US011006692B2

(12) United States Patent
Love et al.

(10) Patent No.: US 11,006,692 B2
(45) Date of Patent: May 18, 2021

(54) SOCCER SHOE

(71) Applicant: adidas AG, Herzogenaurach (DE)

(72) Inventors: Martin Love, Herzogenaurach (DE); Marco Müller, Herzogenaurach (DE); Martin Jobst, Herzogenaurach (DE); Jacky Gilbert Weber, Herzogenaurach (DE)

(73) Assignee: adidas AG, Herzogenaurach (DE)

( * ) Notice: Subject to any disclaimer, the term of this patent is extended or adjusted under 35 U.S.C. 154(b) by 0 days.

(21) Appl. No.: 14/619,586

(22) Filed: Feb. 11, 2015

(65) Prior Publication Data

US 2015/0223552 A1 Aug. 13, 2015

(30) Foreign Application Priority Data

Feb. 11, 2014 (DE) ..... 10 2014 202 432.3

(51) Int. Cl.

| | |
|---|---|
| ***A43B 1/00*** | (2006.01) |
| ***A43B 1/04*** | (2006.01) |
| ***A43B 5/02*** | (2006.01) |
| ***D04B 21/20*** | (2006.01) |
| ***D04B 1/22*** | (2006.01) |
| ***A43C 15/02*** | (2006.01) |

(52) U.S. Cl.

CPC ..... *A43B 5/02* (2013.01); *A43B 1/0009* (2013.01); *A43B 1/04* (2013.01); *A43C 15/02* (2013.01); *D04B 1/22* (2013.01); *D04B 21/207* (2013.01); *D10B 2501/043* (2013.01)

(58) Field of Classification Search

CPC ..... A43B 1/0009; A43B 1/04; A43B 5/02; A43B 23/026; A43C 15/02

USPC ..... 36/45, 106, 128, 133

See application file for complete search history.

(56) References Cited

U.S. PATENT DOCUMENTS

| | | | |
|---|---|---|---|
| 74,962 | A | 2/1868 | Wesson |
| 275,142 | A | 4/1883 | Carter |
| 299,934 | A | 3/1884 | Muller |
| 467,091 | A | 1/1892 | Gernshym |
| 578,153 | A | 3/1897 | Lamb |
| 601,192 | A | 3/1898 | Woodwide |
| 601,894 | A | 4/1898 | Lamb |
| D31,023 | S | 6/1899 | Olmsted |
| 757,424 | A | 4/1904 | Vohl |
| 951,033 | A | 3/1910 | Steber |

(Continued)

FOREIGN PATENT DOCUMENTS

| | | |
|---|---|---|
| AT | 386324 | 10/1988 |
| CA | 989720 | 5/1976 |

(Continued)

OTHER PUBLICATIONS

ISO 8117:2003(E), "Textile Machinery—Knitting Machines—Nominal diameters of circular machines", Second Edition, Feb. 15, 2003, 6 pages.

(Continued)

*Primary Examiner* — Sharon M Prange

(74) *Attorney, Agent, or Firm* — Kilpatrick Townsend & Stockton LLP

(57) ABSTRACT

Described are soccer shoes having an upper formed of knitwear, and a sole having cleats that are connected to the knitwear, wherein the knitwear is capable of coupling the sole to a foot of a wearer of the soccer shoe while the soccer shoe is being worn.

25 Claims, 33 Drawing Sheets

(56) References Cited

U.S. PATENT DOCUMENTS 1,215,198 A 2/1917 Rothstein
1,346,516 A 7/1920 Godfrey
1,370,799 A 3/1921 Egerton
1,413,314 A 4/1922 Bossworth
1,413,537 A 4/1922 Jones
1,538,263 A 5/1925 Ackerman
1,597,934 A 8/1926 Stimpson
1,841,518 A 1/1932 Bellak
1,888,172 A 11/1932 Joha
1,902,780 A 3/1933 Holden et al.
RE18,804 E 4/1933 Joha
1,910,251 A 5/1933 Joha
1,972,609 A 9/1934 Arsdale et al.
2,001,293 A 4/1935 Wilson
2,018,275 A 10/1935 Jack
2,024,180 A 12/1935 Parlante
2,038,844 A 4/1936 Dorf
2,042,146 A 5/1936 Deakin
2,047,724 A 7/1936 Zuckerman
2,048,294 A 7/1936 Roberts
2,069,083 A 1/1937 Percy
2,076,285 A 4/1937 Wiggin
2,126,186 A 8/1938 Friedland
2,147,197 A 2/1939 Glidden
2,150,730 A 3/1939 Schuessler
2,165,092 A 7/1939 Daniels
2,171,654 A 9/1939 Ralph et al.
2,178,941 A 11/1939 Schuessler
2,257,390 A 9/1941 Roy
2,276,920 A 3/1942 Charles et al.
2,292,455 A 8/1942 Hollier et al.
2,297,028 A 9/1942 Sheeler
2,302,167 A 11/1942 Austin
2,314,098 A 3/1943 Raymond
2,319,141 A 5/1943 Kuehnel
2,330,199 A 9/1943 Basch
2,343,390 A 3/1944 Ushakoff
2,364,134 A 12/1944 Dow et al.
2,391,594 A 12/1945 Gaetano
2,400,487 A 5/1946 Clark
2,400,692 A 5/1946 Herbert
2,424,957 A 7/1947 Schletter
2,440,393 A 4/1948 Clark
2,460,674 A 2/1949 Lajos
2,464,301 A 3/1949 Carleton, Jr.
2,467,237 A 4/1949 Sherman et al.
2,516,697 A 7/1950 Haddad
2,538,673 A 1/1951 Ansley
2,569,764 A 10/1951 Jonas
2,584,084 A 1/1952 Rubico
2,586,045 A 2/1952 Hoza
2,603,891 A 7/1952 Gustav
2,608,078 A 8/1952 Anderson
2,623,373 A 12/1952 Vogel
2,641,004 A 6/1953 Whiting et al.
2,675,631 A 4/1954 Doughty
2,679,117 A 5/1954 Reed
2,701,458 A 2/1955 Ducharme
2,712,744 A 7/1955 Miller et al.
2,714,813 A 8/1955 Roscoe
2,783,631 A 3/1957 Sumner
2,811,029 A 10/1957 Conner
2,848,885 A 8/1958 Goodman
2,898,754 A 8/1959 Harms
2,934,839 A * 5/1960 Servin ..... A43B 3/101 36/9 R
2,948,132 A 8/1960 Gift
2,966,785 A 1/1961 Goff et al.
2,983,128 A 5/1961 Goff et al.
2,994,322 A 8/1961 Cullen et al.
3,004,354 A * 10/1961 Kramer ..... A43B 3/101 36/9 R
3,013,564 A 12/1961 Harold
3,015,943 A 1/1962 Guy
3,035,291 A 5/1962 Bingham, Jr.
3,063,074 A 11/1962 Scholl
3,070,909 A 1/1963 Hermann et al.
3,078,699 A 2/1963 Huntley
3,093,916 A 6/1963 Hiestand et al.
3,138,880 A 6/1964 Kunzli
3,159,988 A 12/1964 Reymes
3,217,336 A 11/1965 Joseph
3,228,819 A 1/1966 Bingham, Jr.
3,298,204 A 1/1967 Hoffecker
3,324,220 A 6/1967 Stansfield
3,370,363 A 2/1968 Kaplan
3,416,174 A 12/1968 Novitske
3,425,246 A 2/1969 Knohl
3,550,402 A 12/1970 Colton
3,583,081 A 6/1971 Hayashi
3,616,149 A 10/1971 Wincklhofer et al.
3,620,892 A 11/1971 Wincklhofer et al.
3,635,051 A 1/1972 Betts et al.
3,656,323 A 4/1972 Brown
3,694,940 A 10/1972 Stohr
3,695,063 A 10/1972 Betts et al.
3,704,474 A 12/1972 Winkler
3,766,566 A 10/1973 Tadokoro et al.
3,769,723 A 11/1973 Masterson et al.
3,778,856 A 12/1973 Christie et al.
3,785,173 A 1/1974 Hanney et al.
3,838,583 A 10/1974 Rumi et al.
3,863,272 A 2/1975 Guille
3,867,248 A 2/1975 Bauer
3,884,052 A 5/1975 Findlay et al.
3,952,427 A 4/1976 von den Benken et al.
3,967,390 A 7/1976 Anfruns
3,971,234 A 7/1976 Taylor
3,972,086 A 8/1976 Belli et al.
3,985,003 A 10/1976 Reed
3,985,004 A 10/1976 Johnson et al.
4,027,402 A 6/1977 Liu et al.
4,028,910 A 6/1977 Wignall et al.
4,031,586 A 6/1977 von den Benken et al.
4,038,699 A 8/1977 Burn
4,038,840 A 8/1977 Castello
4,068,395 A 1/1978 Senter
4,075,383 A 2/1978 Anderson et al.
4,111,008 A 9/1978 Robinson et al.
4,120,101 A 10/1978 Drew
4,144,727 A 3/1979 Duhl et al.
4,183,156 A 1/1980 Rudy et al.
4,211,806 A 7/1980 Civardi et al.
4,219,945 A 9/1980 Rudy et al.
4,232,458 A 11/1980 Bartels
4,233,758 A 11/1980 Auberry
4,255,949 A 3/1981 Thorneburg
4,258,480 A 3/1981 Famolare, Jr.
4,265,954 A 5/1981 Romanek
4,276,671 A 7/1981 Melton
4,279,049 A 7/1981 Coiquaud
4,282,657 A 8/1981 Antonious
4,306,315 A 12/1981 Castiglia
4,306,929 A 12/1981 Menikheim et al.
4,317,292 A 3/1982 Melton
4,324,752 A 4/1982 Newton et al.
4,354,318 A 10/1982 Frederick et al.
4,356,643 A 11/1982 Kester et al.
4,373,361 A 2/1983 Thorneburg
4,430,811 A * 2/1984 Okada ..... A43B 1/04 36/30 R
4,447,967 A 5/1984 Zaino
4,465,448 A 8/1984 Aldridge et al.
4,467,626 A 8/1984 Coble et al.
4,523,346 A 6/1985 Auberry et al.
4,531,525 A 7/1985 Richards
4,592,154 A 6/1986 Oatman
4,607,439 A 8/1986 Harada
4,610,685 A 9/1986 Raley
4,624,115 A 11/1986 Safrit et al.
4,642,915 A 2/1987 Pfander
4,651,354 A 3/1987 Petrey
4,663,946 A 5/1987 Wright
4,669,126 A 6/1987 Jones

(56) References Cited

U.S. PATENT DOCUMENTS 4,682,479 A 7/1987 Pernick
4,722,202 A 2/1988 Imboden
4,729,179 A 3/1988 Quist, Jr.
4,737,396 A 4/1988 Kamat et al.
4,750,339 A 6/1988 Simpson, Jr. et al.
4,756,098 A 7/1988 Boggia
4,783,355 A 11/1988 Mueller
4,785,558 A 11/1988 Shiomura
4,813,158 A 3/1989 Brown
4,813,161 A 3/1989 Lesley
4,852,272 A 8/1989 Chilewich et al.
4,899,465 A 2/1990 Bleimhofer et al.
4,941,331 A 7/1990 Cournoyer et al.
4,960,135 A 10/1990 Nelson
5,031,423 A 7/1991 Ikenaga et al.
5,095,720 A 3/1992 Tibbals
5,117,567 A 6/1992 Berger et al.
5,125,116 A 6/1992 Gaither et al.
5,152,025 A 10/1992 Hirmas et al.
5,157,791 A 10/1992 Woodson et al.
5,181,278 A 1/1993 Peleg et al.
5,192,601 A 3/1993 Neisler
5,240,773 A 8/1993 Dunn et al.
5,253,434 A 10/1993 Curley, Jr. et al.
5,291,671 A 3/1994 Caberlotto et al.
5,319,807 A 6/1994 Brier
5,323,627 A 6/1994 Lonati et al.
5,343,639 A 9/1994 Kilgore et al.
5,345,638 A 9/1994 Nishida
5,353,523 A 10/1994 Kilgore et al.
5,353,524 A 10/1994 Brier
5,371,957 A 12/1994 Gaudio et al.
5,385,036 A 1/1995 Spillane et al.
5,388,430 A 2/1995 Essig
5,426,869 A 6/1995 Gore et al.
5,461,884 A 10/1995 McCartney et al.
5,479,791 A 1/1996 Osborne
5,484,646 A 1/1996 Mann
5,505,011 A 4/1996 Bleimhofer
5,511,323 A 4/1996 Dahlgren
5,513,450 A 5/1996 Aviles
5,519,894 A 5/1996 Imboden et al.
5,526,584 A 6/1996 Bleimhofer et al.
5,553,468 A 9/1996 Osborne
5,560,227 A 10/1996 Depoe et al.
5,572,860 A 11/1996 Mitsumoto et al.
5,575,090 A 11/1996 Condini
5,581,817 A 12/1996 Hicks
5,592,836 A 1/1997 Schuster et al.
5,605,060 A 2/1997 Osborne
5,606,808 A 3/1997 Gilliard et al.
5,623,734 A 4/1997 Pugliatti
5,623,840 A 4/1997 Roell
5,709,107 A 1/1998 Jeffcoat
5,711,093 A 1/1998 Aumann
5,711,168 A 1/1998 Proctor et al.
5,722,262 A 3/1998 Proctor et al.
5,729,918 A 3/1998 Smets et al.
5,735,145 A 4/1998 Pernick
5,737,857 A 4/1998 Aumann
5,737,943 A 4/1998 Bernhardt
5,746,013 A 5/1998 Fay
5,765,296 A 6/1998 Ludemann et al.
5,774,898 A 7/1998 Malpee
5,784,806 A 7/1998 Wendt
5,787,503 A 8/1998 Murphy, III
5,791,163 A 8/1998 Throneburg
5,836,179 A 11/1998 Van Laar
5,850,745 A 12/1998 Albright
5,855,123 A 1/1999 Albright
5,884,419 A 3/1999 Davidowitz et al.
5,896,608 A 4/1999 Whatley
5,896,683 A 4/1999 Foxen et al.
5,896,758 A 4/1999 Rock et al.
5,906,007 A 5/1999 Roberts
5,996,189 A 12/1999 Wang et al.
6,021,585 A 2/2000 Cole
6,029,376 A 2/2000 Cass
6,032,387 A 3/2000 Johnson
6,052,921 A 4/2000 Oreck
6,088,936 A 7/2000 Bahl et al.
6,109,068 A 8/2000 Stoll et al.
6,128,835 A 10/2000 Ritter et al.
6,151,802 A 11/2000 Reynolds
6,158,253 A 12/2000 Svoboda et al.
6,170,175 B1 1/2001 Funk et al.
6,173,589 B1 1/2001 Hayes, Jr. et al.
6,192,717 B1 2/2001 Rabinowicz
6,196,030 B1 3/2001 Stoll et al.
6,227,010 B1 5/2001 Roell
6,231,946 B1 5/2001 Brown, Jr. et al.
6,250,115 B1 6/2001 Suzuki
6,272,888 B1 8/2001 Fujita et al.
6,286,233 B1 9/2001 Gaither
6,287,168 B1 9/2001 Rabinowicz
6,299,962 B1 10/2001 Davis et al.
6,301,759 B1 10/2001 Langer et al.
6,308,438 B1 10/2001 Throneburg et al.
6,330,814 B1 12/2001 Fujiwara
6,333,105 B1 12/2001 Tanaka et al.
6,401,364 B1 6/2002 Burt et al.
6,415,632 B1 7/2002 Vesnaver
6,430,844 B1 8/2002 Otis
6,449,878 B1 9/2002 Lyden
6,539,752 B1 4/2003 Apollonio
6,558,784 B1 5/2003 Norton et al.
6,588,237 B2 7/2003 Cole et al.
6,622,312 B2 9/2003 Rabinowicz
6,662,469 B2 12/2003 Urie et al.
6,665,955 B1 12/2003 Mizrahi et al.
6,708,348 B1 3/2004 Romay
6,735,988 B1 5/2004 Honeycutt
6,754,983 B2 6/2004 Hatfield et al.
6,779,369 B2 8/2004 Shepherd
6,871,515 B1 3/2005 Starbuck et al.
6,886,367 B2 5/2005 Mitchell et al.
6,899,591 B2 5/2005 Mitchell
6,910,288 B2 * 6/2005 Dua ..... A43B 1/04 12/146 C
6,922,917 B2 8/2005 Kerns et al.
6,931,762 B1 8/2005 Dua
6,944,975 B2 9/2005 Safdeye et al.
6,984,596 B2 1/2006 Dickerson
6,986,183 B2 1/2006 Delgorgue et al.
6,986,269 B2 * 1/2006 Dua ..... A43B 1/04 66/177
D517,297 S 3/2006 Jones et al.
7,016,867 B2 3/2006 Lyden
7,037,571 B2 5/2006 Fish et al.
7,043,942 B2 5/2006 Chapman
7,047,668 B2 * 5/2006 Burris ..... A43B 5/02 36/133
7,051,460 B2 5/2006 Orei et al.
7,055,267 B2 6/2006 Wilson et al.
7,056,402 B2 6/2006 Koerwien et al.
7,081,221 B2 7/2006 Paratore et al.
7,107,235 B2 9/2006 Lyden
7,131,296 B2 * 11/2006 Dua ..... A43B 1/04 66/178 R
7,179,414 B2 2/2007 Safdeye et al.
7,207,125 B2 4/2007 Jeppesen et al.
7,207,196 B2 4/2007 Lonati et al.
7,207,961 B1 4/2007 Benton et al.
7,240,522 B2 7/2007 Kondou et al.
7,346,935 B1 3/2008 Patterson
7,347,011 B2 3/2008 Dua et al.
7,356,946 B2 4/2008 Hannon et al.
7,441,348 B1 10/2008 Dawson et al.
7,543,397 B2 6/2009 Kilgore et al.
7,568,298 B2 8/2009 Kerns et al.
7,637,032 B2 * 12/2009 Sokolowski ..... A43B 1/04 36/3 A
7,650,705 B2 1/2010 Donnadieu et al.
7,677,061 B2 3/2010 Mori et al.

(56) References Cited

U.S. PATENT DOCUMENTS 7,682,219 B2 3/2010 Falla
7,721,575 B2 5/2010 Yokoyama
7,774,956 B2 8/2010 Dua et al.
7,805,860 B2 10/2010 Fliri et al.
7,814,598 B2 10/2010 Dua et al.
7,854,076 B2 12/2010 Keppler et al.
7,882,648 B2 2/2011 Langvin
8,028,440 B2 10/2011 Sokolowski et al.
8,042,288 B2 10/2011 Dua et al.
8,099,881 B2 * 1/2012 Yamamoto ..... A43B 1/00 12/142 R
8,196,317 B2 6/2012 Dua et al.
8,209,883 B2 7/2012 Lyden
8,215,132 B2 7/2012 Dua et al.
8,225,530 B2 7/2012 Sokolowski et al.
8,266,749 B2 9/2012 Dua et al.
8,296,970 B2 * 10/2012 Jessiman ..... A43B 1/04 36/3 A
D673,765 S 1/2013 Parker et al.
8,448,474 B1 5/2013 Tatler et al.
8,464,383 B2 6/2013 Sing
8,490,299 B2 7/2013 Dua et al.
8,522,577 B2 9/2013 Huffa
8,590,345 B2 11/2013 Sokolowski et al.
8,595,878 B2 12/2013 Farris et al.
8,621,891 B2 1/2014 Shaffer et al.
8,647,460 B1 2/2014 Koo
8,650,916 B2 2/2014 Thomas et al.
8,683,718 B2 4/2014 Fliri et al.
8,701,232 B1 4/2014 Droege et al.
8,745,895 B2 6/2014 Sokolowski et al.
8,745,896 B2 6/2014 Shaffer et al.
8,800,172 B2 8/2014 Dua et al.
8,839,532 B2 9/2014 Huffa et al.
8,881,430 B2 11/2014 Baines et al.
8,898,932 B2 12/2014 Molyneux et al.
8,899,079 B2 12/2014 Podhajny et al.
8,959,800 B2 2/2015 Sokolowski et al.
8,959,959 B1 2/2015 Podhajny et al.
8,973,410 B1 3/2015 Podhajny et al.
8,978,422 B2 3/2015 Podhajny et al.
8,997,529 B1 4/2015 Podhajny et al.
8,997,530 B1 4/2015 Podhajny
9,003,836 B1 4/2015 Podhajny et al.
9,010,157 B1 4/2015 Podhajny et al.
9,027,260 B2 5/2015 Shaffer et al.
9,032,763 B2 5/2015 Meir et al.
9,060,562 B2 6/2015 Meir et al.
9,072,335 B1 7/2015 Podhajny
9,078,488 B1 7/2015 Podhajny et al.
9,084,449 B2 7/2015 Huffman et al.
9,095,187 B2 8/2015 Molyneux et al.
9,132,601 B2 9/2015 Beye et al.
9,139,938 B2 9/2015 Podhajny et al.
9,145,629 B2 9/2015 Podhajny
9,150,986 B2 10/2015 Shaffer et al.
9,192,204 B1 11/2015 Klug et al.
9,226,540 B2 1/2016 Podhajny et al.
9,297,097 B2 3/2016 Turner
9,301,567 B2 4/2016 Roulo et al.
9,339,076 B2 5/2016 Podhajny et al.
9,353,469 B2 5/2016 Meir et al.
9,357,813 B2 6/2016 Lyden
9,365,959 B2 6/2016 Turner
9,375,046 B2 6/2016 Meir
9,398,784 B2 7/2016 Baudouin et al.
9,498,023 B2 11/2016 Binder
9,723,890 B2 * 8/2017 Long ..... A43B 1/04
2001/0016993 A1 8/2001 Cagner
2001/0024709 A1 9/2001 Yoneda et al.
2001/0032399 A1 10/2001 Litchfield et al.
2001/0054240 A1 12/2001 Bordin et al.
2001/0055684 A1 12/2001 Davis et al.
2002/0000002 A1 1/2002 Hatch et al.
2002/0002780 A1 1/2002 Barthelemy et al.
2002/0007570 A1 1/2002 Girard
2002/0012784 A1 1/2002 Norton et al.
2002/0026730 A1 3/2002 Whatley
2002/0035796 A1 3/2002 Knoche et al.
2002/0053148 A1 5/2002 Haimerl
2002/0078599 A1 6/2002 Delgorgue et al.
2002/0092199 A1 7/2002 Fish et al.
2002/0148142 A1 10/2002 Oorei et al.
2002/0148258 A1 10/2002 Cole et al.
2002/0152638 A1 10/2002 Safdeye et al.
2002/0157281 A1 10/2002 Safdeye et al.
2003/0009908 A1 1/2003 Sheets et al.
2003/0009919 A1 1/2003 Stein
2003/0033837 A1 2/2003 Higgins
2003/0039882 A1 2/2003 Wruck et al.
2003/0051372 A1 3/2003 Lyden
2003/0069807 A1 4/2003 Lyden
2003/0079374 A1 5/2003 Belley et al.
2003/0097766 A1 5/2003 Morgan
2003/0106171 A1 6/2003 Issler
2003/0121179 A1 7/2003 Chen
2003/0126762 A1 7/2003 Tseng
2003/0131499 A1 7/2003 Silverman
2003/0191427 A1 10/2003 Jay et al.
2003/0192351 A1 10/2003 Meckley et al.
2003/0226280 A1 12/2003 Paratore et al.
2003/0227105 A1 12/2003 Paratore et al.
2004/0009731 A1 1/2004 Rabinowicz
2004/0045955 A1 3/2004 Rock et al.
2004/0083622 A1 5/2004 Mizrahi et al.
2004/0107603 A1 6/2004 Wei
2004/0111920 A1 6/2004 Cretinon
2004/0111921 A1 6/2004 Lenormand
2004/0118018 A1 6/2004 Dua
2004/0139628 A1 7/2004 Wiener
2004/0139629 A1 7/2004 Wiener
2004/0143995 A1 7/2004 McClelland
2004/0163280 A1 8/2004 Morris et al.
2004/0181972 A1 9/2004 Csorba
2004/0198178 A1 10/2004 Mitchell et al.
2004/0205982 A1 10/2004 Challe
2004/0216332 A1 11/2004 Wilson et al.
2004/0226113 A1 11/2004 Wright et al.
2004/0255486 A1 12/2004 Pawlus et al.
2004/0261467 A1 12/2004 Chapman
2005/0016023 A1 1/2005 Burris et al.
2005/0028405 A1 2/2005 Wilson et al.
2005/0055843 A1 3/2005 Morlacchi
2005/0081402 A1 4/2005 Orei et al.
2005/0091725 A1 5/2005 Alley et al.
2005/0102863 A1 5/2005 Hannon et al.
2005/0108898 A1 5/2005 Jeppesen et al.
2005/0115281 A1 6/2005 Mitchell et al.
2005/0115284 A1 6/2005 Dua
2005/0127057 A1 6/2005 Rock et al.
2005/0138845 A1 6/2005 Haimerl
2005/0155137 A1 7/2005 Berger
2005/0166426 A1 8/2005 Donnadieu et al.
2005/0166427 A1 8/2005 Greene et al.
2005/0193592 A1 9/2005 Dua et al.
2005/0208857 A1 9/2005 Baron et al.
2005/0268497 A1 12/2005 Alfaro et al.
2005/0273988 A1 12/2005 Christy et al.
2005/0284000 A1 12/2005 Kerns
2006/0006168 A1 1/2006 Rock et al.
2006/0016099 A1 1/2006 Marco et al.
2006/0021258 A1 2/2006 Beck
2006/0048413 A1 3/2006 Sokolowski et al.
2006/0059715 A1 3/2006 Aveni
2006/0059716 A1 3/2006 Yamashita et al.
2006/0117607 A1 6/2006 Pare et al.
2006/0130359 A1 6/2006 Dua et al.
2006/0162187 A1 7/2006 Byrnes et al.
2006/0179549 A1 8/2006 Huggins et al.
2006/0243000 A1 11/2006 Turlan et al.
2007/0000027 A1 1/2007 Ganzoni et al.
2007/0003728 A1 1/2007 Hannon et al.
2007/0022627 A1 2/2007 Sokolowski et al.
2007/0074334 A1 4/2007 Steel et al.

(56) References Cited

U.S. PATENT DOCUMENTS

2007/0144039 A1 6/2007 Fliri
2007/0180730 A1 8/2007 Greene et al.
2007/0234593 A1 10/2007 Beck
2007/0271817 A1 11/2007 Ellis, III
2008/0000108 A1 1/2008 Ellis, III
2008/0010860 A1 1/2008 Gyr
2008/0017294 A1 1/2008 Bailey et al.
2008/0032580 A1 2/2008 Fukuoka et al.
2008/0066499 A1 3/2008 Andrieu et al.
2008/0078102 A1 4/2008 Kilgore et al.
2008/0110048 A1 5/2008 Dua et al.
2008/0110049 A1 5/2008 Sokolowski et al.
2008/0189830 A1 8/2008 Egglesfield et al.
2008/0250668 A1* 10/2008 Marvin ..... A43B 9/12 36/54
2008/0263893 A1 10/2008 Hernandez et al.
2008/0295230 A1 12/2008 Wright et al.
2008/0313939 A1 12/2008 Ardill et al.
2009/0068908 A1 3/2009 Hinchcliff et al.
2009/0071036 A1 3/2009 Hooper et al.
2009/0107012 A1 4/2009 Cheney et al.
2009/0126225 A1 5/2009 Jarvis
2009/0126229 A1 5/2009 Fuerst et al.
2009/0134145 A1 5/2009 Rock et al.
2009/0172971 A1 7/2009 Peikert et al.
2009/0241374 A1 10/2009 Sato et al.
2009/0297794 A1 12/2009 Lin
2010/0018075 A1 1/2010 Meschter et al.
2010/0043253 A1 2/2010 Dojan et al.
2010/0051132 A1 3/2010 Glenn et al.
2010/0064453 A1 3/2010 Haimerl
2010/0107346 A1 5/2010 Aveni
2010/0107443 A1 5/2010 Aveni
2010/0154256 A1 6/2010 Dua
2010/0162590 A1 7/2010 Bonigk
2010/0170651 A1 7/2010 Scherb et al.
2010/0175276 A1 7/2010 Dojan et al.
2010/0269372 A1 10/2010 Dua et al.
2010/0299962 A1 12/2010 Fliri
2011/0030244 A1 2/2011 Motawi et al.
2011/0061149 A1 3/2011 Polacco et al.
2011/0061265 A1 3/2011 Lyden
2011/0078921 A1 4/2011 Greene et al.
2011/0088282 A1 4/2011 Dojan et al.
2011/0154689 A1 6/2011 Chung
2011/0154693 A1 6/2011 Oberschneider
2011/0179677 A1 7/2011 Jessiman et al.
2011/0219643 A1 9/2011 Tai
2011/0283567 A1 11/2011 Yin
2011/0302727 A1 12/2011 Sokolowski et al.
2011/0302810 A1 12/2011 Borel et al.
2011/0308108 A1 12/2011 Berns et al.
2011/0308110 A1* 12/2011 Berns ..... A43B 3/0063 36/89
2012/0023686 A1 2/2012 Huffa et al.
2012/0023778 A1 2/2012 Dojan et al.
2012/0055044 A1 3/2012 Dojan et al.
2012/0090077 A1 4/2012 Brown et al.
2012/0114883 A1 5/2012 Kapur et al.
2012/0144699 A1 6/2012 Eggert et al.
2012/0159813 A1 6/2012 Dua et al.
2012/0180195 A1 7/2012 Shull et al.
2012/0198730 A1 8/2012 Burch et al.
2012/0204448 A1 8/2012 Bracken
2012/0216423 A1 8/2012 Lyden
2012/0216430 A1 8/2012 Stohr
2012/0233878 A1 9/2012 Hazenberg et al.
2012/0233879 A1 9/2012 Dojan et al.
2012/0233880 A1 9/2012 Chao et al.
2012/0233882 A1 9/2012 Huffa et al.
2012/0233883 A1 9/2012 Spencer et al.
2012/0233884 A1 9/2012 Greene
2012/0233885 A1 9/2012 Shaffer et al.
2012/0233886 A1 9/2012 Madore et al.
2012/0233887 A1 9/2012 Baker et al.
2012/0233888 A1 9/2012 Baker et al.
2012/0234051 A1 9/2012 Huffa
2012/0234052 A1 9/2012 Huffa et al.
2012/0234111 A1 9/2012 Molyneux et al.
2012/0234467 A1 9/2012 Rapaport et al.
2012/0235322 A1 9/2012 Greene et al.
2012/0238376 A1 9/2012 Knight et al.
2012/0238910 A1 9/2012 Nordstrom
2012/0240429 A1 9/2012 Sokolowski et al.
2012/0246973 A1 10/2012 Dua
2012/0255201 A1 10/2012 Little
2012/0272548 A1 11/2012 Downard et al.
2012/0279260 A1 11/2012 Dua et al.
2012/0285039 A1 11/2012 Lazaris et al.
2012/0285043 A1 11/2012 Dua et al.
2012/0297557 A1 11/2012 Koo et al.
2012/0297642 A1 11/2012 Schaefer et al.
2012/0297643 A1 11/2012 Shaffer et al.
2012/0297645 A1 11/2012 Berbert et al.
2012/0318026 A1 12/2012 Dua et al.
2013/0031801 A1 2/2013 Hatfield et al.
2013/0036629 A1 2/2013 Bramani et al.
2013/0047471 A1 2/2013 Liang
2013/0055590 A1 3/2013 Mokos
2013/0061405 A1 3/2013 Haimerl
2013/0091741 A1 4/2013 Frank
2013/0118031 A1 5/2013 Chenciner et al.
2013/0139407 A1 6/2013 Brongers et al.
2013/0145652 A1 6/2013 Podhajny et al.
2013/0152424 A1 6/2013 Dojan
2013/0160323 A1 6/2013 Hsiao
2013/0174449 A1 7/2013 Koyess et al.
2013/0219749 A1 8/2013 Dojan et al.
2013/0232820 A1 9/2013 Bramani et al.
2013/0239438 A1 9/2013 Dua et al.
2013/0255103 A1 10/2013 Dua et al.
2013/0260104 A1 10/2013 Dua et al.
2013/0260629 A1 10/2013 Dua et al.
2013/0269209 A1 10/2013 Lang
2014/0068968 A1 3/2014 Podhajny et al.
2014/0082965 A1 3/2014 Greene et al.
2014/0101824 A1 4/2014 Spanks et al.
2014/0123409 A1 5/2014 Huffa et al.
2014/0130373 A1 5/2014 Baines et al.
2014/0130374 A1 5/2014 Minami et al.
2014/0130375 A1 5/2014 Baines et al.
2014/0130376 A1 5/2014 Fahmi et al.
2014/0137433 A1 5/2014 Craig et al.
2014/0137434 A1 5/2014 Craig
2014/0144190 A1 5/2014 Tatler et al.
2014/0150292 A1* 6/2014 Podhajny ..... A43B 23/0205 36/50.1
2014/0150295 A1 6/2014 Dua et al.
2014/0150296 A1 6/2014 Dua et al.
2014/0157831 A1 6/2014 Huffa et al.
2014/0196314 A1 7/2014 Beye et al.
2014/0209233 A1 7/2014 Dua et al.
2014/0237855 A1 8/2014 Podhajny et al.
2014/0237856 A1 8/2014 Podhajny et al.
2014/0238082 A1 8/2014 Meir et al.
2014/0238083 A1 8/2014 Meir et al.
2014/0245544 A1 9/2014 Huffa et al.
2014/0245546 A1 9/2014 Huffa et al.
2014/0245547 A1 9/2014 Molyneux et al.
2014/0245633 A1 9/2014 Podhajny et al.
2014/0245634 A1 9/2014 Podhajny et al.
2014/0245636 A1 9/2014 Seamarks et al.
2014/0245637 A1 9/2014 Fahmi et al.
2014/0245639 A1 9/2014 Dua et al.
2014/0245643 A1 9/2014 Huffa et al.
2014/0310983 A1 10/2014 Tamm et al.
2014/0310984 A1 10/2014 Tamm et al.
2014/0310985 A1 10/2014 Tran et al.
2014/0310986 A1 10/2014 Tamm et al.
2014/0338226 A1 11/2014 Zavala
2014/0352082 A1 12/2014 Shaffer et al.
2014/0352173 A1 12/2014 Bell et al.
2015/0013080 A1 1/2015 Thomas et al.
2015/0013188 A1 1/2015 Baines et al.

(56) References Cited

U.S. PATENT DOCUMENTS

| | | | |
|---|---|---|---|
| 2015/0013394 | A1 | 1/2015 | Huffa |
| 2015/0013395 | A1 | 1/2015 | Huffa |
| 2015/0040431 | A1 | 2/2015 | Molyneux et al. |
| 2015/0047225 | A1 | 2/2015 | Dealey et al. |
| 2015/0059209 | A1* | 3/2015 | Dekovic ..... A43B 23/02 36/84 |
| 2015/0059211 | A1 | 3/2015 | Podhajny et al. |
| 2015/0075031 | A1 | 3/2015 | Podhajny et al. |
| 2015/0101212 | A1 | 4/2015 | Dekovic et al. |
| 2015/0143716 | A1 | 5/2015 | Savage et al. |
| 2015/0143720 | A1 | 5/2015 | Avar et al. |
| 2015/0216254 | A1 | 8/2015 | Podhajny et al. |
| 2015/0216255 | A1 | 8/2015 | Podhajny |
| 2015/0216257 | A1 | 8/2015 | Meir et al. |
| 2015/0250256 | A1 | 9/2015 | Podhajny et al. |
| 2015/0264995 | A1 | 9/2015 | Hilderbrand, IV |
| 2015/0272261 | A1 | 10/2015 | Huffman et al. |
| 2015/0342285 | A1 | 12/2015 | Bell et al. |
| 2015/0359290 | A1 | 12/2015 | Podhajny et al. |
| 2015/0366293 | A1 | 12/2015 | Clarkson et al. |
| 2016/0029736 | A1 | 2/2016 | Meir |
| 2016/0088894 | A1 | 3/2016 | Podhajny et al. |
| 2016/0088899 | A1 | 3/2016 | Klug et al. |
| 2016/0090670 | A1 | 3/2016 | Meir |
| 2016/0095377 | A1 | 4/2016 | Tamm |
| 2016/0198797 | A1 | 7/2016 | Ikenaka |
| 2016/0206039 | A1 | 7/2016 | Cross et al. |
| 2016/0206040 | A1 | 7/2016 | Cross et al. |
| 2016/0206042 | A1 | 7/2016 | Cross et al. |
| 2016/0206046 | A1 | 7/2016 | Cross |
| 2016/0295971 | A1 | 10/2016 | Arnese et al. |
| 2017/0156434 | A1 | 6/2017 | Tamm et al. |
| 2017/0311650 | A1 | 11/2017 | Hupperets et al. |
| 2018/0064201 | A1 | 3/2018 | Tran et al. |

FOREIGN PATENT DOCUMENTS

| | | |
|---|---|---|
| CA | 2387640 | 4/2003 |
| CN | 2044806 | 9/1989 |
| CN | 1067566 | 1/1993 |
| CN | 2187379 | 1/1995 |
| CN | 2438730 | 7/2001 |
| CN | 1392833 | 1/2003 |
| CN | 1411762 | 4/2003 |
| CN | 1429512 | 7/2003 |
| CN | 1155597 | 6/2004 |
| CN | 1960650 | 5/2007 |
| CN | 101316526 | 12/2008 |
| CN | 201356120 | 12/2009 |
| CN | 102939023 | 2/2013 |
| CN | 104413996 | 3/2015 |
| DE | 71153 | 4/1893 |
| DE | 627878 | 7/1936 |
| DE | 870963 | 3/1953 |
| DE | 1736512 | 12/1956 |
| DE | 1785183 | 3/1959 |
| DE | 1084173 | 6/1960 |
| DE | 1910713 | 7/1970 |
| DE | 1785183 | 11/1971 |
| DE | 2044031 | 3/1972 |
| DE | 1685690 | 1/1973 |
| DE | 2162456 | 6/1973 |
| DE | 2305693 | 8/1973 |
| DE | 2505537 | 8/1976 |
| DE | 2801984 | 7/1979 |
| DE | 3820094 | 12/1989 |
| DE | 4400739 | 7/1995 |
| DE | 68922952 | 11/1995 |
| DE | 4419802 | 12/1995 |
| DE | 4419803 | 12/1995 |
| DE | 4441555 | 6/1996 |
| DE | 19629317 | 10/1997 |
| DE | 19738433 | 4/1998 |
| DE | 19728848 | 1/1999 |
| DE | 4443002 | 2/1999 |
| DE | 19855542 | 6/2000 |
| DE | 19910785 | 9/2000 |
| DE | 10022254 | 11/2001 |
| DE | 10037728 | 2/2002 |
| DE | 10145073 | 4/2003 |
| DE | 10228143 | 11/2003 |
| DE | 3903242 | 7/2004 |
| DE | 4138836 | 7/2004 |
| DE | 19910785 | 12/2004 |
| DE | 602004000536 | 12/2006 |
| DE | 102005030651 | 1/2007 |
| DE | 10316979 | 2/2007 |
| DE | 60031821 | 9/2007 |
| DE | 102006009974 | 9/2007 |
| DE | 102006022494 | 11/2007 |
| DE | 202007011165 | 1/2008 |
| DE | 202009010225 | 2/2010 |
| DE | 202009011928 | 2/2010 |
| DE | 102009018942 | 11/2010 |
| DE | 102009028627 | 3/2011 |
| DE | 102010037585 | 3/2012 |
| DE | 102011055154 | 5/2012 |
| DE | 202012100938 | 5/2012 |
| DE | 202007019490 | 1/2013 |
| DE | 202009018763 | 4/2013 |
| DE | 202009018765 | 4/2013 |
| DE | 102012206062 | 10/2013 |
| DE | 202012013113 | 11/2014 |
| DE | 202012013114 | 11/2014 |
| DE | 202012013118 | 11/2014 |
| DE | 202012013119 | 11/2014 |
| DE | 202012013120 | 11/2014 |
| EP | 0037629 | 10/1981 |
| EP | 45372 | 2/1982 |
| EP | 0105773 | 4/1984 |
| EP | 279950 | 8/1988 |
| EP | 0384059 | 8/1990 |
| EP | 446583 | 9/1991 |
| EP | 0472743 | 3/1992 |
| EP | 499710 | 8/1992 |
| EP | 508712 | 10/1992 |
| EP | 0664092 | 7/1995 |
| EP | 448714 | 7/1996 |
| EP | 728860 | 8/1996 |
| EP | 0733732 | 9/1996 |
| EP | 758693 | 2/1997 |
| EP | 845553 | 6/1998 |
| EP | 864681 | 9/1998 |
| EP | 898002 | 2/1999 |
| EP | 0959704 | 12/1999 |
| EP | 1004829 | 5/2000 |
| EP | 1031656 | 8/2000 |
| EP | 1091033 | 4/2001 |
| EP | 0758693 | 10/2001 |
| EP | 0833000 | 3/2002 |
| EP | 1219191 | 7/2002 |
| EP | 1233091 | 8/2002 |
| EP | 1273693 | 1/2003 |
| EP | 1275761 | 1/2003 |
| EP | 1437057 | 7/2004 |
| EP | 1148161 | 4/2005 |
| EP | 1563752 | 8/2005 |
| EP | 1602762 | 12/2005 |
| EP | 1352118 | 10/2006 |
| EP | 1972706 | 9/2008 |
| EP | 2023762 | 2/2009 |
| EP | 2079336 | 7/2009 |
| EP | 2088887 | 8/2009 |
| EP | 1571938 | 11/2009 |
| EP | 2248434 | 11/2010 |
| EP | 2378910 | 10/2011 |
| EP | 1919321 | 8/2012 |
| EP | 2485619 | 8/2012 |
| EP | 2520188 | 11/2012 |
| EP | 1571938 | 5/2013 |
| EP | 2088887 | 5/2013 |
| EP | 2591694 | 5/2013 |
| EP | 2649898 | 10/2013 |

(56) References Cited

FOREIGN PATENT DOCUMENTS

| | | | |
|---|---|---|---|
| EP | 2716177 | | 7/2014 |
| EP | 2803283 | | 1/2015 |
| EP | 2904920 | | 8/2015 |
| EP | 2952346 | | 12/2015 |
| EP | 2977205 | | 1/2016 |
| EP | 2686467 | | 4/2016 |
| EP | 2713793 | | 6/2016 |
| EP | 2505092 | | 8/2016 |
| FR | 858875 | | 12/1940 |
| FR | 862088 | | 2/1941 |
| FR | 2171172 | | 9/1973 |
| FR | 2491739 | | 9/1982 |
| FR | 2506576 | | 12/1984 |
| FR | 2504786 | | 1/1986 |
| FR | 2648684 | | 12/1990 |
| FR | 2776485 | | 4/2000 |
| FR | 2780619 | | 9/2000 |
| FR | 2784550 | | 1/2001 |
| FR | 2848807 | | 7/2013 |
| GB | 109091 | | 8/1917 |
| GB | 273968 | | 7/1927 |
| GB | 323457 | | 1/1930 |
| GB | 413279 | | 7/1934 |
| GB | 538865 | | 8/1941 |
| GB | 674835 | | 7/1952 |
| GB | 761519 | | 11/1956 |
| GB | 782562 | | 9/1957 |
| GB | 832518 | | 4/1960 |
| GB | 1102447 | | 2/1968 |
| GB | 1219433 | | 1/1971 |
| GB | 1328693 | | 8/1973 |
| GB | 1539886 | | 2/1979 |
| GB | 2018837 | | 10/1979 |
| GB | 1572493 | | 7/1980 |
| GB | 1581999 | | 12/1980 |
| GB | 1603487 | | 11/1981 |
| GB | 2044073 | | 3/1983 |
| GB | 2131677 | | 6/1984 |
| GB | 2133273 | | 7/1984 |
| GB | 2214939 | | 4/1992 |
| GB | 317184 | | 8/2003 |
| GB | 413017 | | 7/2004 |
| GB | 2408190 | | 5/2005 |
| JP | S39-16845 | U | 6/1939 |
| JP | S59-166706 | U | 11/1984 |
| JP | S63-057909 | U | 4/1988 |
| JP | 02079336 | | 3/1990 |
| JP | H02-116806 | U | 9/1990 |
| JP | H03-033203 | U | 1/1991 |
| JP | H05-176804 | A | 7/1993 |
| JP | H06-068722 | Y2 | 3/1994 |
| JP | 06113905 | | 4/1994 |
| JP | H06-154001 | A | 6/1994 |
| JP | H06-248501 | A | 9/1994 |
| JP | H06-296507 | A | 10/1994 |
| JP | H0759604 | | 3/1995 |
| JP | H07-148004 | A | 6/1995 |
| JP | H07-246101 | | 9/1995 |
| JP | 08109553 | | 4/1996 |
| JP | H09 047302 | A | 2/1997 |
| JP | H09-238701 | A | 9/1997 |
| JP | H10-000103 | A | 1/1998 |
| JP | H10-130991 | A | 5/1998 |
| JP | H10-155504 | A | 6/1998 |
| JP | H10-179209 | A | 7/1998 |
| JP | H03-064834 | U | 5/1999 |
| JP | H11-229253 | A | 8/1999 |
| JP | 11302943 | | 11/1999 |
| JP | 2000-015732 | A | 1/2000 |
| JP | 2000-279201 | A | 10/2000 |
| JP | 2001017206 | | 1/2001 |
| JP | 2001-104091 | A | 4/2001 |
| JP | 2001-164407 | A | 6/2001 |
| JP | 2001-164444 | A | 6/2001 |
| JP | 2002-088512 | | 3/2002 |
| JP | 2002146654 | | 3/2002 |
| JP | 2004-230151 | | 8/2004 |
| JP | 2004-283586 | | 10/2004 |
| JP | 2006-150064 | A | 6/2006 |
| JP | 2006-249586 | A | 9/2006 |
| JP | 3865307 | B2 | 1/2007 |
| JP | 2007204864 | | 8/2007 |
| JP | 2007236612 | | 9/2007 |
| JP | 2007239151 | | 9/2007 |
| JP | 4376792 | | 12/2009 |
| JP | 2010-030289 | A | 2/2010 |
| JP | 2010-163712 | A | 7/2010 |
| JP | 2010-275649 | A | 12/2010 |
| JP | 2011-256506 | A | 12/2011 |
| JP | 2012-500071 | A | 1/2012 |
| JP | 4851688 | B2 | 1/2012 |
| JP | 2012062615 | | 3/2012 |
| JP | 2012512698 | | 6/2012 |
| JP | 2012-522551 | A | 9/2012 |
| JP | 2012533404 | | 12/2012 |
| JP | 2013-151783 | A | 8/2013 |
| JP | 2015-025223 | A | 2/2015 |
| NL | 7304678 | | 10/1974 |
| NL | 7505389 | | 11/1975 |
| WO | 9003744 | | 4/1990 |
| WO | 9221806 | | 12/1992 |
| WO | 9843506 | | 10/1998 |
| WO | 9914415 | | 3/1999 |
| WO | 9943229 | | 9/1999 |
| WO | 0032861 | | 6/2000 |
| WO | 0033694 | | 6/2000 |
| WO | 0112003 | | 2/2001 |
| WO | 0112004 | | 2/2001 |
| WO | 0231247 | | 4/2002 |
| WO | 0241721 | | 5/2002 |
| WO | 02072325 | | 9/2002 |
| WO | 2004064558 | | 8/2004 |
| WO | 2004066770 | | 8/2004 |
| WO | 2004098333 | | 11/2004 |
| WO | 2005004656 | | 1/2005 |
| WO | 2005025841 | | 3/2005 |
| WO | 2005055754 | | 6/2005 |
| WO | 2005074737 | | 8/2005 |
| WO | 2007005459 | | 1/2007 |
| WO | 2009143000 | | 11/2009 |
| WO | 2010020391 | | 2/2010 |
| WO | 2010090923 | | 8/2010 |
| WO | 2011108954 | | 9/2011 |
| WO | 2011138639 | | 11/2011 |
| WO | 2012018731 | | 2/2012 |
| WO | 2012125473 | | 9/2012 |
| WO | 2012125483 | | 9/2012 |
| WO | 2012125490 | | 9/2012 |
| WO | 2012138488 | | 10/2012 |
| WO | 2012151408 | | 11/2012 |
| WO | 2012166602 | | 12/2012 |
| WO | 2012166607 | | 12/2012 |
| WO | 2013126314 | | 8/2013 |
| WO | 2013192363 | | 12/2013 |
| WO | 2014078152 | | 5/2014 |
| WO | 2014078158 | | 5/2014 |
| WO | 2014078160 | | 5/2014 |
| WO | 2014078161 | | 5/2014 |
| WO | 2014081680 | | 5/2014 |
| WO | 2014085205 | | 6/2014 |
| WO | 2014085206 | | 6/2014 |
| WO | 2014113352 | | 7/2014 |
| WO | 2014134236 | | 9/2014 |
| WO | 2014134237 | | 9/2014 |
| WO | 2014134239 | | 9/2014 |
| WO | 2014134242 | | 9/2014 |
| WO | 2014134244 | | 9/2014 |
| WO | 2014134247 | | 9/2014 |
| WO | 2014137825 | | 9/2014 |
| WO | 2015030914 | | 3/2015 |
| WO | 2015076893 | | 5/2015 |

(56) References Cited

FOREIGN PATENT DOCUMENTS

| | | |
|---|---|---|
| WO | 2015134648 | 9/2015 |
| WO | 2016018904 | 2/2016 |

OTHER PUBLICATIONS

Burall, Paul, "CoID Design Awards", Design, Jun. 1969, pp. 46-47.
IPR2016-00920, Petition for Inter Partes Review of U.S. Pat. No. 8,042,288 filed Apr. 19, 2016, 67 pages.
IPR2016-00920, Exhibit 1003, Declaration of Lenny M. Holden, Apr. 19, 2016, 166 pages.
IPR2016-00921, Petition for Inter Partes Review of U.S. Pat. No. 7,814,598 filed Apr. 19, 2016, 57 pages.
IPR2016-00922, Petition for Inter Partes Review of U.S. Pat. No. 8,266,749 filed Apr. 19, 2016, 67 pages.
IPR2016-00921 and IPR-00922, Exhibit 1003, Declaration of Lenny M. Holden, Apr. 19, 2016, 154 pages.
Chinese Patent Application No. 201510071264.0, Office Action dated Mar. 28, 2016, 9 pages (No English translation available. A summary of the Office Action is provided in the Transmittal Letter submitted herewith).
"From Fiber to Fabric: Silk", Clothing and Textiles, Utah State University Cooperative Extension, http://extension.usu.edu./tiles/publications/factsheet/FC_Clothing&Textiles_2012-25pr.pdf, 2011, 3 pages.
*Robert M. Lyden* v. *adidas America, Inc*., adidas AG, adidas International Marketing B.V., The Finish Line, Inc., and Dick's Sporting Goods, Inc., "Original Complaint", Case No. 3:14-CV-1586 MO, United States District Court, District of Oregon, Portland Division, filed Oct. 8, 2014, 54 pages.
Freshness Magazine (Youtube Video), "The Story Behind Nike Flyknit Technology", http://web.archive.org/web/20120225004803/http://www.freshnessmag.com/2012/02/21/the-story-behind-nike-flyknit-technology-video, published on Feb. 21, 2012, 3 pages (website screenshot submitted).
Reissue U.S. Appl. No. 95/002,094, "Patent Owner's Rebuttal Brief", filed Sep. 3, 2014, 40 pages.
Reissue U.S. Appl. No. 95/002,094, "Patent Owner's Rebuttal Brief ", filed Sep. 22, 2014, 25 pages.
Underwood, Jenny, "The Design of 3D Shape Knitted Preforms", Ph.D. Thesis for School of Fashion and Textile, Design and Social Context Portfolio, RMIT University, Nov. 2009, 201 pages.
European Application No. 15154607.4, Extended European Search Report dated Jul. 20, 2015, 9 pages.
U.S. Appl. No. 14/257,668, Tamm et al.
U.S. Appl. No. 14/257,706, Tran et al.
U.S. Appl. No. 14/257,719, Tamm et al.
U.S. Appl. No. 14/257,737, Tamm et al.
Page 1 of Lyden Letter dated Apr. 21, 2010, redacted.
Eberle et al., Excerpt from Clothing Technology, 2002, 3 pages.
Compendium Warp Knitting, Sonderdruck, Karl Mayer GmbH, Aug. 1, 1978, 8 pages.
Duolastic—an elastic fabric sets new standards, HKS 1 MSU E-Magazine—weft elastic tricot machine, Sonderdruck, Karl Mayer GmbH, Aug. 4, 1989, 8 pages.
Fabric Pictures, www.karlmayer.com, Karl Mayer GmbH, undated, 7 pages.
Jacquard Rashchel machine for the Production of Curtains, Karl Mayer GmbH, Jan. 12, 1996, 4 pages.
Knitting Wear, SM8 Top 1, Santoni S.p.A. undated, 2 pages.
MRSS 42 SU: for producing the finest laces with ground in 22 dtex monofilaments, Sonderdruck, Karl Mayer GmbH, Aug. 4, 1988, 3 pages.
Multibar Jacquard Raschel Machine for Lace, Net Curtains and Patterned Elastic Products, Sonderdruck, Karl Mayer GmbH, Aug. 4, 1978, 6 pages.
Exhibit 2008, Decision on Appeal in Reexam U.S. Appl. No. 95/001,320, filed in IPR2013-00067 on Dec. 28, 2012, 37 pages.
Anand et al., Technical Fabric Structures—2. Knitted Fabrics, Handbook of Technical Textiles, Woodhead Publishing, 2000, 5 pages.
Chinese Patent Application No. 2005800066703, Office Action dated Jun. 13, 2008, 17 pages.
Chinese Patent Application No. 2005800066703, Office Action dated Jul. 27, 2007, 18 pages.
Chinese Patent Application No. 2005800066703, Office Action dated Aug. 21, 2009, 19 pages.
Chinese Patent Application No. 2005800066703, Office Action dated Feb. 15, 2008, 6 pages.
Chinese Patent Application No. 2009101783949, Office Action dated May 13, 2011, 13 pages.
German Patent Application No. 102014202432.3, First Office Action dated Jan. 7, 2015, 5 pages (no English translation available—summary provided in Transmittal Letter submitted herewith).
Ebrlle et al., Clothing Technology, Sixth German Edition and Third English Edition, Veriag Europa-Lehrmittel, Nourney, Vollmer GmbH & Co., D-42781 Haa-Guriten, ISBN 3-8085-6223-4, Nov. 28, 2012, 3 pages.
Exhibit 2004, R. Shishoo, Chapter 16 of Textiles in Sport, filed in IPR2013-00067 on Nov. 28, 2012, 22 pages.
Decision Institution of Inter Partes Review 37 C.F.R. § 42.108, filed in IPR2013-00067 on May 17, 2013, 38 pages.
Decision Motion to Withdraw § 42.10(e) filed in IPR2013-00067 on Oct. 30, 2013, 3 pages.
Exhibit 1001, Declaration and Curriculum Vitae of Dr. Edward C. Frederick filed in IPR2013-00067 on Nov. 28, 2012, 178 pages.
Exhibit 2002, Declaration Edward C. Frederick with note filed in IPR2013-00067 on Aug. 19, 2013, 23 pages.
Exhibit 2010, Declaration of Raymond Tonkel filed in IPR2013-00067 on Aug. 19, 2013, 101 pages.
Exhibit 2009, Edward Frederick Deposition Transcript filed in IPR2013-00067 on Jul. 23, 2013, 187 pages.
Exhibit 2013, Errata Sheet from Edward Frederick Deposition filed in IPR2013-00067 on Aug. 29, 2013, 1 page.
Exhibit 2012, Excerpts from Man-Made Fiber and Textile Dictionary filed in IPR2013-00067 on Aug. 19, 2013, 4 pages.
Exhibit 1015, Cross Examination Deposition of Raymond Tonkel filed in IPR2013-00067 on Nov. 12, 2013, 114 pages.
Exhibit 1016, Declaration of Sabut Adanur Ph.D. filed in IPR2013-00067 on Nov. 12, 2013, 57 pages.
Exhibit 1017, Excerpt of Knitted Fabrics filed in IPR2013-00067 on Nov. 12, 2013, 73 pages.
Exhibit 1018, Excerpt of Bharat J. Gaijar, Wrap Knit Fabrics filed in IPR2013-00067 on Nov. 12, 2013, 16 pages.
Exhibit 1019, J. Watel, the Milanese Machine: Little Progress Made in Development of Milanese Fabric filed in IPR2013-00067 on Nov. 12, 2013, 4 pages.
Exhibit 1023, Supplemental Declaration of Edward C. Frederick filed in IPR2013-00067 on Nov. 12, 2013, 18 pages.
Exhibit 1024, Billy Hunter, Editor Viewpoint: Nike Flyknit: Quantum Leap for Flat Knitting filed in IPR2013-00067 on Nov. 12, 2013, 5 pages.
Exhibit 1025, Billy Hunter, Editor Viewpoint: Nike Flyknit: Ready, Steady, Go filed in IPR2013-00067 on Nov. 12, 2013, 5 pages.
Exhibit 2007, U.S. Pat. No. 7,347,011 with markings filed in IPR2013-00067 on Nov. 12, 2013, 22 pages.
Exhibit 2015, Excerpts from Celanese Corporation Man-Made Fiber and Textile Dictionary filed in IPR2013-00067 on Dec. 11, 2013, 5 pages.
Exhibit 2016, Excerpts from Hoechst Celanese "Dictionary of Fiber & Textile Technology" filed in IPR2013-00067 on Dec. 11, 2013, 4 pages.
Exhibit 2017, Excerpts from Celanese Corporation Man-Made Fiber and Textile Dictionary filed in IPR2013-00067 on Dec. 11, 2013, 10 pages.
Exhibit 2018, Excerpts from Hoechst Celanese Dictionary of Fiber & Textile Technology filed in IPR2013-00067 on Dec. 11, 2013, 11 pages.
Exhibit 2020, transcript of Dec. 3, 2013, second cross-examination deposition of Edward C. Frederick filed in IPR2013-00067 on Dec. 11, 2013, 59 pages.

(56) References Cited

OTHER PUBLICATIONS

Exhibit 2021, transcript of Dec. 3, 2013, cross-examination deposition of Sabit Adanur filed in IPR2013-00067 on Dec. 11, 2013, 139 pages.
Exhibit 2022, signature page for transcript of Dec. 3, 2013, Frederick deposition (Ex. 2020) filed in IPR2013-00067 on Jan. 7, 2014, 1 page.
Exhibit 2023, signature page for transcript of Dec. 3, 2013, Adanur deposition (Ex. 2021) filed in IPR2013-00067 on Jan. 7, 2014, 1 page.
Exhibit 3001 filed in IPR2013-00067 on Apr. 28, 2014, 3 pages.
Exhibit 3002 filed in IPR2013-00067 on Apr. 28, 2014, 4 pages.
Exhibit 1003, File History for U.S. Pat. No. 7,347,011, filed in IPR2013-00067 on Nov. 28, 2012, 201 pages.
Final Written Decision filed in IPR2013-00067 on Apr. 28, 2014, 43 pages.
Exhibit 1026, IDS under 37 C.F.R. 1.501 filed in IPR2013-00067 on Nov. 12, 2013, 2 pages.
Nike, Inc. Notice of Appeal filed in IPR2013-00067 on Jun. 30, 2014, 5 pages.
Nike's Motion to Amend filed in IPR2013-00067 on Aug. 19, 2013, 19 pages.
Notice of Filing Date Accorded to Petition and Time for Filing Patent Owner Preliminary Response filed in IPR2013-00067 on Dec. 4, 2012, 8 pages.
Oral Hearing Transcript filed in IPR2013-00067 on Mar. 5, 2014, 41 pages.
Order Conduct of the Proceeding filed in IPR2013-00067 on Jun. 19, 2013, 4 pages.
Order Conduct of the Proceeding filed in IPR2013-00067 on Aug. 2, 2013, 5 pages.
Order Conduct of the Proceeding § 4.25 filed in IPR2013-00067 on Jan. 23, 2014, 3 pages.
Order Trial Hearing filed in IPR2013-00067 on Jan. 13, 2014, 4 pages.
Patent Owner Corrected Certificate of Service filed in IPR2013-00067 on Aug. 19, 2013, 3 pages.
Patent Owner Opposition to Motion to Exclude filed in IPR2013-00067 on Jan. 21, 2014, 8 pages.
Patent Owner's Motion to Amend U.S. Pat. No. 7,347,011 filed in IPR2013-00067 on Aug. 19, 2013, 19 pages.
Patent Owner's Preliminary Response to Petition filed in IPR2013-00067 on Feb. 28, 2013, 8 pages.
Patent Owner's Reply to Petitioner's Opposition to Motion to Amend filed in IPR2013-00067 on Dec. 11, 2013, 9 pages.
Patent Owner's Trial Hearing Demonstratives filed in IPR2013-00067 on Feb. 6, 2014, 47 pages.
Petition for Inter Partes Review Under 35 U.S.C. 311-319 and 37 CFR 42.100 et seq. filed in IPR2013-00067 on Nov. 28, 2012, 66 pages.
Petitioner's Amended Notice of Cross Examination of Raymond Tonkel filed in IPR2013-00067 on Nov. 1, 2013, 3 pages.
Petitioner's Opposition to Patent Owner's Motion to Amend filed in IPR2013-00067 on Nov. 12, 2013, 20 pages.
Petitioner's Motion to Exclude Evidence filed in IPR2013-00067 on Jan. 17, 2014, 8 pages.
Petitioner's Opposition to Patent Owner Motion to Amend filed in IPR2013-00067 on Nov. 12, 2013, 20 pages.
Petitioner's Reply to Patent Owner's Opposition to Petitioner's Motion to Exclude Evidence filed in IPR2013-00067 on Jan. 28, 2014, 8 pages.
Exhibit 2012, Random House Webster Dictionary Excerpts filed in IPR2013-00067 on Aug. 19, 2013, 4 pages.
Revised Petition for Inter Partes Review Under 35 U.S.C. §§ 311-319 and 37 C.F.R. § 42.100 filed in IPR2013-00067 on Dec. 10, 2012, 64 pages.
Submission of Patent Owner's Trial Hearing Demonstratives filed in IPR2013-00067 on Feb. 6, 2014, 3 pages.
Supplemental Declaration Edward C. Frederick filed in IPR2013-00067 on Nov. 12, 2013, 18 pages.
Exhibit 2006, U.S. Pat. No. 2,147,197 with markings filed in IPR2013-00067 on Aug. 19, 2013, 5 pages.
Exhibit 2003, U.S. Pat. No. 4,354,318 filed in IPR2013-00067 on Aug. 19, 2013, 6 pages.
PCT Patent Application No. PCT/US2005/004776, International Search Report and Written Opinion dated May 19, 2005, 15 pages.
PCT Patent Application No. PCT/US2009/056795, International Search Report and Written Opinion dated Feb. 20, 2010, 16 pages.
PCT Patent Application No. PCT/US2012/028534, International Preliminary Report on Patentability dated Sep. 17, 2013, 8 pages.
PCT Patent Application No. PCT/US2012/028534, International Search Report and Written Opinion dated Oct. 17, 2012, 14 pages.
PCT Patent Application No. PCT/US2012/028559, International Search Report and Written Opinion dated Oct. 19, 2012, 9 pages.
PCT Patent Application No. PCT/US2012/028576, International Preliminary Report on Patentability dated Sep. 17, 2013, 7 pages.
PCT Patent Application No. PCT/US2012/028576, International Search Report and Written Opinion dated Oct. 1, 2012, 10 pages.
Spencer, "Knitting Technology", Woodhead Publishing Limited, 1989 and 2001, 413 pages.
IPR2013-00067, Excerpts from Man-Made Fiber and Textile Dictionary, Exhibit 2011, Nov. 27, 2013, 12 pages.
Office Action, Chinese Patent Application No. 201510071264.0, dated Dec. 15, 2016, 9 pages.
Petition for Inter Partes Review Under 35 U.S.C. §§ 311-319 and 37 C.F.R. § 42.100 ET SEQ. with Exhibit 1003, Declaration of Lenny M. Holden, Inter Partes Review No. 2017-00263, Nov. 14, 2016.
Petition for Inter Partes Review Under 35 U.S.C. §§ 311-319 and 37 C.F.R. § 42.100 ET SEQ. with Exhibit 1003, Declaration of Lenny M. Holden, Inter Partes Review No. 2017-00264, Nov. 14, 2016.
Photograph of Adizero Prime SP Olympia, 2012.
Photograph of Adios, 2012.
Buckley et al., "New Textile Concepts for Use in Control of Body Environments", Presented at RTO HFM Symposium on "Blowing Hot and Cold: Protecting Against Climatic Extremes", Dresden, Germany, Oct. 8-10, 2001, 7 pages.
Hong et al., "The Development of 3D Shaped Knitted Fabrics for Technical Purposes on a Flat Knitting Machine", Indian Journal of Fibre & Textile Research, vol. 19, pp. 189-194, Sep. 1994, 6 pages.
Lu et al. , "The Development of the Flat-Knitted Shaped Uppers Based on Ergonomics", AUTEX Research Journal, vol. 16, No. 2, pp. 67-74, Jun. 2016, 8 pages.
Federal Circuit Case No. 14-1719 , Federal Circuit Mandate to PTAB, Apr. 4, 2016, 1 page.
Federal Circuit Case No. 14-1719 , United States Patent and Trademark Office's Solicitor's Brief to Federal Circuit, Apr. 9, 2015, 27 pages.
Federal Circuit Case No. 14-1719 , Appellant's Reply Brief, May 27, 2015, 38 pages.
Federal Circuit Case No. 14-1719 , Federal Circuit Decision, Feb. 11, 2016, 41 pages.
Federal Circuit Case No. 14-1719 , Appellant's Opening Brief to Federal Circuit, Dec. 15, 2014, 47 pages.
Federal Circuit Case No. 14-1719 , Appellee's Response Brief to Federal Circuit, Apr. 10, 2015, 76 pages.
Federal Circuit Case Nos. 18-1180 & 18-1181 , Appellant's Reply in Support of Motion to Remand, Jun. 5, 2018, 16 pages.
Federal Circuit Case Nos. 18-1180 & 18-1181 , Appellant's Motion for Remand to PTAB, May 24, 2018, 19 pages.
Federal Circuit Case Nos. 18-1180 & 18-1181 , Appellee's Opposition to Motion to Remand to PTAB, Jun. 1, 2018, 21 pages.
Federal Circuit Case Nos. 18-1180 & 18-1181 , Federal Circuit Decision to Remand to PTAB, Jul. 2, 2018, 4 pages.
Federal Circuit Case Nos. 18-1180 & 18-1181 , Appellant's Reply Brief, May 1, 2018, 41 pages.
Federal Circuit Case Nos. 18-1180 & 18-1181 , Appellee's Corrected Response Brief, Apr. 12, 2018, 75 pages.
Federal Circuit Case Nos. 18-1180 & 18-1181 , Appellant's Opening Brief, Feb. 26, 2018, 79 pages.
IPR2013-00067 , Patent Owner's Response Brief, Nov. 16, 2017, 12 pages.
IPR2013-00067 , Petitioner's Opening Brief, Nov. 6, 2017, 12 pages.

(56) References Cited

OTHER PUBLICATIONS

IPR2013-00067 , Exhibit 1027, Petitioner's Oral Hearing Demonstratives Slides, 25 pages.
IPR2013-00067 , Exhibit 3003, Email regarding Aqua Products Conference Call, 3 pages.
IPR2013-00067 , Order Conduct of Remand Proceeding, Aug. 10, 2016, 4 pages.
IPR2013-00067 , Patent Owner's Notice of Appeal, Jun. 30, 2014, 5 pages.
IPR2013-00067 , Petitioner's Reply Brief on Remand, Nov. 22, 2017, 6 pages.
IPR2013-00067 , Decision on Remand, Sep. 18, 2018, 65 pages.
IPR2016-00920 , Decision Denying Institution of Inter Partes Review, Oct. 20, 2016, 8 pages.
IPR2016-00921 , Petitioners Brief Addressing Newly Instituted Ground, Sep. 10, 2018, 12 pages.
IPR2016-00921 , Order Modifying Institution Decision and Granting Request for Additional Briefing, Aug. 24, 2018, 14 pages.
IPR2016-00921 , Patent Owner's Response Brief Addressing the Newly Instituted Ground, Sep. 24, 2018, 14 pages.
IPR2016-00921 , Decision on Institution of Inter Partes Review, Oct. 21, 2016, 24 pages.
IPR2016-00921 , Petitioner's Reply to Patent Owner Response, Apr. 21, 2017, 32 pages.
IPR2016-00921 , Patent Owner's Objection to Admissability of Evidence, Apr. 28, 2017, 4 pages.
IPR2016-00921 , Petitioner's Notice of Supplemental Evidence in Response to Patent Owner's Objection to Evidence, May 12, 2017, 4 pages.
IPR2016-00921 , Petitioner's Notice of Appeal, Nov. 13, 2017, 4 pages.
IPR2016-00921 , Final Written Decision, dated Oct. 19, 2017, 49 pages.
IPR2016-00921 , Patent Owner's Response Brief, Jan. 23, 2017, 64 pages.
IPR2016-00921 & IPR2016-00922 , Exhibit 1014, Merriam-Webster Dictionary Definition of Impart, Apr. 10, 2017, 11 pages.
IPR2016-00921 & IPR2016-00922 , Exhibit 2004, Transcript of Deposition of Lenny Holden, Jan. 10, 2017, 226 pages.
IPR2016-00921 & IPR2016-00922 , Exhibit 3001, Random House Webster's College Dictionary Definition of Impart and Texture, Apr. 1999, 4 pages.
IPR2016-00921 & IPR2016-00922 , Record of Oral Hearing, Jul. 26, 2017, 74 pages.
IPR2016-00921 & IPR2016-00922 , Exhibit 1013, Analyzing the Color, Design and Texture of Fabric, 8 pages.
IPR2016-00921 & IPR2016-00922 , Exhibit 1016, Adidas's Oral Hearing Demonstratives, Jul. 12, 2017, 84 pages.
IPR2016-00922 , Petitioner's Brief Addressing Newly Instituted Ground, Sep. 10, 2018, 12 pages.
IPR2016-00922 , Order Modifying Institution Decision and Granting for Additional Briefing, Aug. 24, 2018, 14 pages.
IPR2016-00922 , Patent Owner's Response Brief Addressing Newly Instituted Ground, Sep. 24, 2018, 14 pages.
IPR2016-00922 , Decision on Institution of Inter Partes Review, Oct. 21, 2016, 24 pages.
IPR2016-00922 , Petitioner's Reply Brief, Apr. 21, 2017, 34 pages.
IPR2016-00922 , Patent Owner's Objection to Admissability of Evidence, Apr. 28, 2017, 4 pages.
IPR2016-00922 , Petitioner's Notice of Supplemental Evidence in Response to Patent Owner's Objections to Evidence 37 C.F.R. § 42.64(B)(1), May 12, 2017, 4 pages.
IPR2016-00922 , Petitioner's Notice of Appeal, Nov. 13, 2017, 4 pages.
IPR2016-00922 , Final Written Decision, dated Oct. 19, 2017, 52 pages.
IPR2016-00922 , Patent Owner's Response Brief, Jan. 23, 2017, 66 pages.
IPR2017-00263 , Decision Denying Institution of Inter Partes Review, Jun. 7, 2017, 11 pages.
IPR2017-00263 , Decision Denying Request for Rehearing, Jul. 20, 2017, 12 pages.
IPR2017-00263 , Petitioner's Request for Rehearing, Jul. 7, 2017, 17 pages.
IPR2017-00263 , Patent Owner's Corrected Preliminary Response, Mar. 27, 2017, 24 pages.
IPR2017-00263 , Patent Owner's Preliminary Response, Mar. 9, 2017, 24 pages.
IPR2017-00264 , Decision Denying Request for Rehearing, Jul. 20, 2017, 12 pages.
IPR2017-00264 , Decision Denying Institution of Inter Partes Review, Jun. 7, 2017, 12 pages.
IPR2017-00264 , Petitioner's Request for Rehearing, Jul. 7, 2017, 17 pages.
IPR2017-00264 , Patent Owner's Corrected Preliminary Response, Mar. 27, 2017, 24 pages.
IPR2017-00264 , Patent Owner's Preliminary Response, Mar. 9, 2017, 24 pages.
"Knitting Machine Wins Design Award—The Textile Institute & Industry", EBSCO Host,Textile Institute & Industry, vol. 7, Issue 7, Jul. 1969, 3 pages.
"Polyamide 6.6 Emana Yarn", 5 pages.
Aibibu et al., "Textile Cell-free Scaffolds for in Situ Tissue Engineering Applications", Journal of Materials Science: Materials in Medicine, vol. 27, No. 3, Mar. 2016, 20 pages.
Atalay et al., "Knitted Strain Sensors: Impact of Design Parameters on Sensing Properties", Sensors, vol. 14, No. 3, 2014, 8 pages.
Atalay et al., "Textile-Based Weft Knitted Strain Sensors: Effect of Fabric Parameters on Sensor Properties , Sensors (Basel)", vol. 13, No. 8, Aug. 21, 2013, 6 pages.
Barton et al., "Development and Evaluation of a Tool for the Assessment of Footwear Characteristics", Journal of Foot and Ankle Research, vol. 2, Apr. 23, 2009, 13 pages.
Hamlin , "The Hamlin Cleanroom Bootie", MO-LA Inc., Technical Developments, vol. 18, Mar. 1993, 2 pages.
IPR2013- 00067 , Excerpts from Man-Made Fiber and Textile Dictionary , Exhibit 2011, Aug. 19, 2013, 12 pages.
Lo et al., "Effects of Custom-Made Textile Insoles on Plantar Pressure Distribution and Lower Limb Emg Activity During Turning", Journal of Foot and Ankle Research, vol. 9, Jul. 13, 2016, 11 pages.
Office Action, European Patent Application No. 15154607.4 , dated Jan. 5, 2018, 6 pages.
Saenz-Cogollo et al., "Pressure Mapping Mat for Tele-Home Care Applications", Sensors, vol. 16, No. 3, E365, Mar. 11, 2016, 9 pages.
Singh et al., "Medical Textiles as Vascular Implants and Their Success to Mimic Natural Arteries", Journal of functional biomaterials, vol. 6, No. 3, Sep. 2015, 15 pages.
Stoppa et al., "Wearable Electronics and Smart Textiles: A Critical Review", Sensors, vol. 14, No. 7, Jul. 2014, 20 pages.
U.S. Appl. No. 14/257,668 , Final Office Action, dated Feb. 1, 2019, 29 pages.
U.S. Appl. No. 14/257,719 , Final Office Action, dated Jan. 24, 2019, 15 pages.
U.S. Appl. No. 14/257,737 , Final Office Action, dated Jan. 2, 2019, 15 pages.
Federal Circuit Case No. 19-1262, Reply Brief of Appellant Nike, Inc., Sep. 13, 2019, 38 pages.
Federal Circuit Case No. 19-1262, Appellee Adidas AG's Response Brief, Aug. 9, 2019, 60 pages.
IPR 19-1787, Appellant Adidas AG's Opening Brief, Aug. 30, 2019, 319 pages.
Notice of Opposition, European Patent Application No. 13161357.2, dated Apr. 1, 2019, 49 pages.
Petitioner Adidas AG's Notice of Appeal, IPR2016-00921, Apr. 19, 2019, pp. 1-79.
Principal Brief of Appellant Nike, Inc., United States Court of Appeals for the Federal Circuit, Appeal from the United States Patent and Trademark Office Patent Trial and Appeal Board Case No. IPR2013-00067, May 17, 2019, pp. 1-59.
Eberle et al., Clothing Technology, Third English Edition, 2002, 291 pages.

(56) References Cited

OTHER PUBLICATIONS

IPR2013-00067 , Nike's Notice of Appeal, Nov. 20, 2018, 69 pages.
IPR2016-00921 , Decision on Remand—35 USC 144 and 37 CFR 42.5(a), Feb. 19, 2019, pp. 1-67.
IPR2016-00921-00922 , Hearing Transcript, Nov. 29, 2018, 37 pages.
IPR2016-00921-00922 , Nike's Demonstratives for Additional Oral Hearing, Nov. 15, 2018, pp. 1-21.
IPR2016-00921-00922 , Patent Owner Nike's Demonstratives, Jul. 11, 2017, pp. 1-27.
IPR2016-00921-00922 , Petitioner's Demonstratives for Supplemental Oral Hearing, Nov. 15, 2018, pp. 1-21.
IPR2016-00921-00922 , Record of Oral Hearing, Nov. 15, 2018, 37 pages.
IPR2016-00921-00922 , Transcript of Proceedings, Oct. 15, 2018, pp. 1-44.
IPR2016-00922 , Decision on Remand—35 USC 144 and 37 CFR42.5(a), Feb. 19, 2019, 67 pages.
IPR2016-00922 , Petitioner Adidas AG's Notice of Appeal, Apr. 19, 2019, 75 pages.
Advances in Apparel Production, The Textile Institute, Woodhead Publishing Limited, Cambridge, England, 2008, pp. 190-191.
Federal Circuit Case No. 19-1787, Reply Brief for Appellant Adidas AG, Dec. 23, 2019, 40 pages.
Federal Circuit Case No. 19-1787, Joint Appendix, Dec. 30, 2019, 582 pages.
Federal Circuit Case No. 19-1787, Appellee Nike, Inc.'s Response Brief, Nov. 25, 2019, 77 pages.
Federal Circuit Case No. 19-1262, Appellant's Citation of Supplemental Authority Pursuant to Rule 28(j), Jan. 29, 2020, 11 pages.
Appellee Nike Response to Citation of Supplemental Authority, Federal Circuit Case No. 19-1987, May 20, 2020, 3 pages.
Federal Circuit Case No. 19-1787, Appellant Adidas Citation of Supplemental Authority, May 15, 2020, 31 pages.
Notice of Opposition, German Patent Application No. 10 2014 202 432.3, dated Jun. 12, 2020, 42 pages.
Office Action, Chinese Patent Application No. 201811276475.8, dated Jun. 19, 2020, 19 pages.
Decision on Appeal, Federal Circuit Case No. 19-1262, Apr. 9, 2020, 17 pages.
Judgment, Federal Circuit Case No. 19-1262, Apr. 9, 2020, 1 page.
Chamberlain, "Knitted Fabrics", 1919, pp. 80-103, Sir Isaac Pitman & Sons, Ltd., London.
Chamberlain, "Principles of Machine Knitting", 1951, pp. 54-57, The Textile Institute, Manchester.
Wignall ,"Knitting", 1964, pp. 99-101, 116-129, Pitman Publishing, London.
European Search Report, European Patent Application No. 20167046.0, dated Aug. 25, 2020, 10 pages.
Federal Circuit Case Nos. 19-1787 and 19-1788, Opinion, Jun. 25, 2020, 8 pages.
IPR Case No. 2013-00067, Exhibit 2024, Intervenor's Petition for Panel Hearing, Appeal No. 2015-1928, Aug. 20, 2020, 38 pages.
IPR Case No. 2013-00067, Patent Owner's Opening Brief on Second Remand, Aug. 20, 2020, 12 pages.
IPR Case No. 2013-00067, Patent Owner's Reply Brief on Second Remand, Sep. 3, 202, 7 pages.
IPR Case No. 2013-00067, Petitioner's Opening Brief on Remand, Aug. 20, 2020, 12 pages.
IPR Case No. 2013-00067, Petitioner's Response Brief on Remand, Sep. 3, 2020, 7 pages.
IPR Case No. 2013-00067, Order—Conduct of the Proceeding on Remand, Jul. 24, 2020, 6 pages.
Office Action, German Patent Application No. 102014202432.3, dated Sep. 21, 2016, 7 pages.
Office Action, European Patent Application No. 15154607.4, dated Apr. 4, 2017, 6 pages.
Summons to Attend Oral Proceedings, European Patent Application No. 15154607.4, mailed Nov. 22, 2018, 7 pages.
Office Action, Chinese Patent Application No. 201811276049.4, dated Jul. 30, 2020, 17 pages.
IPR2013-00067, Final Written Decision on Remand, dated Mar. 1, 2021, 40 pages.
Office Action, Chinese Patent Application No. 201811276049.4, dated Feb. 26, 2021, 13 pages.
Office Action, Chinese Patent Application No. 201811276475.8, dated Mar. 9, 2021, 15 pages.

* cited by examiner

SOCCER SHOE

CROSS REFERENCE TO RELATED APPLICATION

This application is related to and claims priority benefits from German Patent Application No. DE 10 2014 202 432.3, filed on Feb. 11, 2014, entitled IMPROVED SOCCER SHOE ("the '432 application"). The '432 application is hereby incorporated herein in its entirety by this reference.

FIELD OF THE INVENTION

The present invention relates to a shoe, in particular a soccer shoe.

BACKGROUND

A number of requirements are imposed on a soccer shoe, such as that the soccer shoe should be light, adjust to a wearer's foot in an optimal manner, and provide good control of the ball for the soccer player. While a lower-weight soccer shoe is of particularly great importance during fast sprints, a heavy soccer shoe is also impedimental and detrimental to precision when shooting a soccer ball. A soccer shoe that is well-adjusted to the shape of the foot provides the soccer player with the necessary support on the one hand and enables precise transmission of force to the ball during shooting on the other hand. Good control of the ball is especially important during technically ambitious play, such as e.g. dribbling. Soccer players for whom precisely guiding the ball has priority, such as midfielders, prefer soccer shoes that allow the most direct and immediate contact possible with the ball.

These varied requirements imposed on a soccer shoe can be difficult to realize simultaneously. For example, reduction of a soccer shoe's weight usually results in the soccer shoe providing the soccer player with less support since the lighter weight is typically achieved by dispensing with material that would otherwise support the foot and ensure a firm coupling of the soccer shoe to the foot. In addition, allowing the most direct and immediate contact with the ball possible for the soccer player is typically realized by a correspondingly thin material of the shoe upper, which is detrimental to stability and a firm fit. Thus, there is tension between the various requirements imposed on a soccer shoe, which means that the known solutions to date typically meet certain requirements, but tend to disregard other requirements.

For example, a cleat shoe described in US 2011/0308108 A1 comprises an inner layer and an outer layer. Fasteners in the form of ribbons are mounted between the inner layer and the outer layer in order to fix the shoe to the foot. The shoe provides sufficient support to the foot of a wearer, but it is cumbersome to handle, heavy and, due to the inner layer, outer layer, and the fasteners being arranged on top of each other, it does not allow a good feel for the ball.

Similar disadvantages can be found in the soccer shoe described in DE 10 2010 037 585 A1, which consists of an inner section and an outer section. The inner section meets the essential requirements, such as stability for the foot, protection for vulnerable areas of the foot, cushioning of the footbed, as well as contact properties with the ball, and the outer section ensures the carrying function for the sole portion and the cleat connection. However, shoe is heavy and cumbersome to handle.

The present invention therefore has the aim of providing a soccer shoe which is light, provides sufficient support to a wearer, and allows good control of the ball.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a soccer shoe comprises an upper comprising knitwear, and a sole comprising cleats, wherein the sole is connected to the knitwear, and the knitwear is configured to couple the sole to a foot of a wearer when the soccer shoe is worn. In some embodiments, the sole is a rigid sole.

The knitwear may be configured to extend above an ankle of the wearer when the soccer shoe is worn. In certain embodiments, the knitwear comprises more than one weft-knitted or warp-knitted sections. The knitwear may also be formed as one-piece knitwear. In some embodiments, the knitwear substantially encloses the foot of the wearer when the soccer shoe is worn. The knitwear may be weft-knitted and/or may be warp-knitted.

In some embodiments, the soccer shoe does not comprise a separate tongue in an area of an instep and/or the soccer shoe does not comprise laces.

According to certain embodiments of the present invention, a soccer shoe comprises an upper comprising knitwear, wherein the knitwear comprises a first and a second weft-knitted or warp-knitted layers, and a sole comprising cleats, wherein the sole is connected to the knitwear, and the knitwear is configured to couple the sole to a foot of a wearer when the soccer shoe is worn.

In some embodiments, a reinforcement is arranged between the first and the second weft-knitted or warp-knitted layers. The reinforcement may be made from plastic and/or may be arranged in at least one of a lateral area and a medial area of the upper.

In certain embodiments, the knitwear is coated, such that friction between a soccer ball and the coated knitwear is increased compared to friction between the soccer ball and uncoated knitwear.

According to some embodiments, the upper does not comprise a securing element. The upper may be configured to overlap a section of a shin guard when the soccer shoe is worn.

In some embodiments, the knitwear is made on a flat weft-knitting or warp-knitting machine. In additional embodiments, the knitwear is made on a circular weft-knitting or warp-knitting machine. The knitwear may be reinforced with a polymer reinforcement.

In certain embodiments, the upper is configured to connect to a shin guard or a soccer sock.

According to certain embodiments, a method of manufacturing a soccer shoe comprises providing the sole, weft-knitting or warp-knitting the knitwear for the upper, such that the knitwear is configured to couple the sole to a foot of a wearer when the soccer shoe is worn, and connecting the sole to the upper.

In certain embodiments, the sole is a rigid sole. The knitwear may be weft-knitted or warp-knitted and configured to extend above an ankle of the wearer when the soccer shoe is worn.

In some embodiments, the weft-knitting or warp-knitting of the knitwear further comprises weft-knitting or warp-knitting multiple weft-knitted or warp-knitted sections, and joining the multiple weft-knitted or warp-knitted section to form the knitwear.

BRIEF DESCRIPTION OF THE DRAWINGS

In the following detailed description, embodiments of the invention are described referring to the following figures.

BRIEF DESCRIPTION

Figure 1A:
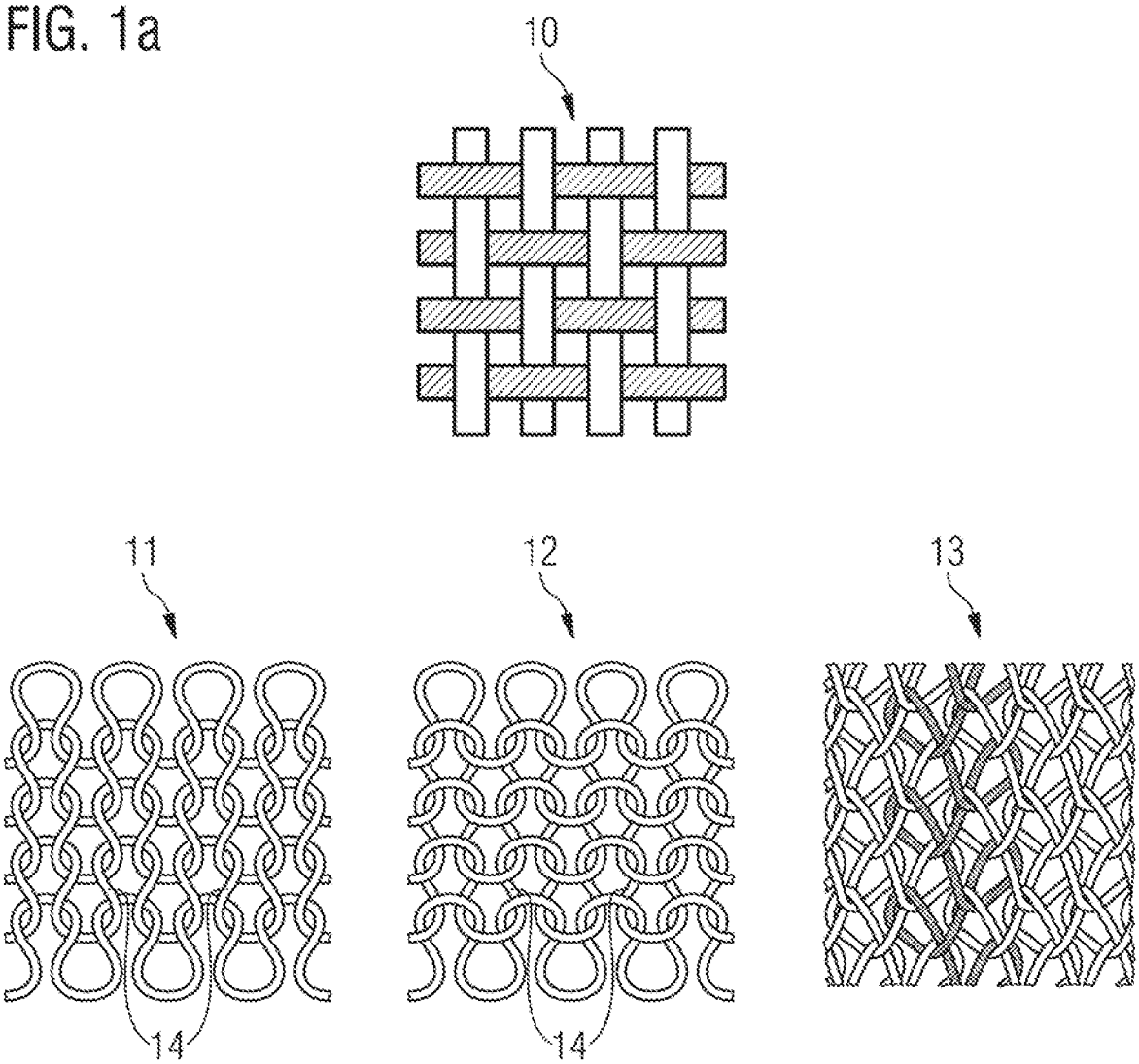
FIG. 1*a* is a schematic representation of textile structures, according to certain embodiments of the present invention.

According to a first aspect of the present invention, this aim is achieved by a soccer shoe which comprises a shoe upper comprising knitwear and a rigid sole which comprises cleats and is connected to the knitwear, wherein the knitwear is capable of coupling the sole to a foot of a wearer of the soccer shoe while the soccer shoe is being worn.

By the soccer shoe according to the invention comprising a shoe upper which comprises knitwear, the material of the shoe upper is sufficiently thin for providing direct and immediate contact to a soccer ball. The wearer of the soccer shoe in accordance with the invention thus has good control of the ball, which may be beneficial when dribbling or shooting, for example. Moreover, knitwear comprises a certain level of stretchability so that the shoe upper may optimally adjust to the shape of the foot and provides the wearer with the necessary support.

The knitwear of the shoe upper is furthermore suitable for coupling the sole of the soccer shoe to the foot of a wearer of the soccer shoe while it is being worn. In this way, the sole is tightly connected to the foot so that twisting of the foot is avoided or at least reduced. The knitwear essentially, i.e. more than 50% of the required forces, causes the sole to be fixed under the foot of the wearer and to hold it in its position.

Thus, by knitwear being used in the shoe upper for coupling the sole to the foot, the soccer shoe is very light on the one hand while providing the foot with the necessary stability due to an optimal fit on the other hand. The knitwear may generally also be arranged only on the outside of the shoe upper, only on the inside of the shoe upper, or both on the inside and on the outside. The inside is the side of the shoe upper facing the foot. The outside is the side of the shoe upper facing away from the foot.

The sole of the shoe according to certain embodiments of the invention comprises sufficient rigidity to transmit forces between the foot and the ground, which occur during playing soccer on grass, artificial turf, or indoor.

Cleats are understood as any type of bump on the sole that is capable of increasing the traction of the sole with the ground, for example grass or artificial turf. The cleats comprise such a hardness that they press into the ground, e.g. grass or artificial turf, to some degree under the weight of a soccer player.

In certain embodiments of the invention, the sole is a rigid sole. A rigid sole provides a soccer player sufficient support and provides good transmission of forces between a foot of the player and the ground, especially on grass and artificial turf.

In additional embodiments of the invention, the knitwear is capable of extending above an ankle of the foot while the soccer shoe is being worn. Due to this, the sole of the soccer shoe may be coupled to the foot very tightly, since the contact area of the knitwear with the foot is correspondingly large. Moreover, the "taping" necessary among soccer players, i.e. wrapping the ankle area in ribbons, may not be necessary. This is because the knitwear extending above the ankle protects the ankle from injuries, while also ensuring a smooth transition from the soccer shoe to a shin guard and/or soccer socks on the other hand. The knitwear may be suitable for extending all the way to a knee while the soccer shoe is being worn.

In further embodiments of the invention, the knitwear consists of several weft-knitted or warp-knitted sections. This enables use of knitwear only in areas that are necessary for safely coupling the sole of the soccer shoe to the foot. Other materials may be used in other areas. Moreover, individual knitwear sections may be manufactured on a flat weft-knitting machine or a flat warp-knitting machine and then connected in order to obtain a three-dimensional shape.

In alternative embodiments of the invention, the knitwear may be formed as one-piece knitwear. One-piece knitwear may simply and cost-effectively be weft-knitted or warp-knitted on a corresponding machine. Since seams can be omitted, pressure sores may be reduced or avoided.

In further embodiments of the invention, the sole of the soccer shoe comprises knitwear. In additional embodiments, the sole and the knitwear are formed as one-piece knitwear. In this case, the soccer shoe may be produced in one piece on a corresponding weft-knitting or warp-knitting machine.

In some embodiments, knitwear encloses a foot of a wearer of the soccer shoe substantially completely. This ensures a firm coupling of the sole of the soccer shoe to the foot by the knitwear. The soccer shoe provides the foot with a high degree of stability.

In further embodiments of the invention, the knitwear is weft-knitted. Weft-knitted knitwear may be simply and specifically provided with functional properties. Weft-knitted knitwear may, for example, be weft-knitted in a more open-meshed manner in places where the most humidity occurs on the foot so as to specifically better air the foot in these places. The knitwear may be flat weft-knitted or circular weft-knitted.

In additional embodiments of the invention, the knitwear is warp-knitted. By machine warp-knitting, the knitwear may be produced relatively rapidly and cost-effectively. The knitwear may be either flat warp-knitted or circular warp-knitted.

The knitwear may be formed to fulfil the function of a tongue in the area of the instep. In this manner, separately forming the tongue may be omitted so that the manufacture of the soccer shoe is simplified. Moreover, pressure sores are reduced or prevented since the otherwise common discontinuous transition between the tongue and the shoe upper is omitted.

In certain embodiments, the knitwear is formed to fulfil the function of laces. Thus, laces may be omitted, which simplifies the handling of the soccer shoe, as well as its manufacture.

The sole may be injection molded to the shoe upper. This enables a simple manufacture of the soccer shoe, since the work step of connecting the sole to the shoe upper is omitted. In further embodiments, the sole is injection molded directly to the knitwear. This ensures a firm coupling of the sole to a foot of a wearer of the soccer shoe. In certain embodiments, polyurethane ("PU"), thermoplastic polyurethane ("TPU") or polyamides ("PA") are used for injection molding the sole to the shoe upper.

In alternative embodiments of the invention, the sole is glued to the shoe upper. For example, the sole may be manufactured by injection molding and may be subsequently glued to the shoe upper. Suitable materials for manufacturing the sole are rubber, ethylene vinyl acetate ("EVA"), or expanded thermoplastic polyurethane ("eTPU").

In certain embodiments of the invention, the knitwear of the upper comprises a first and a second weft-knitted or warp-knitted layer. In this way, the material thickness of the shoe upper may be specifically varied.

A reinforcement may be arranged between the first and the second weft-knit or warp-knit layer. The reinforcement may simply be placed between the first and the second layer. In this manner, the soccer shoe may be cost-effectively reinforced in specific places, for example in the toe region or the heel region or in both areas. The reinforcement may be generally manufactured from any desired material which is suitable for structural reinforcement like e.g. a fibrous web or a textile. The reinforcement may also be arranged in a shin area of the shoe upper. In this way, a separate shin guard may be omitted.

The reinforcement may be made from plastic. Reinforcements made from plastic are simple and cost-effective to manufacture by corresponding methods, such as injection molding. Suitable plastics are PU, polyethylene, polypropylene, and EVA, for example. These may be used e.g. as a sheet for reinforcement. Alternatively, the reinforcement is a non-woven made from the mentioned plastics. The sheet or the non-woven may be applied to an inner side or an outer side of the soccer shoe.

The reinforcement may be arranged in a lateral area or in a medial area or in a lateral and a medial area of the upper. In this way, the soccer shoe may specifically be reinforced in areas in which it comes into contact with the ball. At the same time, however, the reinforcement may be formed in a sufficiently thin manner, e.g. as a plastic sheet, so as not to considerably restrict the feel for the ball.

In certain embodiments of the invention, the shoe upper does not comprise a securing element. Dispensing with a securing element, such as laces, for example, enables a more cost-effective manufacture of the soccer shoe. In general, using knitwear allows for such an accurately fitting manufacture that a securing element may be omitted.

The knitwear may be coated, such that the friction between a soccer ball and the knitwear is increased compared to uncoated knitwear. This allows for the ball to be played precisely. Moreover, the soccer player is able to provide the ball with a spin, which is referred to as swerve, so as to cause a bent trajectory.

The upper may comprise such a height that the upper edge of the upper overlaps a section of a shin guard while the soccer shoe is being worn. A smooth transition may thus be created between the shin guard and the soccer shoe. "Taping" the ankle area, as was mentioned before, may be omitted.

In certain embodiments of the invention, the knitwear is made on a flat weft-knitting machine or a flat warp-knitting machine. The knitwear may be manufactured simply and cost-effectively on a flat weft-knitting machine or a flat warp-knitting machine.

In alternative embodiments of the invention, the knitwear is made on a circular weft-knitting machine or a circular warp-knitting machine. Knitwear manufactured on circular weft-knitting machines or circular warp-knitting machines already has a tube-like shape and is therefore easier to adjust to the shape of a cobbler's last and thus to the shape of the foot.

In certain embodiments of the invention, the upper comprises a coupling mechanism to connect the upper to a shin guard or a soccer sock. This further increases the coupling of the sole of the soccer shoe to the foot.

The coupling mechanism may be a hook-and-loop fastener. A hook-and-loop fastener is easy to attach to the shoe upper or the soccer sock, e.g. by sewing, and it is very easy to handle.

The knitwear may be reinforced with a polymer reinforcement. The knitwear may be provided with a polymer reinforcement, e.g. by the latter being applied as a coating.

Further aspects of the present invention relate to a method of manufacturing a soccer shoe as described above, the method comprising: providing the sole; weft-knitting or warp-knitting the knitwear for the upper, such that the knitwear is capable of coupling the sole to a foot of a wearer of the soccer shoe during wearing the soccer shoe; and connecting the sole to the upper.

In certain embodiments, the sole provided is a rigid sole. A rigid sole provides a soccer player sufficient support and provides good transmission of forces between a foot of the player and the ground, especially on grass and artificial turf.

The knitwear may be weft-knitted or warp-knitted such that the knitwear is capable of extending above an ankle of a foot while the soccer shoe is being worn. Due to this, the sole of the soccer shoe may be coupled to the foot very tightly, since the contact area of the knitwear with the foot is correspondingly large. Moreover, the aforementioned "taping" may be omitted. This is because on the one hand, the knitwear extending above the ankle protects the ankle from injuries on the one hand while ensuring a smooth transition from the soccer shoe to a shin guard and/or soccer socks on the other hand.

The weft-knitting or warp-knitting of the knitwear may further comprise: weft-knitting or warp-knitting multiple weft-knitted or warp-knitted sections; and joining the multiple weft-knitted or warp-knitted sections to form the knitwear. This enables use of knitwear only in areas that are necessary for safely coupling the sole of the soccer shoe to the foot. Other materials may be used in other areas. Moreover, individual knitwear sections may be manufactured on a flat weft-knitting machine or a flat warp-knitting machine and connected then in order to obtain a three-dimensional shape.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments and variations of the present invention will be described in more detail below.

The use of knitwear allows products such as a shoe upper or a sole of a shoe, such as an insole, strobel sole, midsole and/or outer sole to be equipped with areas having different characteristics and providing different functions with low production effort. The properties include bendability, stretchability (expressed as Young's modulus, for example), permeability to air and water, thermoconductivity, thermal capacity, moisture absorption, static friction, abrasion resistance, hardness, and thickness, for example.

Various techniques are applied in order to achieve such characteristics or functions, which will be described in the following. Such suitable techniques in manufacturing knitwear include knitting techniques, the selection of fibers and yarns, coating the fibers, yarns or knitwear with polymer or other materials, the use of monofilaments, the combination of monofilaments and polymer coating, the application of fuse/melt yarns, and multi-layer textile material. In general, the yarns used for the manufacture of knitwear may be equipped, i.e. coated accordingly. In addition or alternatively, the finished knitwear may be equipped accordingly.

Another aspect of providing functions concerns the specific use of knitwear for certain areas of a product, for example of a shoe upper or a sole, and the connection of different parts by suitable connection techniques. The mentioned aspects and techniques as well as other aspects and techniques will be explained in the following.

The described techniques may be used individually or may be combined in any manner.

Knitwear

Knitwear used in the present invention is divided into weft-knitted fabrics and single-thread warp-knitted fabrics on the one hand and warp-knitted fabrics on the other hand. The distinctive characteristic of knitwear is that it is formed of interlocking yarn or thread loops. These thread loops are also referred to as stitches and may be formed of one or several yarns or threads.

Yarn or thread are terms for a structure of one or several fibers which is long in relation to its diameter. A fiber is a flexible structure which is rather thin in relation to its length. Very long fibers, of virtually unlimited length with regard to their use, are referred to as filaments. Monofilaments are yarns formed of one single filament, that is, one single fiber.

In weft-knitted fabrics and single-thread warp-knitted fabrics, the stitch formation requires at least one thread or yarn, with the thread running in longitudinal direction of the product, i.e. substantially at a right angle to the direction in which the product is made during the manufacturing process. In warp-knitted fabrics, the stitch formation requires at least one warp sheet, i.e. a plurality of so-called warps. These stitch-forming threads run in longitudinal direction, i.e. substantially in the direction in which the product is made during the manufacturing process.

FIG. 1*a* shows the basic difference between woven fabrics 10, weft-knitted fabrics 11 and 12, and warp-knitted fabrics 13. A woven fabric 10 has at least two thread sheets that are usually arranged at a right angle to one another. In this regard, the threads are placed above or underneath each other and do not form stitches. Weft-knitted fabrics 11 and 12 are created by knitting with one thread from the left to the right by interlocking stitches. View 11 shows a front view (also referred to as the front loop fabric side) and view 12 a back view (also referred to as the back loop fabric side) of a weft-knitted fabric 11, 12. The front loop and back loop product sides differ in the run of the legs 14. On the back loop fabric side 12, the legs 14 are covered in contrast to the front loop fabric side 11.

Figure 1B:
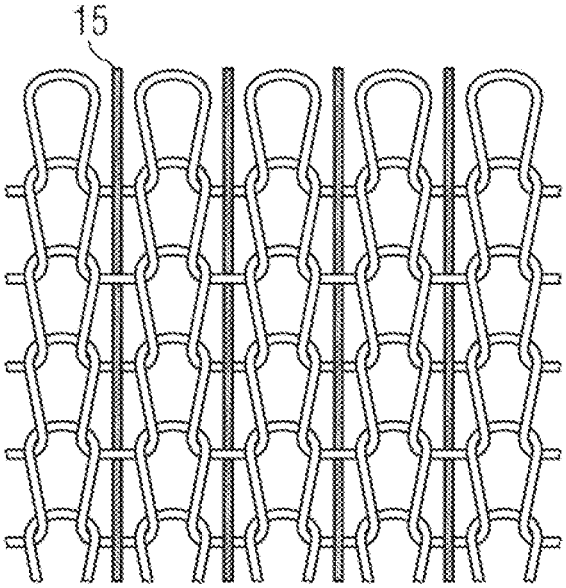
FIG. 1*b* is a schematic representation of a weft-knitted fabric with a filler yarn, according to certain embodiments of the present invention.

Certain embodiments of a weft-knitted fabric that may be used for the present invention with a filler yarn 15 is shown in FIG. 1*b*. A filler yarn 15 is a length of a thread placed between two wales in longitudinal direction, which is held by transverse threads of other weave elements. By the filler yarn 15 being combined with other weave elements, the properties of the weft-knitted fabric are influenced or various pattern effects are achieved. Stretchability of the weft-knitted fabric in the direction of the wales may for example be reduced by a filler yarn 15.

Warp-knitted fabric 13 is created by warp-knitting with many threads from top down, as shown in FIG. 1*a*. In doing so, the stitches of a thread are interlocked with the stitches of the neighboring threads. Depending on the pattern according to which the stitches of the neighboring threads are interlocked, one of the seven basic connections (also referred to as "interlaces" in warp-knitting) pillar, tricot, 2×1 plain, satin, velvet, atlas and twill are created, for example.

Figure 2:
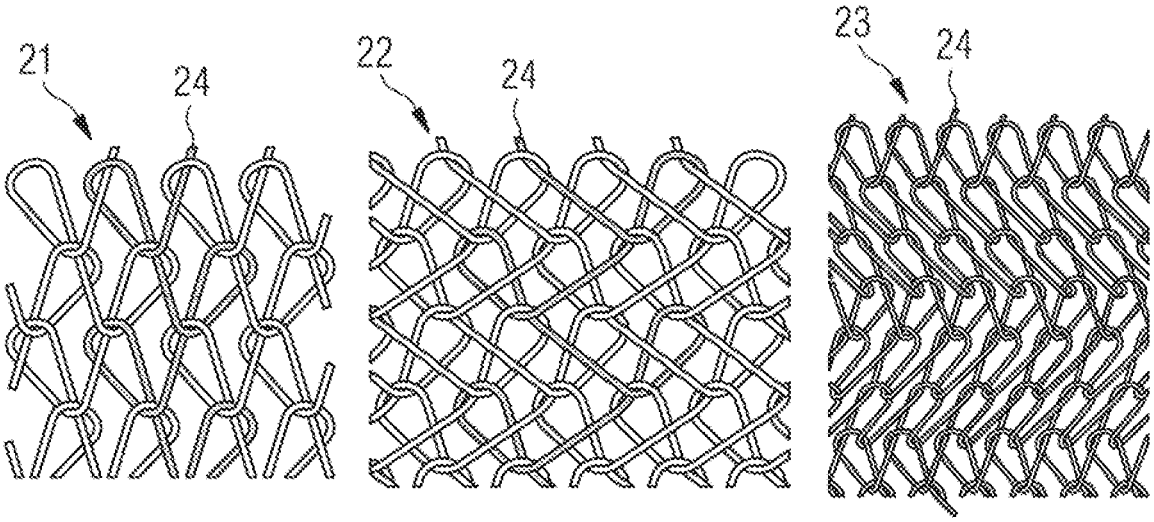
FIG. 2 are schematic representations of various interlaces of a warp-knitted fabric, according to certain embodiments of the present invention.

By way of example, the interlaces tricot 21, 2×1 plain 22, and atlas 23 are shown in FIG. 2. A different interlocking results depending on how the stitches of thread 24, which is highlighted by way of example, are interlocked in the stitches of neighboring threads. In the tricot interlace 21, the stitch-forming thread zigzags through the knitwear in the longitudinal direction and binds between two neighboring wales. The 2×1 plain interlace 22 binds in a manner similar to that of the tricot interlace 21, but each stitch-forming warp skips a wale. In the atlas interlace 23, each stitch-forming warp runs to a turning point in a stairs-shape and then changes direction.

Figure 3:
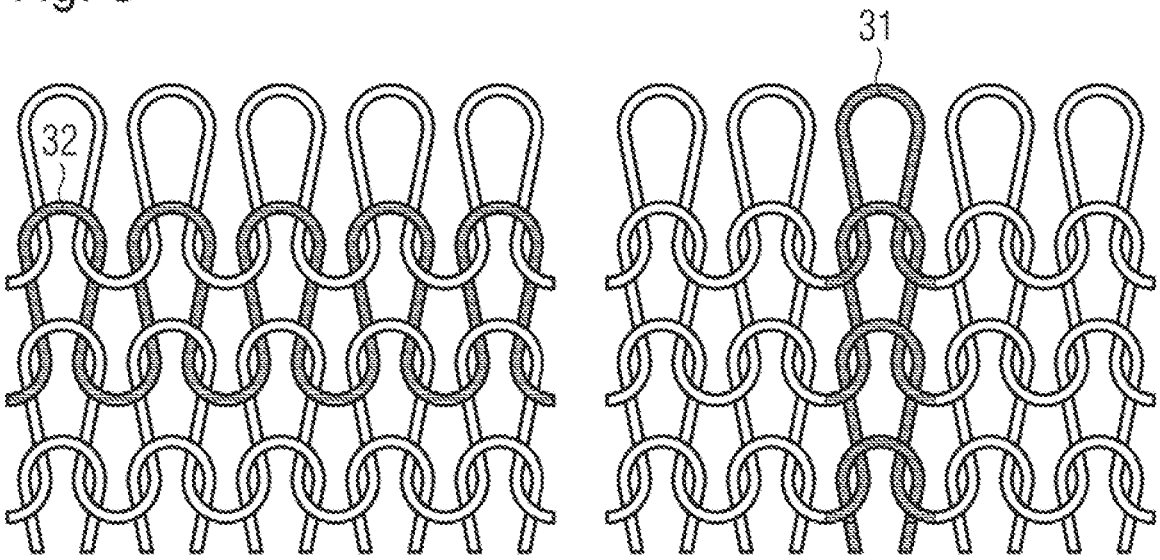
FIG. 3 are schematic representations of weft-knitted fabrics, according to certain embodiments of the present invention.

Stitches arranged above each other with joint binding sites are referred to as wales. FIG. 3 shows a wale as an example of a weft-knitted fabric 31. The term wale is also used analogously in warp-knitted fabrics. Accordingly, wales run vertically through the mesh fabric. Rows of stitches arranged next to one another, as shown by way of example for a weft-knitted fabric 32 in FIG. 3 are referred to as courses. The term course is also used analogously in warp-knitted fabrics. Accordingly, courses run through the mesh fabric in the lateral direction.

Figure 4:
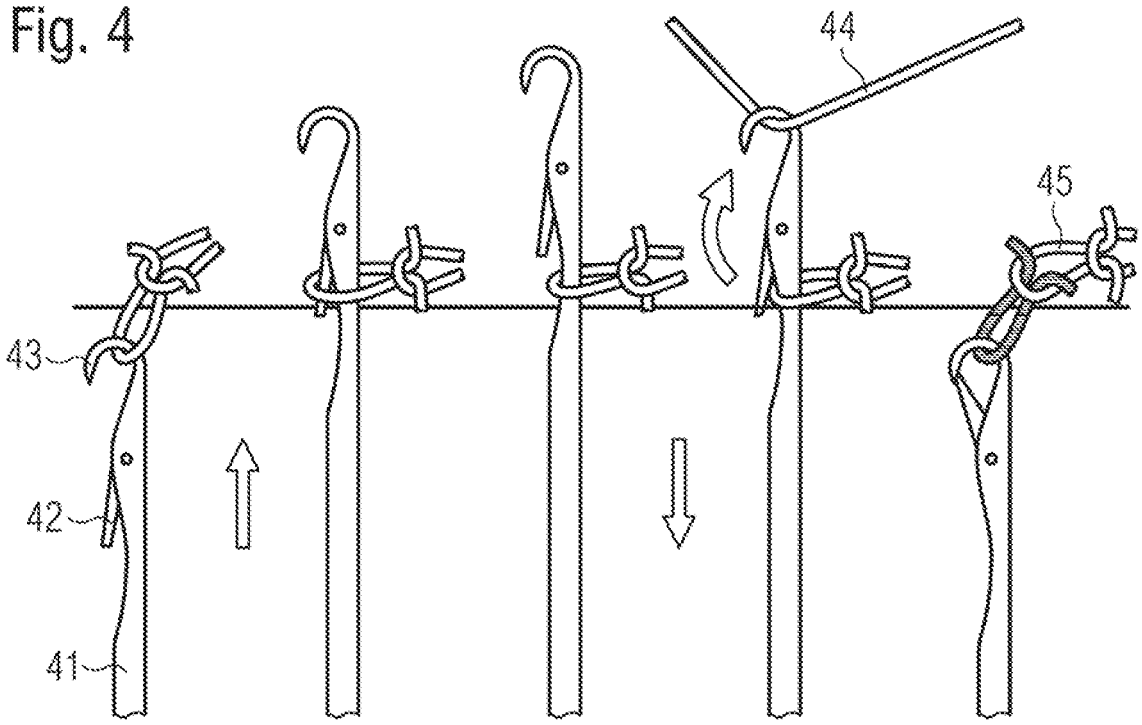
FIG. 4 are illustrations showing a process of stitch forming by latch needles during weft-knitting, according to certain embodiments of the present invention.

Three basic weft-knitted structures are known in weft-knitted fabrics, which may be recognized by the run of the stitches along a wale. With plain, single Jersey, only back loops may be recognized along a wale on one side of the fabric and only back loops may be recognized along the other side of the product. This structure is created on one row of needles of a knitting machine, i.e. an arrangement of neighboring knitting needles, and also referred to as single Jersey. With rib fabric, front and back loops alternate within a course, i.e. either only front or back loops may be found along a wale, depending on the side of the product from which the wale is considered. This structure is created on two rows of needles with needles offset opposite each other. With purl fabric, front and back loops alternate in one wale. Both sides of the product look the same. This structure is manufactured using latch needles as illustrated in FIG. 4 by stitch transfer. The transfer of stitches may be avoided if double latch needles are used, which comprise both a hook and a latch at each end, respectively.

In many embodiments, a variety of structures and surfaces that may be created with knitwear, which may or may not also be possible with weaving. It is possible to manufacture both very heavy and/or stiff knitwear and very soft, transparent and/or stretchable knitwear with substantially the same manufacturing technique. The parameters by which the properties of the material may be influenced substantially are the pattern of weft-knitting or warp-knitting, respectively, the used yarn, the needle size or the needle distance, and the tensile strain subject to which the yarn is placed on the needles.

In certain embodiments of weft-knitting, yarns may be weft-knitted in at freely selectable places. In this manner, selected zones may be provided with certain properties. For example, the shoe upper for the soccer shoe according to certain embodiments of the invention may be provided with zones made from rubberized yarn in order to achieve higher static friction and thus enable the player to better control the ball. By certain yarns being weft-knitted in at selected places, no additional elements have to be applied.

Knitted fabrics are manufactured on machines in the industrial context. These machines usually comprise a plurality of needles. In weft-knitting, latch needles 41 are usually used, which may comprise a moveable latch 42, as illustrated in FIG. 4. This latch 42 closes the hook 43 of the needle 41 so that a thread 44 may be pulled through a stitch 45 without the needle 41 being caught on the stitch 45. In weft-knitting, the latch needles 41 are usually moveable individually, so that every single needle 41 may be controlled so that it catches a thread for stitch formation.

A differentiation is made between flat-knitting and circular-knitting machines. In flat-knitting machines, a thread feeder feeds the thread back and forth along a row of needles. In a circular-knitting machine, the needles are arranged in a circular manner and the thread feeding correspondingly takes place in a circular movement along one or more round rows of needles.

Instead of a single row of needles, it is also possible for a knitting machine to comprise two parallel rows of needles. When looked at from the side, the needles of the two rows of needles may, for example, be opposite each other at a right angle. This enables the manufacture of more elaborate structures or weaves. The use of two rows of needles allows the manufacture of a one-layered or two-layered weft-knitted fabric. A one-layered weft-knitted fabric is created when the stitches generated on the first row of needles are enmeshed with the stitches generated on the second row of needles. Accordingly, a two-layered weft-knitted fabric is created when the stitches generate on the first row of needles are not or only selectively enmeshed with the stitches generated on the second row of needles and/or if they are merely enmeshed at the end of the weft-knitted fabric. If the stitches generated on the first row of needles are loosely enmeshed only selectively with the stitches generated on the second row of needles by an additional yarn, this is also referred to as spacer weft-knitted fabric. The additional yarn, for example a monofilament, is thus guided back and forth between two layers, so that a distance between the two layers is created. The two layers may e.g. be connected to each other via so-called tuck stitch.

Generally, the following weft-knitted fabrics may thus be manufactured on a weft-knitting machine: If only one row of needles is used, a one-layered weft-knitted fabric may be created. When two rows of needles are used, the stitches of both rows of needles may consistently be connected to each other so that the resulting knitwear comprises a single layer. If the stitches of both rows of needles are not connected or only connected at the edge when two rows of needles are used or are only selectively connected in certain locations, two layers are created. If the stitches of both rows of needles are connected selectively in turns by an additional thread, a spacer weft-knitted fabric is created. The additional thread is also referred to as spacer thread and it may be fed via a separate yarn feeder.

In certain embodiments, single-thread warp-knitted fabrics may be manufactured by jointly moved needles. In other embodiments, single-thread warp-knitted fabrics needles may be manufactured by fixing the needles and moving the fabric to create the relative motion between the needles and the fabric. In contrast to weft-knitting, the needles are typically not moved individually. Similar to weft-knitting, there are flat single thread warp-knitting and circular single thread warp-knitting machines.

In warp-knitting, one or several coiled threads, which are next to one another, are used. In stitch formation, the individual warps are placed around the needles and the needles are moved jointly.

The techniques described herein as well as further aspects of the manufacture of knitwear may be found in "Fachwissen Bekleidung", 6th ed. by H. Eberle et al. (published with the title "Clothing Technology" in English), in "Textil- and Modelexikon", 6th ed. by Alfons Hofer and in "Maschenlexikon", 11th ed. by Walter Holthaus, for example.

Three-Dimensional Knitwear

Three-dimensional (3D) knitwear may also be manufactured on weft-knitting machines and warp-knitting machines. This is knitwear comprises a spatial structure although it is weft-knitted or warp-knitted in a single process. A three-dimensional weft-knitting or warp-knitting technique allows for spatial knitwear to be manufactured without seams, cut or manufacture in one piece and in a single process.

Three-dimensional knitwear may, for example, be manufactured by varying the number of stitches in the direction of the wales by partial courses being formed. The corresponding mechanical process is referred to as "needle parking". Depending on the requirement, this technique may be combined with structural variations and/or variations of the number of stitches in the direction of the course. When partial courses are formed, stitch formation temporarily occurs only along a partial width of the weft-knitted fabric or warp-knitted fabric. The needles which are not involved in the stitch formation keep the half stitches ("needle parking") until weft-knitting occurs again at this position. In this way, it is possible to form bulges, for example.

By three-dimensional weft-knitting or warp-knitting, a shoe upper may be adjusted to the cobbler's last or the foot and a sole may be profiled, for example. The tongue of a shoe may e.g. be weft-knitted into the right shape. Contours, structures, knobs, curvatures, notches, openings, fasteners, loops and pockets may be integrated into the knitwear in a single process.

Three-dimensional knitwear may be used for the present invention in an advantageous manner.

Functional Knitwear

According to certain embodiments of the present invention, knitwear and particularly weft-knitted fabric may be provided with a range of functional properties and used in the present invention.

It is possible using a weft-knitting technique to manufacture knitwear having different functional areas and simultaneously maintaining its contours. The structures of knitwear may be adjusted to functional requirements in certain areas, by the stitch pattern, the yarn, the needle size, the needle distance or the tensile strain subject to which the yarn is placed on the needles being selected accordingly.

It is possible, for example, to include structures with large stitches or openings within the knitwear in areas in which airing is desired. In contrast, in areas in which support and stability are desired, fine-meshed stitch patterns, stiffer yarns or even multi-layered weft-knitting structures may be used, which will be described in the following. In the same manner, the thickness of the knitwear is variable.

Knitwear having more than one layer provides numerous possible constructions for the knitwear, which provide many advantages. Knitwear with more than one layer, e.g. two, may be weft-knitted or warp-knitted on a weft-knitting machine or a warp-knitting machine with several rows of needles, e.g. two, in a single stage, as described in the section "knitwear" above. Alternatively, several layers, e.g. two, may be weft-knitted or warp-knitted in separate stages and then placed above each other and connected to each other if applicable, e.g. by sewing, gluing, welding or linking.

Several layers fundamentally increase solidness and stability of the knitwear. In this regard, the resulting solidness depends on the extent to which and the techniques by which the layers are connected to each other. The same yarn or different yarns may be used for the individual layers. For example, it is possible for one layer to be weft-knitted from multi-fiber yarn and one layer to be weft-knitted from monofilament, whose stitches are enmeshed in a weft-knitted fabric. In particular, stretchability of the weft-knitted layer is reduced due to this combination of different yarns. In this construction, a layer made from monofilament may be arranged between two layers made from multi-fiber yarn in order to reduce stretchability and increase solidness of the knitwear. This results in a pleasant surface made from multi-fiber yarn on both sides of the knitwear.

An alternative of two-layered knitwear is referred to as spacer weft-knitted fabric or spacer warp-knitted fabric, as explained in the section "knitwear". In this regard, a spacer yarn is weft-knitted or warp-knitted more or less loosely between two weft-knitted or warp-knitted layers, interconnecting the two layers and simultaneously serving as a filler. The spacer yarn may comprise the same material as the layers themselves, e.g. polyester or another material. The spacer yarn may also be a monofilament which provides the spacer weft-knitted fabric or spacer warp-knitted fabric with stability.

Such spacer weft-knitted fabrics or spacer warp-knitted fabrics, respectively, which are also referred to as three-dimensional weft-knitted fabrics, which are differentiated from the formative 3D weft-knitted fabrics or 3D warp-knitted fabrics mentioned in the section "three-dimensional knitwear" above, may be used wherever additional cushioning or protection is desired, e.g. at the shoe upper or the tongue of a shoe upper or in certain areas of a sole. Three-dimensional structures may also serve to create spaces between neighboring textile layers or also between a textile layer and the foot and thus ensuring airing. Moreover, the layers of a spacer weft-knitted fabric or a spacer warp-knitted fabric may comprise different yarns depending on the position of the spacer weft-knitted fabric on the foot.

The thickness of a spacer weft-knitted fabric or a spacer warp-knitted fabric may be set in different areas depending on the function or the wearer. Various degrees of cushioning may be achieved with areas of various thicknesses, for example. Thin areas may increase bendability, for example, thus fulfilling the function of joints or flex lines.

Multi-layered constructions also provide opportunities for color design, by different colors being used for different layers. In this way, knitwear may be provided with two different colors for the front and the back, for example. A shoe upper made from such knitwear may then comprise a different color on the outside than on the inside.

Other multi-layered constructions may include pockets or tunnels, in which two textile layers or knitwear weft-knitted or warp-knitted on two rows of needles are connected to each other only in certain areas so that a hollow space is created. Alternatively, items of knitwear weft-knitted or warp-knitted in two separate processes are connected to each other such that a void is created, e.g. by sewing, gluing, welding or linking. It is then possible to introduce a cushioning material such as a foam material, eTPU (expanded thermoplastic urethane), ePP (expanded polypropylene), expanded EVA (ethylene vinyl acetate) or particle foam, an air or gel cushion for example, through an opening, e.g. at the tongue, the shoe upper, the heel, the sole or in other areas. Alternatively or additionally, the pocket may also be filled with a filler thread or a spacer knitwear. It is furthermore possible for threads to be pulled through tunnels, for example as reinforcement in case of tension loads in certain areas of a shoe upper. Moreover, it is also possible for the laces to be guided through such tunnels. Moreover, loose threads may be placed into tunnels or pockets for padding, for example in the area of the ankle. However, it is also possible for stiffer reinforcing elements, such as caps, flaps or bones to be inserted into tunnels or pockets. These may be manufactured from plastic such as polyethylene, TPU, polyethylene or polypropylene, for example.

A further possibility for a functional design of knitwear is the use of certain variations of the basic weaves. In weft-knitting, it is possible for bulges, ribs or waves to be weft-knitted in certain areas, for example, in order to achieve reinforcement in these places. A wave may, for example, be created by stitch accumulation on a layer of knitwear. This means that more stitches are weft-knitted or warp-knitted on one layer than on another layer. Alternatively, different stitches are weft-knitted fabric on the one layer than on the other layer, e.g. by being weft-knitted fabric tighter, wider or using a different yarn. Thickening is caused in both alternatives.

Ribs, waves, or similar patterns may, for example, also be used at the bottom of a weft-knitted outer sole of a shoe in order to provide a tread and provide the shoe with better non-slip properties. In order to obtain a rather thick weft-knitted fabric, for example, it is possible to use the weft-knitting techniques "tuck" or "half cardigan", which are described in "Fachwissen Bekleidung", 6th ed. by H. Eberle et al., for example.

Waves may be weft-knitted or warp-knitted such that a connection is created between two layers of a two-layered knitwear or such that no connection is created between the two layers. A wave may also be weft-knitted as a right-left wave on both sides with or without a connection of the two layers. A structure in the knitwear may be achieved by an uneven ration of stitches on the front or the back of the knitwear.

Ribs, waves or similar patterns, for example, may be included in the knitwear of the soccer shoe according to certain embodiments of the invention in order to increase friction with a soccer ball, for example, and/or in order to generally allow for a soccer player to have better control of the ball.

A further possibility of functionally designing knitwear within the framework of the present invention is providing openings in the knitwear already during weft-knitting or warp-knitting. In this manner, airing of the soccer shoe according to the invention may be provided in specific places in a simple manner.

In certain embodiments, functionally designing knitwear within the framework may include forming laces integrally with the knitwear of the shoe upper. In these embodiments, the laces are warp-knitted or weft-knitted integrally with the knitwear already when the knitwear of the shoe upper is weft-knitted or warp-knitted. In this regard, a first end of a lace is connected to the knitwear, while a second end is free.

In some embodiments, the first end is connected to the knitwear of the shoe upper in the area of the transition from the tongue to the area of the forefoot of the shoe upper. In these embodiments, a first end of a first lace may be connected to the knitwear of the shoe upper at the medial side of the tongue and a first end of a second lace is connected to the knitwear of the shoe upper at the lateral side of the tongue. The respective second ends of the two laces may then be pulled through lace eyelets for tying the shoe.

A possibility of speeding up the integral weft-knitting or warp-knitting of laces is having all yarns used for weft-knitting or warp-knitting knitwear end in the area of the transition from the tongue to the area of the forefoot of the shoe upper. In some embodiments, the yarns may end in the medial side of the shoe upper on the medial side of the tongue and form the lace connected on the medial side of the tongue. In certain embodiments, the yarns may end in the lateral side of the shoe upper on the lateral side of the tongue and form the lace connected to the lateral side of the tongue. The yarns may then be cut off at a length that is sufficiently long for forming laces. The yarns may be twisted or intertwined, for example. The respective second end of the laces may be provided with a lace clip. Alternatively, the second ends are fused or provided with a coating.

The knitwear is particularly stretchable in the direction of the stitches (longitudinal direction) due to its construction. This stretching may be reduced e.g. by subsequent polymer coating of the knitwear. The stretching may also be reduced during manufacture of the knitwear itself. One possibility is reducing the mesh openings, that is, using a smaller needle size. Smaller stitches generally result in less stretching of the knitwear. Moreover, the stretching of the knitwear may be reduced by knitted reinforcement, e.g. three-dimensional structures. In various embodiments, such structures may be arranged on the inside or the outside of the knitwear of the shoe upper. Furthermore, non-stretchable yarn, e.g. made from nylon, may be laid in a tunnel along the knitwear in order to limit stretching to the length of the non-stretchable yarn.

Colored areas with several colors may be created by using a different thread and/or by additional layers. In transitional areas, smaller mesh openings (smaller needle sizes) are used in order to achieve a fluent passage of colors.

Further effects may be achieved by weft-knitted insets (inlaid works) or Jacquard knitting. Inlaid works are areas which only provide a certain yarn, e.g. in a certain color. Neighboring areas which may comprise a different yarn, for example in a different color, are then connected to each other by a so-called tuck stitch.

During Jacquard knitting, two rows of needles are used and two different yarns run through all areas, for example. However, in certain areas only one yarn appears on the visible side of the knitwear and the respective other yarn runs invisibly on the other side of the knitwear.

A product manufactured from knitwear may be manufactured in one piece on a weft-knitting machine or a warp-knitting machine. Functional areas may then already be manufactured during weft-knitting or warp-knitting by corresponding techniques as described here.

Alternatively, the product may be combined from several parts of knitwear and it may also comprise parts that are not manufactured from knitwear. In this regard, the parts of knitwear may each be designed separately with different functions, for example regarding thickness, isolation, transport of moisture, stability, protection, abrasion resistance, durability, cooling, stretching, rigidity, compression, etc.

In certain embodiments, the shoe upper of the soccer shoe and/or its sole may, for example, be generally manufactured from knitwear as a whole or it may be put together from different parts of knitted goods. A whole shoe upper or parts of that may, for example, be separated, e.g. punched, from a larger piece of knitwear. The larger piece of knitwear may, for example, be a circular weft-knitted fabric or a circular warp-knitted fabric or a flat weft-knitted fabric or a flat warp-knitted fabric.

For example, a tongue may be manufactured as a continuous piece and connected with the shoe upper subsequently, or it may be manufactured in one piece with the shoe upper. With regard to their functional designs, ridges on the inside may e.g. improve flexibility of the tongue and ensure that a distance is created between the tongue and the foot, which provides additional airing. Laces may be guided through one or several weft-knitted tunnels of the tongue. The tongue may also be reinforced with polymer in order to achieve stabilization of the tongue and e.g. prevent a very thin tongue from convolving. Moreover, the tongue may then also be fitted to the shape of the cobbler's last or the foot.

Applications such as PU prints, TPU ribbons, textile reinforcements, leather, rubber, etc., may be subsequently applied to the knitwear of the soccer shoe. Thus, it is possible, for example, to apply a plastic heel or toe cap as reinforcement or logos and eyelets for laces on the shoe upper, for example by sewing, gluing or welding, as described below.

Sewing, gluing or welding, for example, constitute suitable connection techniques for connecting individual parts of knitwear with other textiles or with other parts of knitwear. Linking is another possibility for connecting two parts of knitwear. Therein, two edges of knitwear are connected to each other according to the stitches (usually stitch by stitch).

A possibility for welding textiles, particularly ones made from plastic yarns or threads, is ultrasonic welding. Therein, mechanical oscillations in the ultrasonic frequency range are transferred to a tool referred to as a sonotrode. The oscillations are transferred to the textiles to be connected by the sonotrode under pressure. Due to the resulting friction, the textiles are heated up, softened and ultimately connected in the area of the place of contact with the sonotrode. Ultrasonic welding allows rapidly and cost-effectively connecting particularly textiles with plastic yarns or threads. It is possible for a ribbon to be attached, for example glued, to the weld seam, which additionally reinforces the weld seam and is optically more appealing. Moreover, wear comfort is increased since skin irritations—especially at the transition to the tongue—are avoided.

Figure 5A:
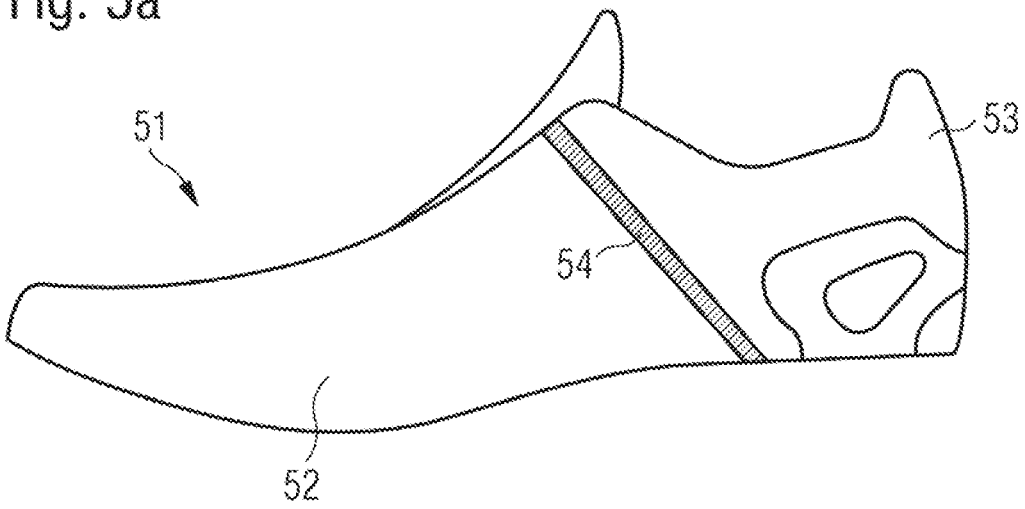
FIG. 5*a* is a side view of a shoe upper with two connected textile areas, according to certain embodiments of the present invention.
Figure 5B:
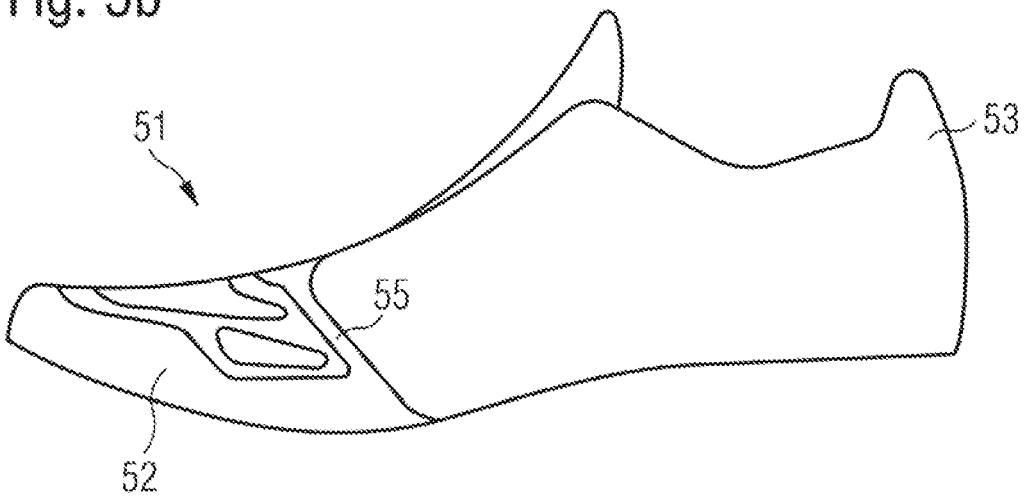
FIG. 5*b* is a side view of a shoe upper with two connected textile areas, according to certain embodiments of the present invention.

Connecting various textile areas, such as parts of knitwear, may occur at quite different locations. For example, the seams for connecting various textile areas of the shoe upper of the soccer shoe may be arranged at various positions, as shown in FIGS. 5*a* and 5*b*. A shoe upper 51 is shown in FIG. 5*a* which comprises two textile areas 52 and 53. They are sewn to each other.

The seam 54 which connects the two textile areas 52 and 53 runs diagonally from an instep area of the shoe upper to an area of the sole in the transition area from the midfoot to the heel. In FIG. 5*b* the seam 55 also runs diagonally, but it is arranged more to the front in the direction of the toe region. Other arrangements of seams and connecting places in general are also possible. The seams shown in FIGS. 5*a* and 5*b* may each be a thread seam, a glued seam, a welded seam or a linking seam. The two seams 54 and 55 may each be mounted only on one side of the upper 51 or on both sides of the shoe upper.

In certain embodiments, adhesive tape may be used to connect textile areas. This feature may also be used in addition to an existing connection, e.g. over a sewn seam or a welded seam. An adhesive tape may fulfill further functions in addition to the function of connecting, such as e.g. protection against dirt or water. An adhesive tape may comprise properties which change over its length.

Figure 6A:
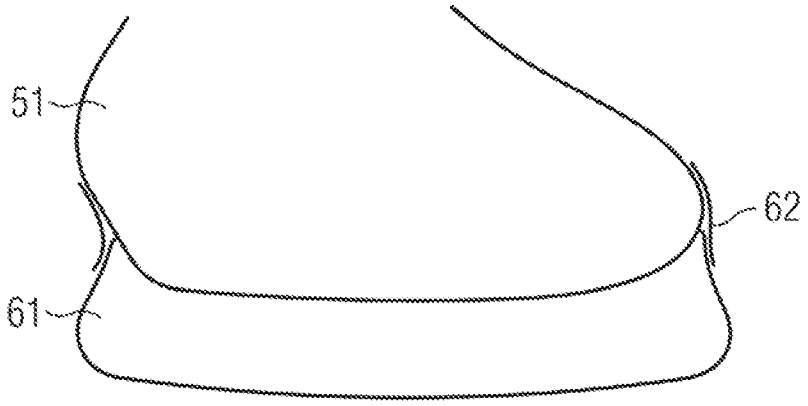
FIGS. 6*a*-6*c* are cross-sectional views of an upper connected to a shoe sole via adhesive tape, according to certain embodiments of the present invention.
Figure 6B:
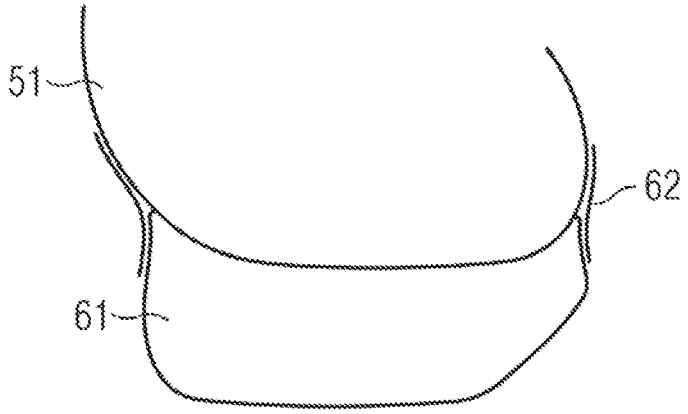
Figure 6C:
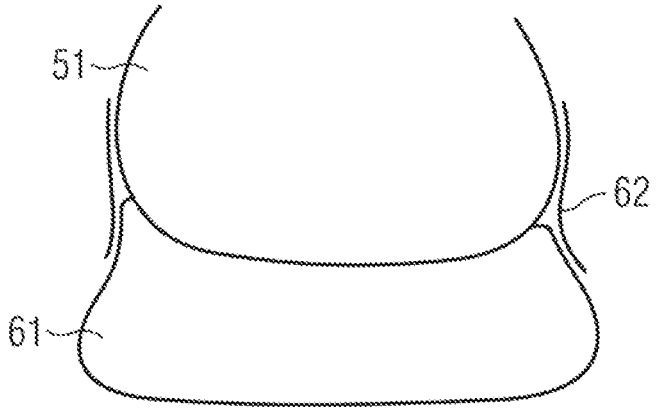

Embodiments of a shoe upper 51 connected to a shoe sole 61 using adhesive tape are shown in FIGS. 6*a*, 6*b*, and 6*c*. Each of FIGS. 6*a*, 6*b*, and 6*c* shows a cross-section of a shoe depicting different positions of the foot and the resulting deformation of the shoe. For example, tensile forces work on the right side of the shoe in FIG. 6*a*, whereas compression forces work on the left side.

The shoe sole 61 may be an outsole or a midsole. The shoe upper 51 and the shoe sole 61 are connected to each other by a surrounding adhesive tape 62. The adhesive tape 62 may be of varying flexibility along its length. For example, the adhesive tape 62 might be particularly rigid and not very flexible in the shoe's heel region in order to provide the shoe with the necessary stability in the heel region. This may be achieved by varying the width and/or the thickness of the adhesive tape 62, for example. The adhesive tape 62 may generally be constructed such that it is able to receive certain forces in certain areas along the tape.

In this way, the adhesive tape 62 does not only connect the shoe upper to the sole but simultaneously fulfills the function of structural reinforcement.

Fibers

The yarns or threads, respectively, used for the knitwear of the present invention usually comprise fibers. As was explained above, a flexible structure which is rather thin in relation to its length is referred to as a fiber. Very long fibers, of virtually unlimited length with regard to their use, are referred to as filaments. Fibers are spun or twisted into threads or yarns. Fibers may also be long, however, and twirled into a yarn. Fibers may include natural or synthetic materials. Natural fibers are environmentally friendly, since they are compostable. Natural fibers include cotton, wool, alpaca, hemp, coconut fibers or silk, for example. Among the synthetic fibers are polymer-based fibers such as nylon, polyester, elastane, or spandex, respectively, or Kevlar® or other para-aramid synthetic fiber, which may be produced as classic fibers or as high-performance fibers or technical fibers.

In certain embodiments, a soccer shoe may be assembled from various parts, with a weft-knitted or a warp-knitted part comprising natural yarn made from natural fibers and a removable part, e.g. the insole, comprising plastic, for example. In this manner, both parts may be disposed of separately. In this example, the weft-knitted part could be directed to compostable waste, whereas the insole could be directed to recycling of reusable materials, for example.

Figure 7:
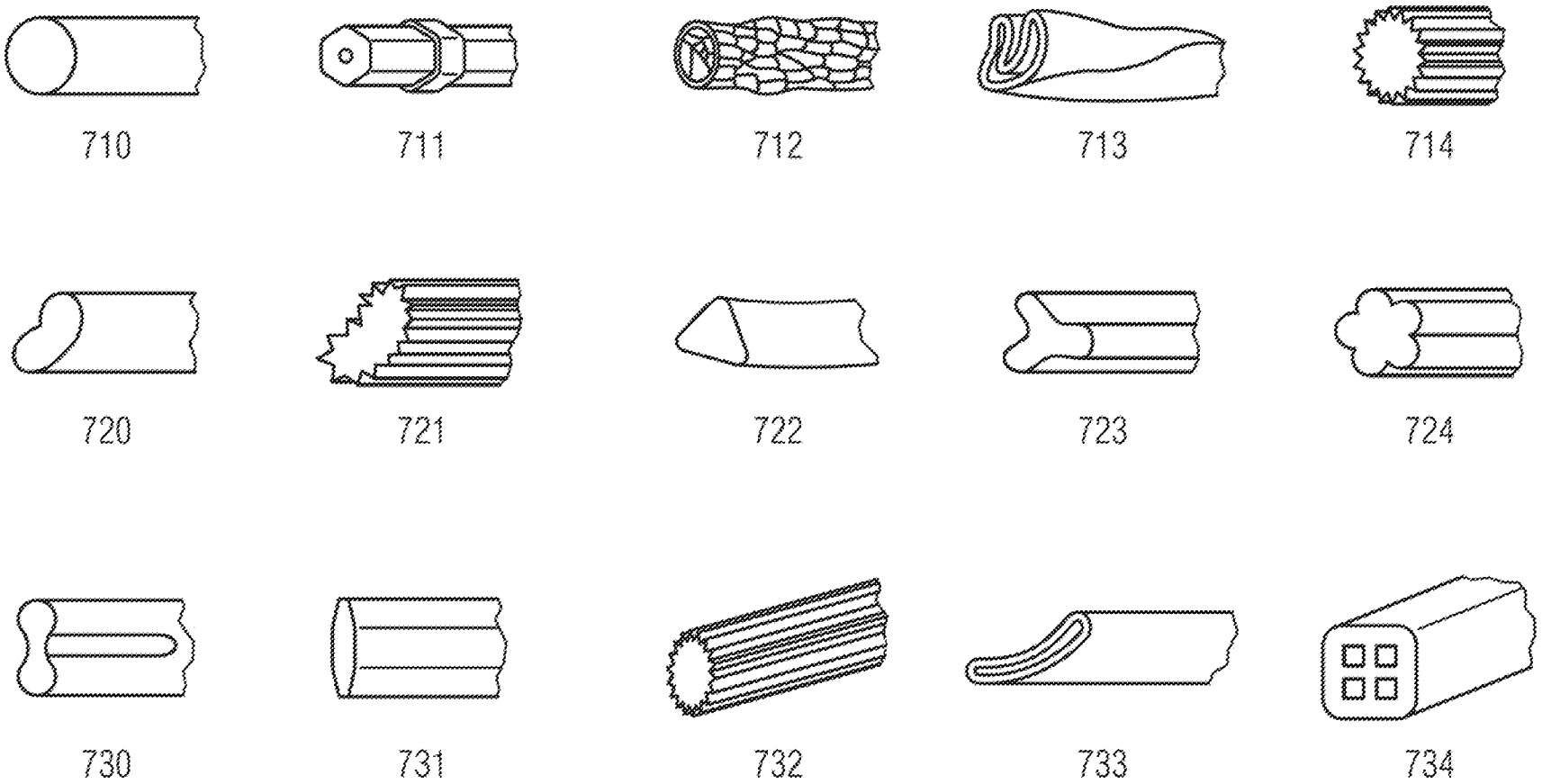
FIG. 7 are cross-sectional views of fibers for yarns used in knitwear, according to certain embodiments of the present invention.

The mechanical and physical properties of a fiber and the yarn manufactured therefrom are also determined by the fiber's cross-section, as illustrated in FIG. 7. These different cross-sections, their properties and examples of materials having such cross-sections will be explained in the following.

A fiber having the circular cross-section 710 may either be solid or hollow. A solid fiber is the most frequent type, it allows easy bending and is soft to the touch. A fiber as a hollow circle with the same weight/length ratio as the solid fiber has a larger cross-section and is more resistant to bending. Examples of fibers with a circular cross-section are nylon, polyester, and Lyocell.

A fiber having the bone-shaped cross-section 730 has the property of wicking moisture. Examples of such fibers are acrylic or spandex. The concave areas in the middle of the fiber support moisture being passed on in the longitudinal direction, with moisture being rapidly wicked from a certain place and distributed.

The following further cross-sections are illustrated in FIG. 7:

Polygonal cross-section 711 with nodes; example: flax;

Oval to round cross-section 712 with overlapping sections; example: wool;

Flat, oval cross-section 713 with expansion and convolution; example: cotton;

Circular, serrated cross-section 714 with partial striations; example: rayon;

Lima bean cross-section 720; smooth surface;

Serrated lima bean cross-section 721; example: Avril™ rayon;

Triangular cross-section 722 with rounded edges; example: silk;

Trilobal star cross-section 723; like triangular fiber with shinier appearance;

Clubbed cross-section 724 with partial striations; sparkling appearance; example: acetate;

Flat and broad cross-section 731; example: acetate in another design;

Star-shaped or concertina cross section 732;

Cross-section 733 in the shape of a collapsed tube with a hollow center; and Square cross-section 734 with voids; example: AnsoIV™ nylon.

Individual fibers with their properties which are relevant for the manufacture of knitwear for the present invention will be described in the following:

aramid fibers: good resistance to abrasion and organic solvents; non-conductive; temperature-resistant up to 500° C.

para-aramid fibers: known under trade names Kevlar®, Techova™, and Twaron™; outstanding strength-to-weight properties; high Young's modulus and high tensile strength (higher than with meta-aramides); low stretching and low elongation at break (approx. 3.5%); difficult to dye.

meta-aramides: known under trade names Numex™, Teijinconex™, New Star™, X-Fiper™.

dyneema fibers: highest impact strength of any known thermoplastics; highly resistant to corrosive chemicals, with exception of oxidizing acids; extremely low moisture absorption; very low coefficient of friction, which is significantly lower than that of nylon and acetate and comparable to Teflon®; self-lubricating; highly resistant to abrasion (15 times more resistant to abrasion than carbon steel); nontoxic.

carbon fiber: an extremely thin fiber about 0.005-0.010 mm in diameter, composed substantially of carbon atoms; highly stable with regard to size; one yarn is formed from several thousand carbon fibers; high tensile strength; low weight; low thermal expansion; very strong when stretched or bent; thermal conductivity and electric conductivity.

glass fiber: high ratio of surface area to weight; with the increased surface making the glass fiber susceptible to chemical attack; by trapping air within them, blocks of glass fibers provide good thermal insulation; thermal conductivity of 0.05 W/(m×K); the thinnest fibers are the strongest because the thinner fibers are more ductile; the properties of the glass fibers are the same along the fiber and across its cross-section, since glass has an amorphous structure; moisture accumulates easily, which can worsen microscopic cracks and surface defects and lessen tensile strength; correlation between bending diameter of the fiber and the fiber diameter; thermal, electrical and sound insulation; higher stretching before it breaks than carbon fibers.

Yarns

A plurality of different yarns may be used for the manufacture of knitwear according to certain embodiments in the present invention. As was already defined, a structure of one or several fibers which is long in relation to its diameter is referred to as a yarn.

Functional yarns are capable of transporting moisture and thus of absorbing sweat and moisture. They may be electrically conducting, self-cleaning, thermally regulating and insulating, flame resistant, and UV-absorbing, and may enable infrared radiation. They may be suitable for sensors. Antibacterial yarns, such as silver yarns, for example, prevent odor formation.

Stainless steel yarn contains fibers made of a blend of nylon or polyester and steel. Its properties include high abrasion resistance, higher cut resistance, high thermal abrasion, high thermal and electrical conductivity, higher tensile strength and high weight.

In textiles made from knitwear, electrically conducting yarns may be used for the integration of electronic devices. These yarns may, for example, forward impulses from sensors to devices for processing the impulses, or the yarns may function as sensors themselves, and measure electric streams on the skin or physiological magnetic fields, for example. Examples for the use of textile-based electrodes may be found in European patent application EP 1 916 323.

Fuse yarns may be a mixture of a thermoplastic yarn and a non-thermoplastic yarn. There are essentially three types of fuse yarns: a thermoplastic yarn surrounded by a non-thermoplastic yarn; a non-thermoplastic yarn surrounded by thermoplastic yarn; and pure melt yarn of a thermoplastic material. After being heated to the melting temperature, thermoplastic yarn fuses with the non-thermoplastic yarn (e.g. polyester or nylon), stiffening the knitwear. The melting temperature of the thermoplastic yarn is determined accordingly and it is usually lower than that of the non-thermoplastic yarn in case of a mixed yarn.

A shrinking yarn is a dual-component yarn. The outer component is a shrinking material, which shrinks when a defined temperature is exceeded. The inner component is a non-shrinking yarn, such as polyester or nylon. Shrinking increases the stiffness of the textile material.

A further yarn for use in knitwear are luminescent or reflecting yarns and so-called "intelligent" yarns. Examples of intelligent yarns are yarns which react to humidity, heat or cold and alter their properties accordingly, e.g. contracting and thus making the stitches smaller or changing their volume and thus increasing permeability to air. Yarns made from piezo fibers or yarn coated with a piezo-electrical substance are able to convert kinetic energy or changes in pressure into electricity, which may provide energy to sensors, transmitters or accumulators, for example.

Yarns may furthermore generally be reworked, e.g. coated, in order to maintain certain properties, such as stretching, water resistance/repellency, color or humidity resistance.

Polymer Coating

Due to its structure, weft-knitted or warp-knitted knitwear is considerably more flexible and stretchable than weaved textile materials. For certain applications and requirements, e.g. in certain areas of a shoe upper according to the present invention, it is therefore necessary to reduce flexibility and stretchability in order to achieve sufficient stability.

For that purpose, a polymer layer may be applied to one side or both sides of knitwear (weft-knit or warp-knit goods), but generally also to other textile materials. Such a polymer layer causes a reinforcement and/or stiffening of the knitwear. In a shoe upper it may, for example, serve the purpose of supporting and/or stiffening and/or reducing elasticity in the toe region, in the heel region, along the lace eyelets, on lateral and/or medial surfaces or in other areas. Furthermore, elasticity of the knitwear and particularly stretchability are reduced. Moreover, the polymer layer protects the knitwear against abrasion. Furthermore, it is possible to give the knitwear a three-dimensional shape using the polymer coating by compression-molding. The polymer coating may be thermoplastic urethane ("TPU"), for example.

In the first step of polymer coating, the polymer material may be applied to one side of the knitwear. It may also be applied on both sides, however. The material may be applied by spraying, knife coating, laying, printing, sintering, ironing or spreading. If it is polymer material in the form of a film, the latter is placed on the knitwear and connected with the knitwear by heat and pressure, for example. Spraying may be carried out by a tool similar to a hot glue gun. Spraying enables the polymer material to be applied evenly in thin layers. Moreover, spraying is a fast method. Effect pigments such as color pigments, for example, may be mixed into the polymer coating.

According to certain embodiments, the polymer is applied in at least one layer with a thickness of 0.2-1 mm. One or several layers may be applied, with it being possible for the layers to be of different thicknesses and/or colors. For example, a shoe may comprise a polymer coating with a thickness of 0.01 to 5 mm. Further, with some shoes, the thickness of the polymer coating may be between 0.05 and 2 mm. Between neighboring areas of a shoe with polymer coatings of various thicknesses there may be continuous transitions from areas with a thin polymer coating to areas with a thick polymer coating. In the same manner, different polymer materials may be used in different areas, as will be described in the following.

During application, polymer material attaches itself to the points of contact or points of intersection, respectively, of the yarns of the knitwear, on the one hand, and to the gaps between the yarns, on the other hand, forming a closed polymer surface on the knitwear after the processing steps described in the following. However, in case of larger mesh openings or holes in the textile structure, this closed polymer surface may also be intermittent, e.g. so as to enable airing. This also depends on the thickness of the applied material: The more thinly the polymer material is applied, the easier it is for the closed polymer surface to be intermittent. Moreover, the polymer material may also penetrate the yarn and soak it and thus contributes to its stiffening.

After application of the polymer material, the knitwear is pressed in a press under heat and pressure. The polymer material liquefies in this step and fuses with the yarn of the textile material.

In a further optional step, the knitwear may be pressed into a three-dimensional shape in a machine for compression-molding. For example, the area of the heel or the area of the toe region of a shoe upper may be shaped three-dimensionally over a cobbler's last. Alternatively, the knitwear may also be directly fitted to a foot.

After pressing and molding, the reaction time until complete stiffening may be one to two days, depending on the used polymer material.

The following polymer materials may be used: polyester; polyester-urethane pre-polymer; acrylate; acetate; reactive polyolefins; co-polyester; polyamide; co-polyamide; reactive systems (mainly polyurethane systems reactive with $H_2O$ or $O_2$); polyurethanes; thermoplastic polyurethanes; and polymeric dispersions.

The described polymer coating may be used sensibly wherever support functions, stiffening, increased abrasion resistance, elimination of stretchability, increase of comfort, increase of friction, and/or fitting to prescribed three-dimensional geometries are desired. It is also possible to fit the shoe upper to the individual shape of the foot of the person wearing it, by polymer material being applied to the shoe upper and then adapting to the shape of the foot under heat.

Additionally or alternatively to a reinforcing polymer coating, knitwear may be provided with a water-repellent coating to avoid or at least reduce permeation of humidity, e.g. into a shoe upper. The water-repellent coating may be applied to the entire shoe upper or only a part thereof, e.g. in the toe region. Water-repellent materials may be based e.g. on hydrophobic materials such as polytetrafluoroethylene ("PTFE"), wax, or white wax. A commercially available coating is Scotchgard™ from 3M.

Monofilaments for Reinforcement

As was already defined, a monofilament is a yarn formed by one single filament, that is, one single fiber. Therefore, in certain embodiments, stretchability of monofilaments is considerably lower than that of yarns which are manufactured from many fibers. This also reduces the stretchability of knitwear that is manufactured from monofilaments or include monofilaments and which are used in the present invention. Monofilaments are typically made from polyamide. However, other materials, such as polyester or a thermoplastic material, are also possible.

So whereas knitwear made from a monofilament is considerably more rigid and less stretchable, this knitwear may not include the desired surface properties, such as e.g. smoothness, colors, transport of moisture, outer appearance and variety of textile structures as usual knitwear has. This disadvantage is overcome by the knitwear described in the following.

Figure 8:
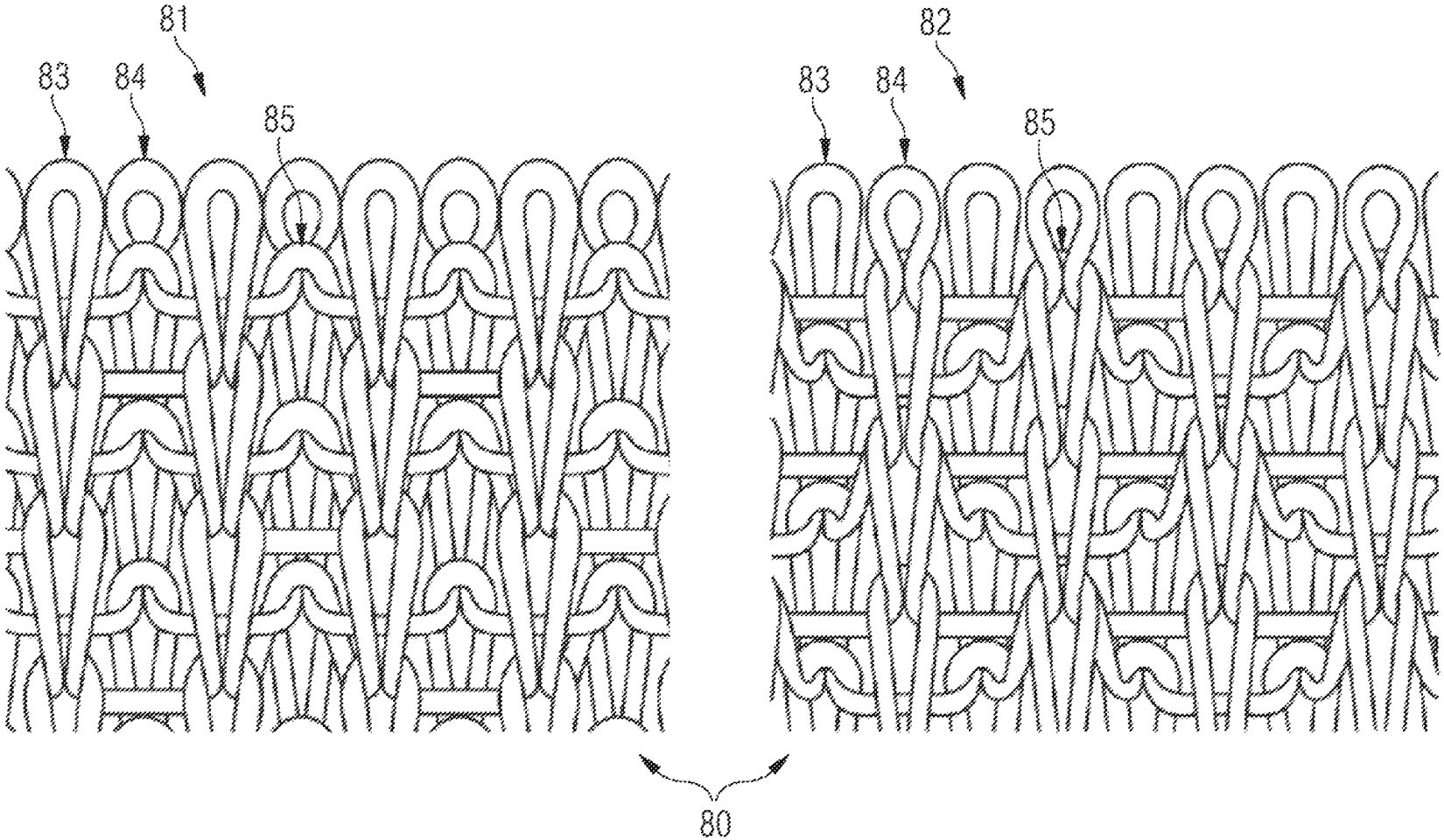
FIG. 8 is a front view and a back view of a knitted knitwear, according to certain embodiments of the present invention.

FIG. 8 depicts a weft-knitted fabric having a weft-knitted layer made from a first yarn, such as a multi-fiber yarn, for example, and a weft-knitted layer made from monofilament. The layer of monofilament is knitted into the layer of the first yarn. The resulting two-layered knitwear is considerably more solid and less stretchable than the layer made from yarn alone.

FIG. 8 particularly depicts a front view 81 and a back view 82 of a two-layered knitwear 80. Both views show a first weft-knitted layer 83 made from a first yarn and a second weft-knitted layer 84 made from monofilament. The first weft-knitted layer 83 made from a first yarn is connected to the second weft-knitted layer 84 by stitches 85. Thus, the greater solidness and smaller stretchability of the second weft-knitted layer 84 made from the monofilament is transferred to the first weft-knitted layer 83 made from the first yarn.

A monofilament may also be melted slightly in order to connect with the layer of the first yarn and limit stretching even more. The monofilament then fuses with the first yarn at the points of contact and fixates the first yarn with respect to the layer made from monofilament.

Combination of Monofilaments and Polymer Coating

The weft-knitted fabric having two layers described in the preceding section may additionally be reinforced by a polymer coating as was already described in the section "polymer coating". The polymer material is applied to the weft-knitted layer made from monofilament. In doing so, it does not connect to the material (e.g. polyamide material) of the monofilament, since the monofilament has a very smooth and round surface, but substantially penetrates the underlying first layer of a first yarn (e.g. polyester yarn). During subsequent pressing, the polymer material therefore fuses with the yarn of the first layer and reinforces the first layer. In doing so, the polymer material has a lower melting point than the first yarn of the first layer and the monofilament of the second layer. The temperature during pressing is selected such that only the polymer material melts but not the monofilament or the first yarn.

Fuse Yarn

For reinforcement and for the reduction of stretching, the yarn of the knitwear which is used according to the invention may additionally or alternatively also be a fuse yarn that fixes the knitwear after pressing. There are substantially three types of melt yarns: a thermoplastic yarn surrounded by a non-thermoplastic yarn; a non-thermoplastic yarn surrounded by thermoplastic yarn; and pure melt yarn of a thermoplastic material. In order to improve the bond between thermoplastic yarn and the non-thermoplastic yarn, it is possible for the surface of the non-thermoplastic yarn to be texturized.

In certain embodiments, pressing takes place at a temperature ranging from 110 to 150° C., and may further be approximately 130° C. The thermoplastic yarn melts at least partially in the process and fuses with the non-thermoplastic yarn. After pressing, the knitwear is cooled, so that the bond is hardened and fixed. The fuse yarn may be arranged in the entire knitwear or only in selective areas.

In some embodiments, the fuse yarn is weft-knitted or warp-knitted into the knitwear. In case of several layers, the fuse/melt yarn may be weft-knitted into one, several or all layers of the knitwear.

In certain embodiments, the fuse/melt yarn may be arranged between two layers of knitwear. In doing so, the fuse/melt yarn may simply be placed between the layers. Arrangement between the layers may be desirable in certain instances, as the mold is not contaminated or soiled during pressing and molding, since there is no direct contact between the fuse/melt yarn and the mold.

Thermoplastic Textile for Reinforcement

A further possibility for reinforcing knitwear that is used for the present invention is the use of a thermoplastic textile. This is a thermoplastic woven fabric or thermoplastic knitwear. A thermoplastic textile fuses at least partially when subjected to heat and stiffens as it cools down. A thermoplastic textile may, for example, be applied to the surface of the knitwear by applying pressure and heat. When it cools down, the thermoplastic textile stiffens and specifically reinforces the shoe upper in the area in which it was placed, for example.

The thermoplastic textile may be specifically manufactured for the reinforcement in its shape, thickness and structure. Additionally, its properties may be varied in certain areas. The stitch structure, the knitting stitch, and/or the yarn used may be varied such that different properties are achieved in different areas.

According to certain embodiments, a thermoplastic textile is a weft-knitted fabric or warp-knitted fabric made from thermoplastic yarn. Additionally, the thermoplastic textile may also comprise a non-thermoplastic yarn. In some embodiments, the thermoplastic textile may be applied to the shoe upper of the soccer shoe, for example, by pressure and heat.

A woven fabric whose wefts and/or warps are thermoplastic are other embodiments of a thermoplastic textile. Different yarns may be used in the weft direction and the warp direction of the thermoplastic woven fabric, so as to achieve different properties, such as stretchability, in the weft direction and the warp direction.

A spacer weft-knitted fabric or spacer warp-knitted fabric made from thermoplastic material are other embodiments of a thermoplastic textile. In this regard, only one layer may be thermoplastic, for example, so as to be attached to the shoe upper of the soccer shoe. Alternatively, both layers are thermoplastic, for example, in order to connect the sole to the shoe upper.

A thermoplastic weft-knitted fabric or warp-knitted fabric may be manufactured using the manufacturing techniques for knitwear described in the section "knitwear".

A thermoplastic textile may be connected with the surface to be reinforced only partially subject to pressure and heat so that only certain areas or only a certain area of the thermoplastic textile connects to the surface. Other areas or another area do not connect, so that the permeability for air and/or humidity is maintained there, for example. The function and/or the design of e.g. the shoe upper of the soccer shoe may be modified by this.

Soccer Shoe

Figure 9A:
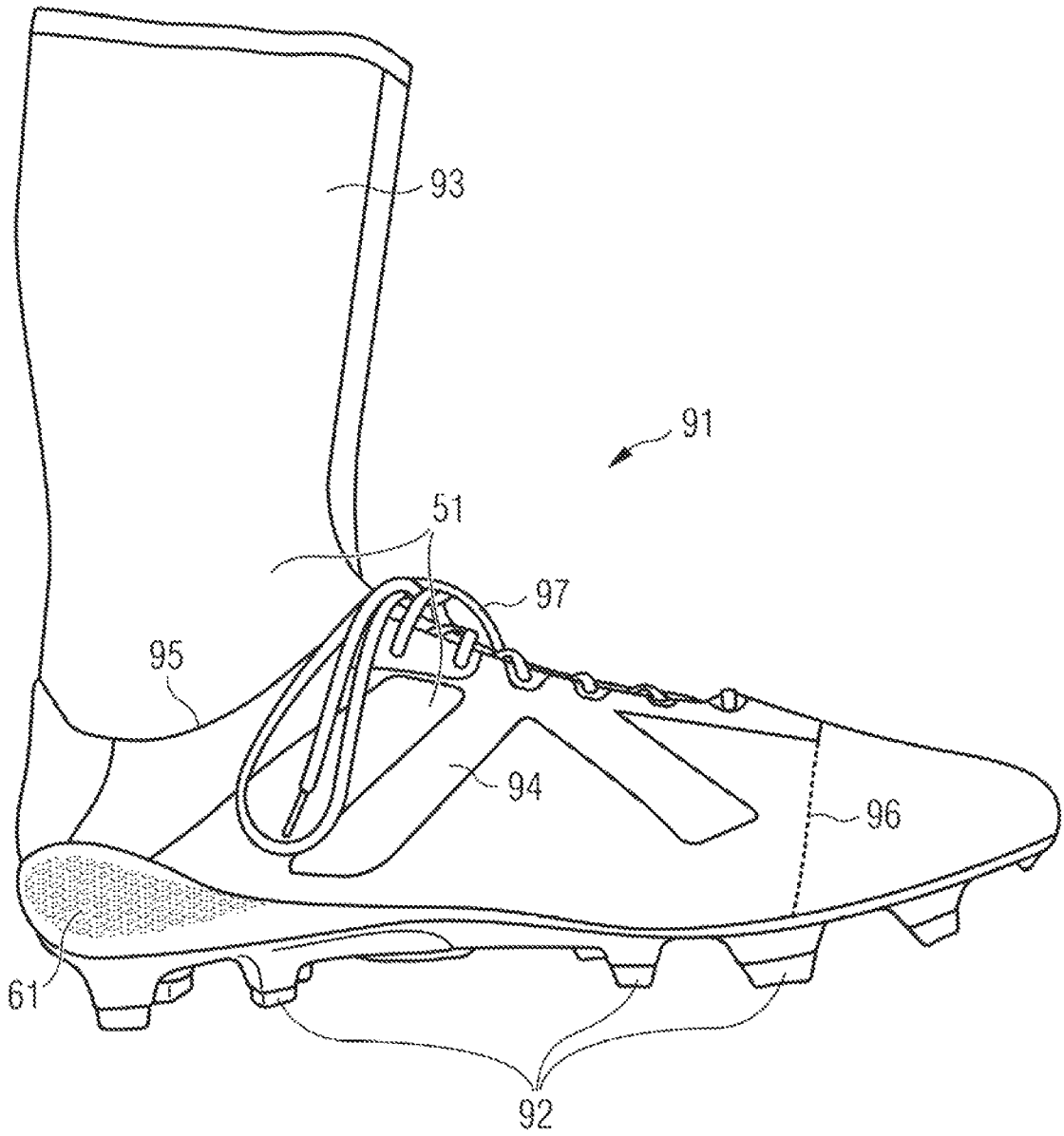
FIG. 9*a* is a medial view of a soccer shoe, according to certain embodiments of the present invention.
Figure 9B:
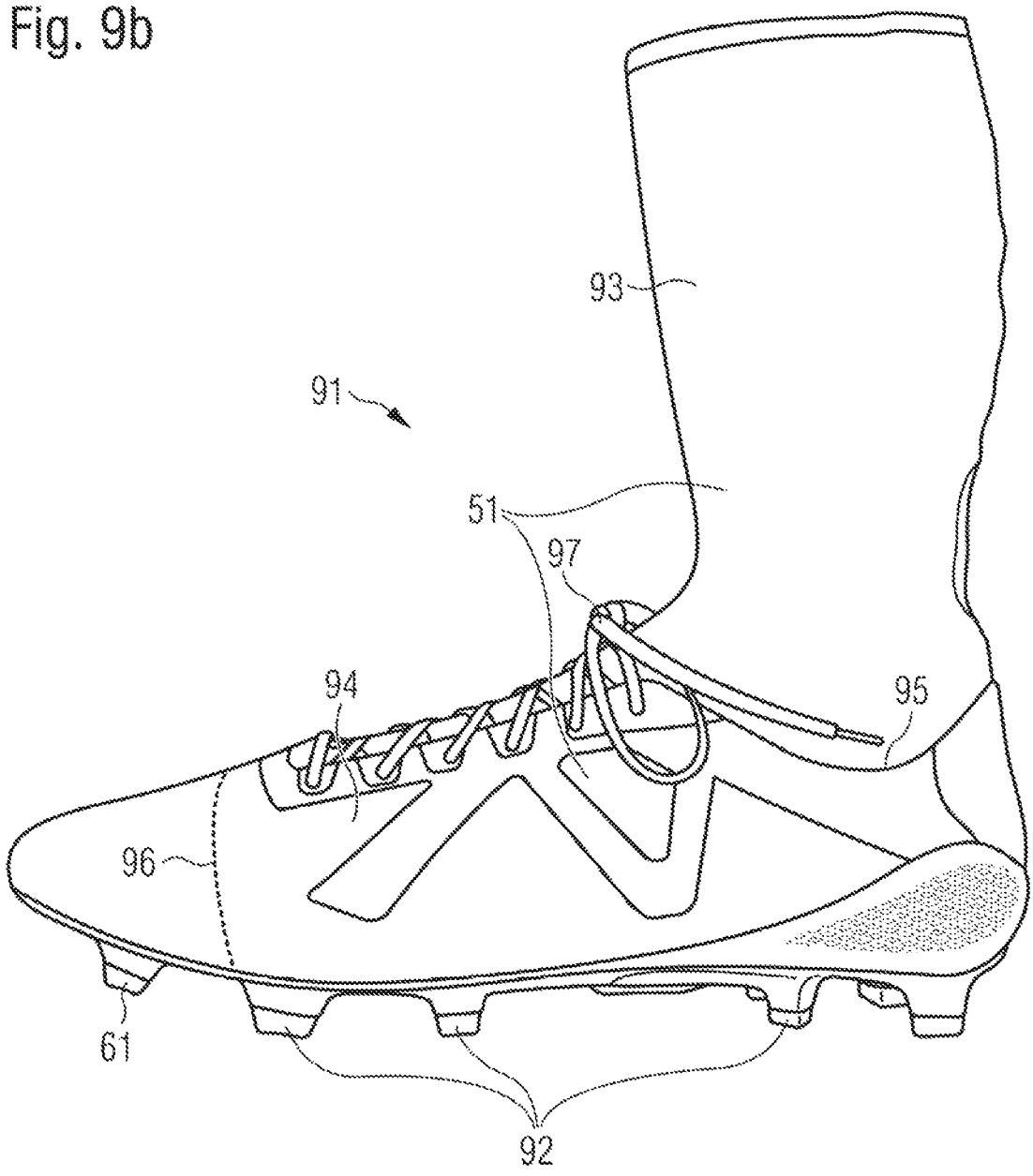
FIG. 9*b* is a lateral view of the soccer shoe of FIG. 9*a*.
Figure 10:
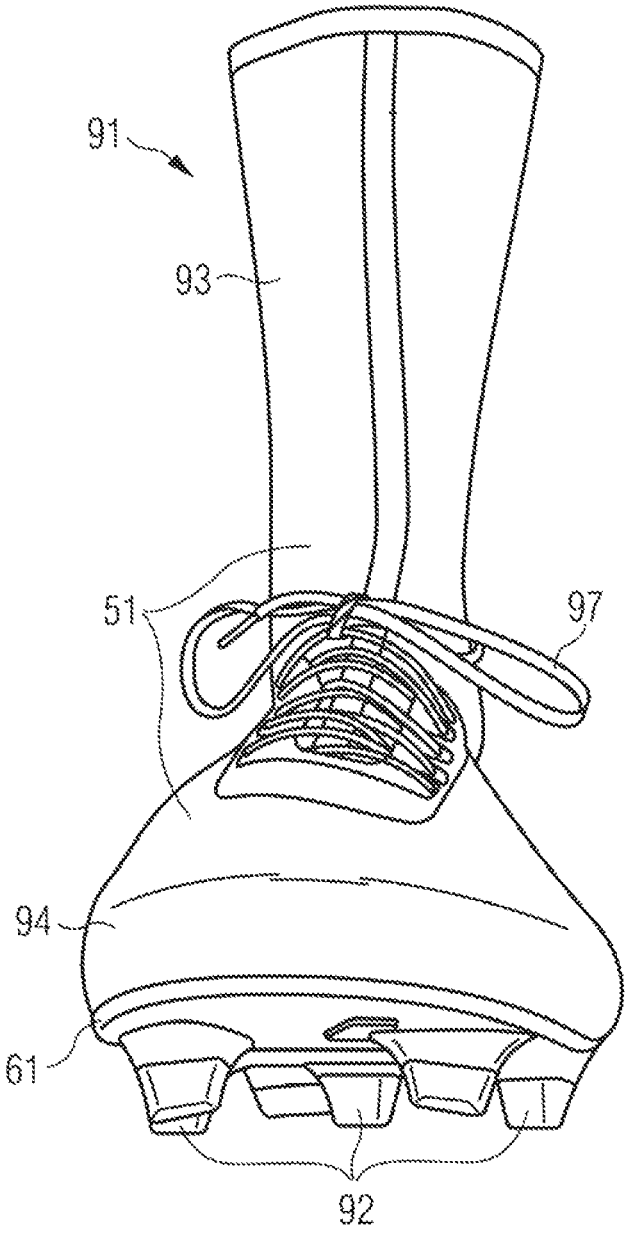
FIG. 10 is a front view of the soccer shoe of FIG. 9*a*.

FIGS. 9*a*, 9*b*, and 10 illustrate certain embodiments of a soccer shoe 91 from different perspectives. FIG. 9*a* shows the medial side, and FIG. 9*b* shows the lateral side of the soccer shoe 91. FIG. 10 is a front view of the soccer shoe 91.

The soccer shoe 91 shown in FIGS. 9*a*, 9*b*, and 10 comprises an upper 51. The upper 51 comprises knitwear that may be weft-knitted or warp-knitted. In certain embodiments, as illustrated in FIGS. 9*a*, 9*b*, and 10, the knitwear is weft-knitted.

The soccer shoe 91 further comprises a sole 61 comprising cleats, three of which are denoted with the reference number 92. The sole 61 is connected to the knitwear of the upper 51. The sole 61 may be manufactured in any known manner. For example, the sole 61 may be manufactured via injection molding and may subsequently be connected to the knitwear of the upper 51, e.g. via gluing or welding. Alternatively, the sole 61 may be injection molded to the upper 51. In some embodiments, the sole 61 may be separately manufactured in a 3D printing process and then connected to the shoe upper 51 via gluing or welding. Alternatively, the sole 61 may be directly printed to the shoe upper in a 3D printing process. Materials used to form the sole 61 include but are not limited to TPU, PU, polyamide, rubber, EVA, or combination thereof.

The knitwear of the upper 51 is capable of coupling the sole 61 to a foot of a wearer while wearing the soccer shoe 91, i.e. the knitwear is substantially (more than 50% of the required forces) responsible for positioning the sole 61 under the foot of the wearer and holding it in position. In the shown exemplary embodiments, this coupling is caused by the knitwear of the upper 51 firmly enclosing the foot of the wearer (not shown in the figures) and thereby holding the sole 61 in its position. Also, the stretchability of the knitwear of the upper 51 adds to the firm coupling of the sole 61 to the foot by tightly enclosing the foot.

Cleats are understood as any type of bump on the sole that is capable of increasing the traction of the sole with the ground, for example grass. For example, the cleats and the sole may be a single integrally-formed piece, i.e. the cleats are formed out of the sole. Alternatively, the cleats may have threads and may be screwed into the sole. The cleats may have the form of knobs or knolls and may round, oval, elongated, or any other suitable shape. Further possible forms include but are not limited to pyramid, cone, or truncated cone.

In the shown embodiments, the knitwear of the upper 51 is capable of extending above an ankle of the wearer of the soccer shoe 91 during wear and, thereby, creates a good coupling of the sole 61 to the foot. In general, the upper 51 may comprise such a height that the upper edge of the upper 51 overlaps a section of a shin guard (not shown in the figures) of a wearer when wearing the soccer shoe 91.

The upper 51 may also comprise a coupling mechanism to connect the upper to the shin guard or to a soccer sock (not shown in the figures). This could, for example, be a hook-and-loop fastener. Alternatively or additionally, a good coupling to a shin guard or sock may also be achieved by compression of the knitwear, i.e. the knitwear exerts sufficient pressure on the shin guard or the sock to avoid or at least reduce slipping of the shin guard or sock relative to the knitwear. In this way, a smooth transition between the knitwear and the shin guard may be achieved. The knitwear may be configured to extend to a knee of a wearer.

In alternative embodiments of the invention (not shown in the figures), the shoe upper may comprise a pocket or channel for the shin guard. The pocket or channel may, for example, be weft-knitted or warp-knitted in the knitwear of the shoe upper as a single piece. Alternatively, the pocket or the channel may be made from a different material and may be sewn, glued, or welded to the shoe upper. Further pockets or channels may be arranged on the shoe upper to fix, for example, elements such as electronic elements, protection elements, paddings, thermal elements (e.g. cool or heat packs) to the shoe upper. Further, in embodiments of the present invention, yarns, support structures, and/or weft-knit or warp-knit structures, respectively, may be combined, such that the protection areas are formed. For example, a shock-absorbing area may be formed in the shoe upper 51 protecting the shin.

In alternative embodiments of the invention (not shown in the figures), the knitwear of the upper 51 may extend below an ankle or may extend to an ankle. In these embodiments, the knitwear provides the function of coupling the sole 61 to the foot.

In certain embodiments, as illustrated in FIGS. 9*a*, 9*b*, and 10, the knitwear of the upper 51 comprises two knit sections 93 and 94. As shown in FIG. 9*b*, the section 93 is an upper section enclosing the entire foot (not shown in the figures) and extends above the ankle but without enclosing a toe region. The lower section 94 encloses the entire foot including the toe region and ends below the ankle. The upper section 93 extends inside of the lower section 94 to a location just before the toe region. However, the section 94 may extend above the toe region in alternative embodiments and completely surround the toe region. Both sections are connected to each other at the transition point to the toe region with a seam 96. Furthermore, both sections are connected to each other with a seam 95 below the opening of the lower section 94. The seam 95 extends into the area of the eyelets and around each eyelet. Other positions and arrangements of seams are also possible, for example as described in the context of FIGS. 5*a* and 5*b*.

In certain exemplary embodiments, as shown in FIGS. 9*a*, 9*b*, and 10, the upper section 93 and the lower section 94 comprise the same yarn and the same kind of binding. In other embodiments, both sections differ with respect to the yarn used and/or the binding. It is also possible that one section may be weft-knitted, whereas the other section may be warp-knitted or vice versa. For example, the upper section 93 may be weft-knitted or warp-knitted in such a way that it causes a comfortable feel on the skin, whereas the lower section 94 may be weft-knitted or warp-knitted so that it provides a high friction with a soccer ball.

Instead of two sections comprising knitwear, the soccer shoe 91 according to the invention may comprise an arbitrary number of sections comprising knitwear. The soccer shoe 91, according to certain embodiments, may alternatively comprise a one-piece knitwear that was manufactured in one piece on a weft-knitting or warp-knitting machine. Additionally or alternatively, the shoe upper 91 may comprise sections of other materials, such as textile, mesh, woven fabric, fibrous web, etc.

In certain exemplary embodiments, as shown in FIGS. 9*a*, 9*b*, and 10, the knitwear of the upper 51 substantially encloses the foot of the wearer of the soccer shoe 91. However, it is also possible that the knitwear only makes up a part of the upper 51 and, thus, only encloses a part of the foot and that other parts of the upper 51 include other textiles such as woven fabrics, mesh, fibrous web, etc. The knitwear of the upper 51 is configured to couple the sole 61 to a foot of a wearer during wearing the soccer shoe 91, i.e. the knitwear is substantially (more than 50% of the required forces) responsible for positioning the sole 61 under the foot of the wearer and holding it in position.

The soccer shoe 91 shown in FIGS. 9*a*, 9*b*, and 10 may not comprise a separate tongue. As can be seen, especially in FIG. 10, the function of the tongue is fulfilled by the knitwear of the upper section 93 of the upper 51 in the area under the laces 97. The laces 97 are conducted through the eyelets in the knitwear of the lower section 94 of the upper 51.

In certain exemplary embodiments, as shown in FIGS. 9*a*, 9*b*, and 10, the laces extend substantially on the upper side of the shoe upper, i.e. the instep of the foot. It is also possible that the laces extend above the ankle. In this way, the fit of the soccer shoe is improved and less elastic knitwear may be used.

The knitwear of the upper according to the invention may be manufactured on a flat weft-knitting machine or a flat warp-knitting machine, respectively, or on a circular weft-knitting machine or a circular warp-knitting machine, respectively. Different sections of the knitwear of the upper 51 may be manufactured on different machines. For example, one section may be manufactured on a flat weft-knitting machine, whereas another section may be manufactured on a circular warp-knitting machine. The sections may subsequently be joined, as described for example in the section "functional knitwear."

The knitwear of the upper 51 according to the invention may be reinforced with a polymer coating, as described for example in the sections "polymer coating" and "thermoplastic textile for reinforcement." Such a polymer reinforcement may stiffen and/or thicken the knitwear. Furthermore, the polymer reinforcement may increase the friction of the knitwear with a soccer ball. TPU may, for example, be used as polymer coating.

Reinforcements may also be directly injection molded to the shoe upper, e.g. to the knitwear. For example, a heel counter may be directly injection molded to the shoe upper. Alternatively, a reinforcement may be applied, for example glued, to the shoe upper externally. Further alternatively, a reinforcement may be arranged, e.g. glued, to the inner side of the shoe upper.

Figure 11:
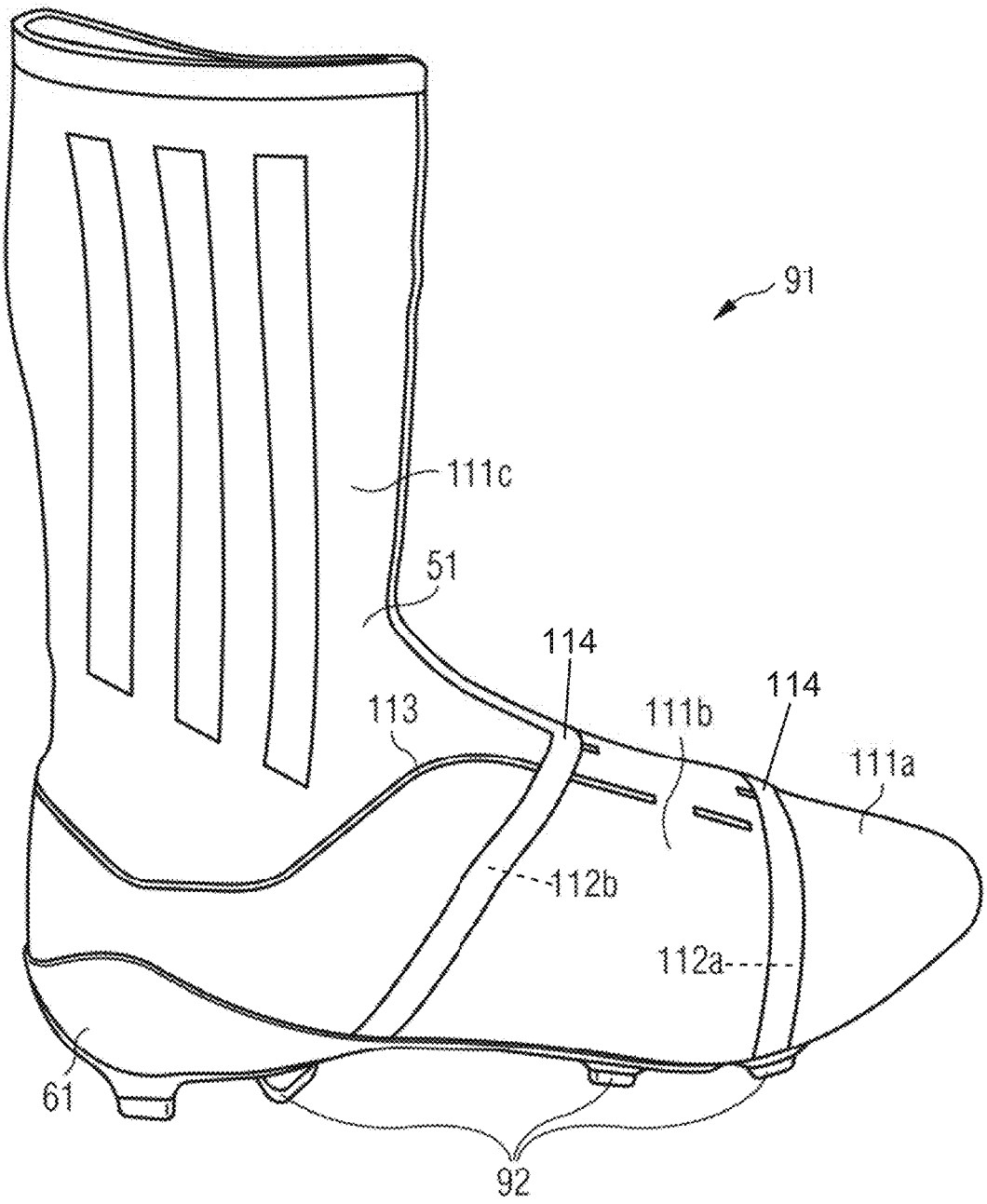
FIG. 11 is a lateral view of a soccer shoe, according to certain embodiments of the present invention.
Figure 12:
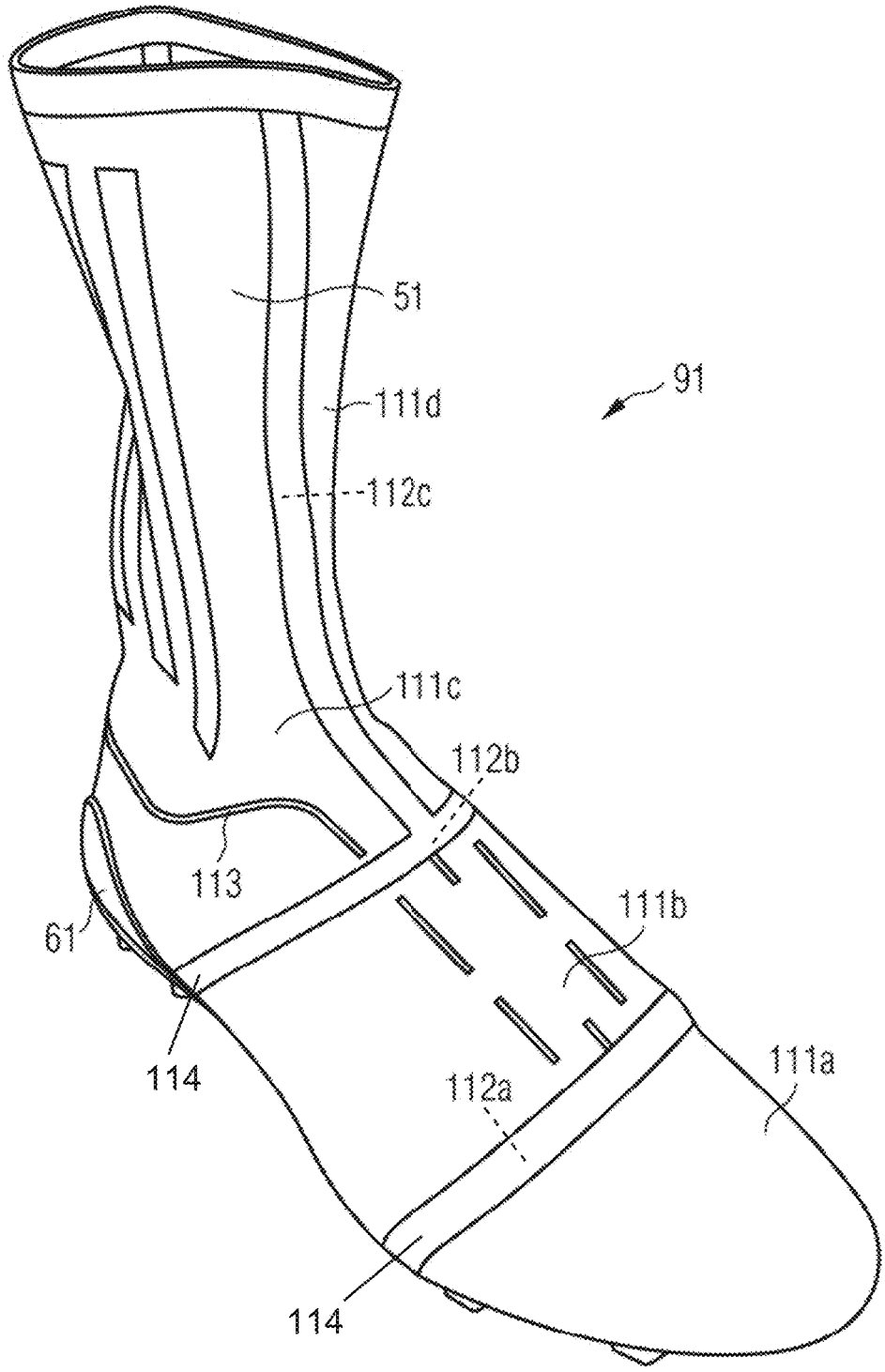
FIG. 12 is a perspective view of the soccer shoe of FIG. 11.
Figure 13:
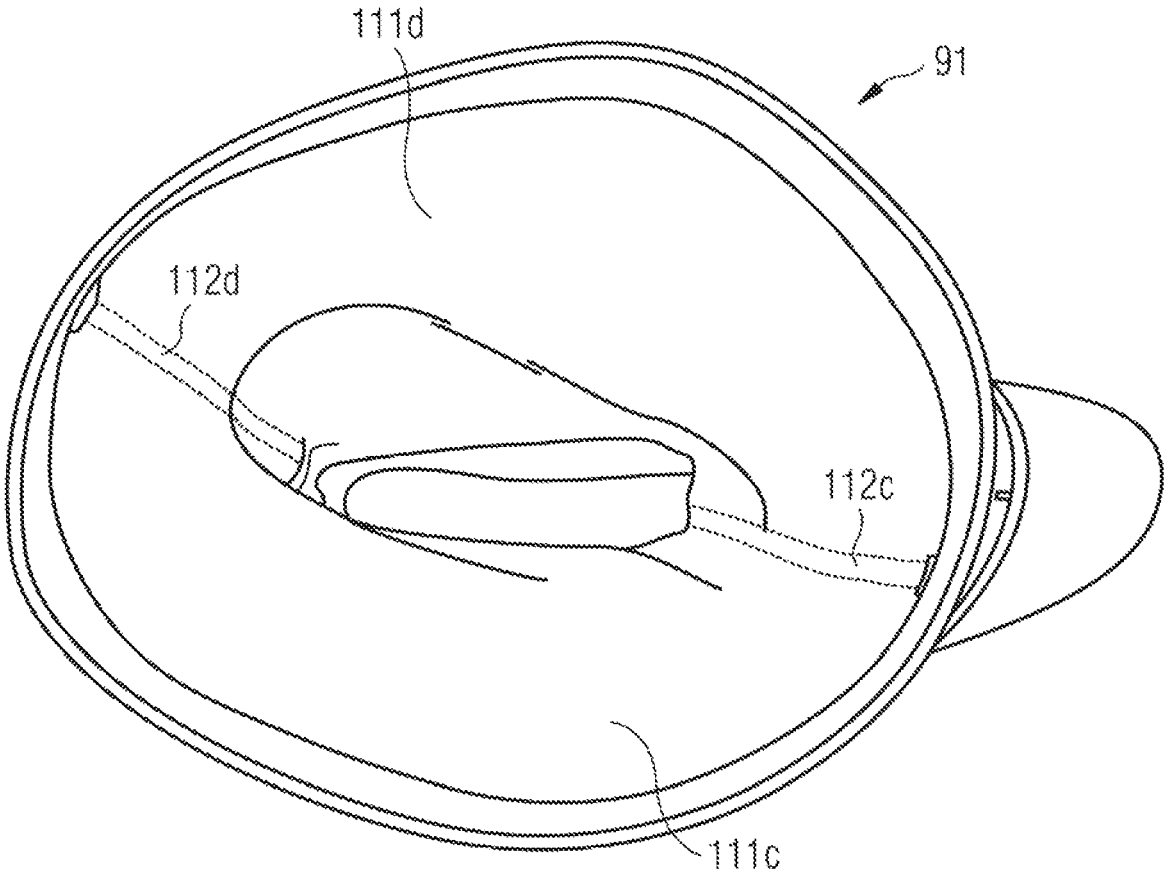
FIG. 13 is a top view of the soccer shoe of FIG. 11.

In FIGS. 11, 12 and 13, further embodiments of a soccer shoe 91 according to the invention are shown. For these embodiments, the description with respect to the embodiments above is similarly applicable to the embodiments of FIGS. 11, 12, and 13. The essential difference between the embodiments is that the embodiments of the soccer shoe shown in FIGS. 11, 12 and 13 does not comprise a fastening element, in particular no laces. In these embodiments, the use of knitwear allows a soccer shoe to be manufactured that fits the foot in a way that allows a fastening element to be omitted.

The knitwear of the soccer shoe 91 shown in FIGS. 11, 12, and 13 may be manufactured from four sections 111*a*, 111*b*, 111*c* and 111*d*. Section 111*a* is arranged above the toe region. Section 111*b* is arranged above the metatarsal area. Section 111*c* extends from the metatarsal area on the lateral side of the soccer shoe 91 to a location above the ankle. Section 111*d* extends from the metatarsal area on the medial side of the soccer shoe 91 to a location above the ankle.

The four sections are joined by corresponding seams 112*a*, 112*b*, 112*c* and 112*d*. Seam 112*a* connects the toe region 111*a* to the metatarsal section 111*b*. Seam 112*b* connects the metatarsal section 111*b* to the lateral section 111*c* and to the medial section 111*d*. Seam 112*c* connects the lateral section 111*c* to the medial section 111*d* on the front side of the soccer shoe 91. Seam 112*d* connects the lateral section 111*c* to the medial section 111*d* on the rear side of the soccer shoe 91.

In some embodiments, a strap 114 is glued over the seams 112 *a*, 112 *b*, 112 *c* and 112 *d* on the outer side of the upper 51. This design decreases or avoids a chance that a football is deflected when contacting one of the seams in an undesirable way.

Instead of sewing sections of the shoe upper together, these sections may also be glued or welded (under heat or with ultrasound). Combinations of different connection techniques are possible. Basically, a different number and/or arrangement of sections of knitwear and corresponding joining seams is possible.

The knitwear of the soccer shoe shown in FIGS. 11, 12, and 13 is double layered, i.e. it comprises two layers as described in the section "knitwear." In some embodiments, the inner layer of the knitwear extends over the entire shoe upper. However, in further embodiments, the inner layer may only extend over a part of the shoe upper. The knitwear is substantially (i.e. with more than 50% of the required forces) responsible for positioning the sole under the foot of the wearer and holding the sole in its position. The knitwear may further contributes 70%, 80%, or 90% of the required forces to fix the sole to the foot.

Below the weldseam shown with the reference numeral 113, a plastic reinforcement may be arranged between the outer layer and the inner layer. Such a reinforcement may be arranged on the medial side, as well as on the lateral side of the soccer shoe. It is also possible that such reinforcements are located in the toe and/or heel regions of the soccer shoe.

Basically, the upper 51 and, in particular, the knitwear may be provided with profile elements which increase the friction between a soccer ball and soccer shoe 91 and/or which allow for a better control of the ball. DE 10 2012 207 300 A1 describes, for example, a method for connecting a profile element to an upper.

Figure 14A:
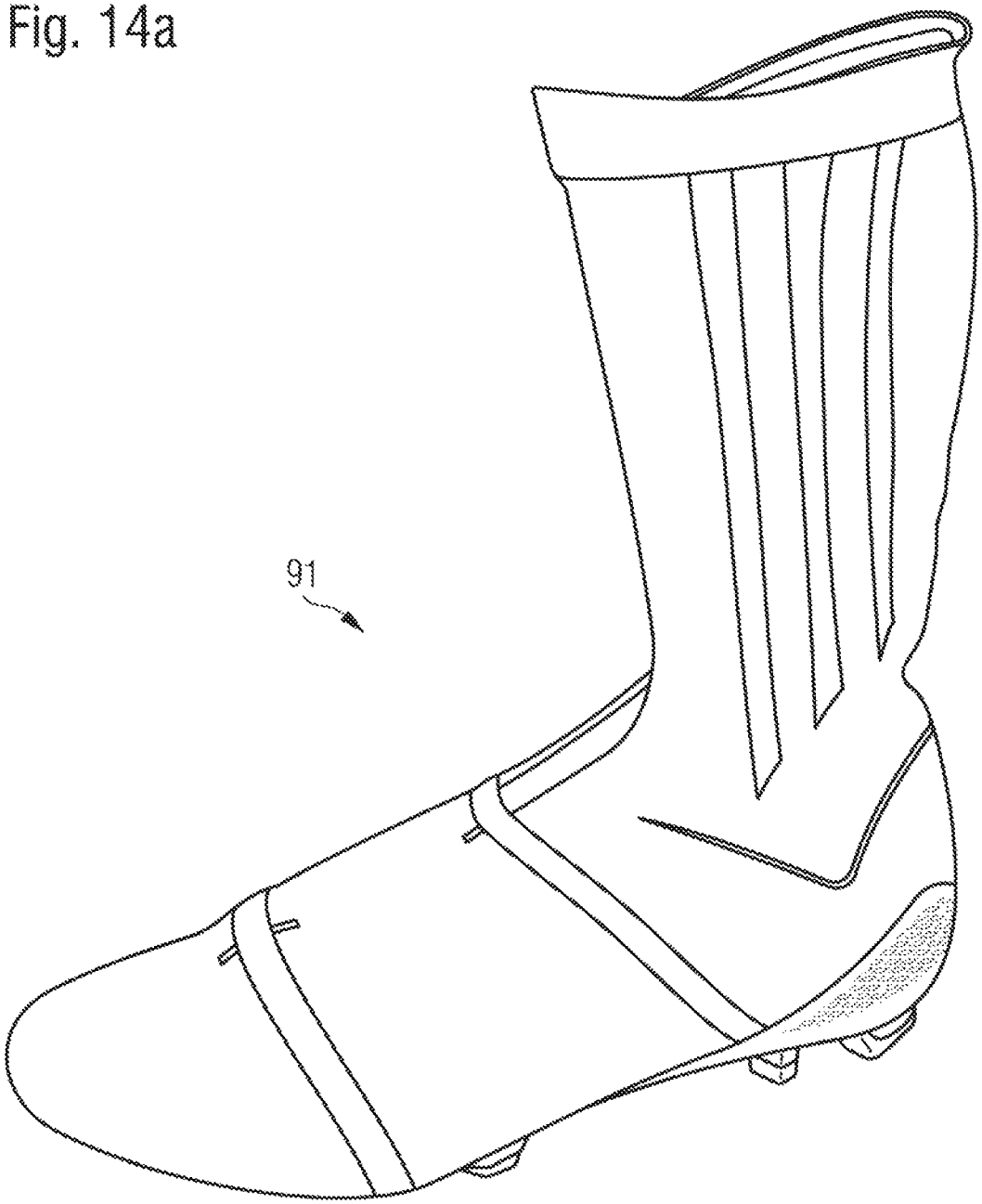
FIGS. 14*a*-14*b* are lateral and medial views, respectively, of a soccer shoe, according to certain embodiments of the present invention.
Figure 14B:
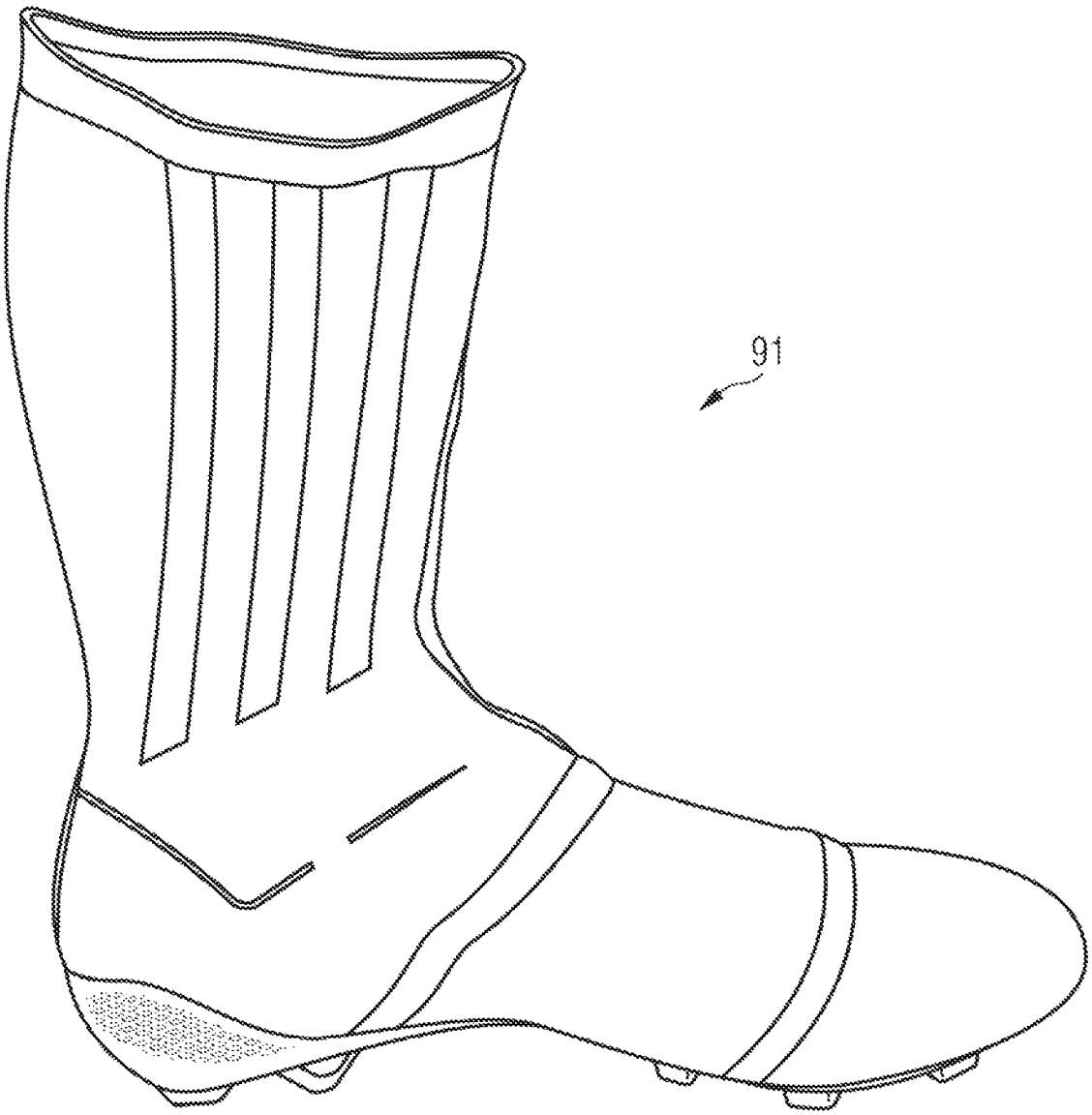
Figure 15A:
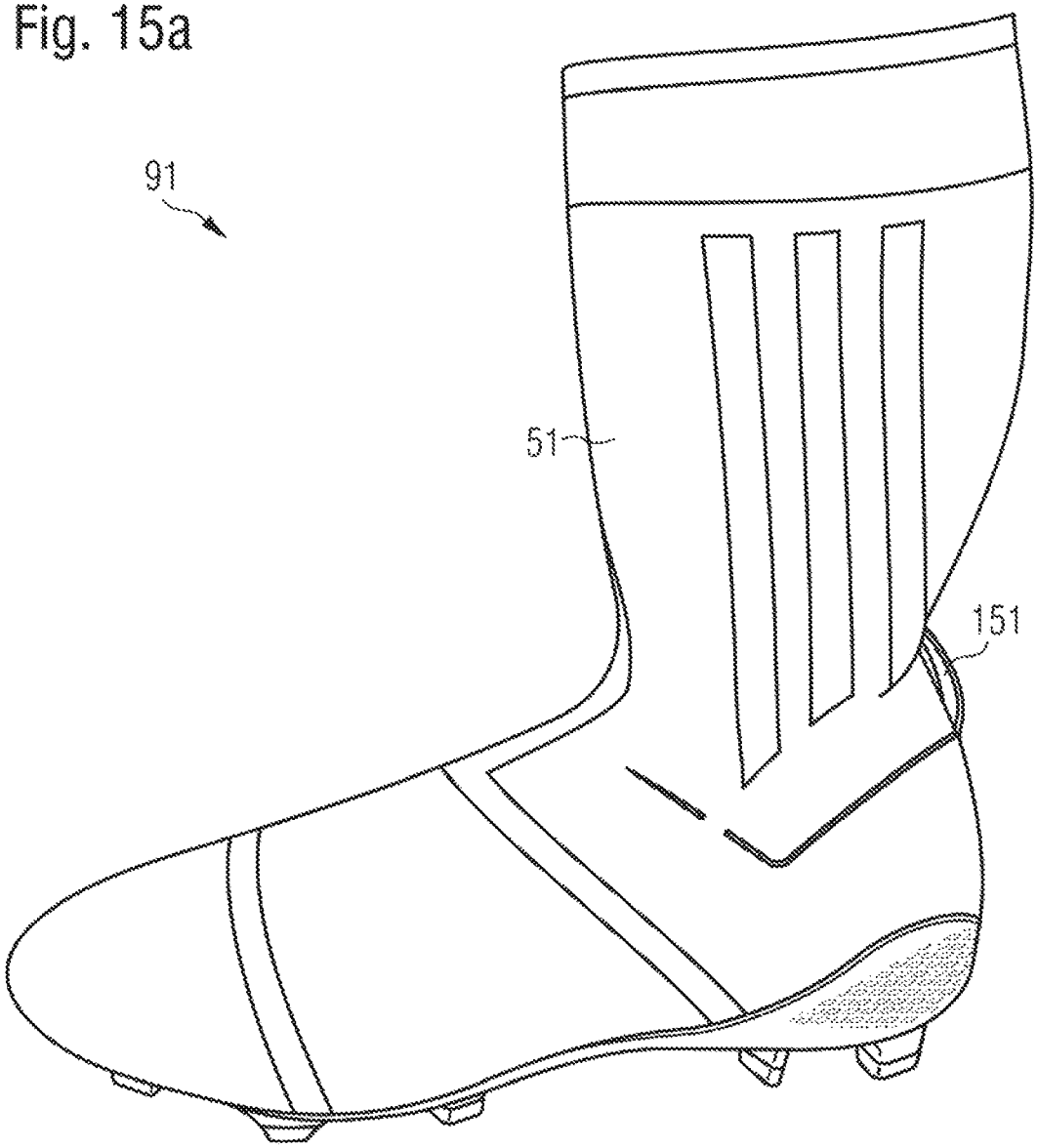
FIGS. 15*a*-15*f* are views of a soccer shoe, according to certain embodiments of the present invention.
Figure 15B:
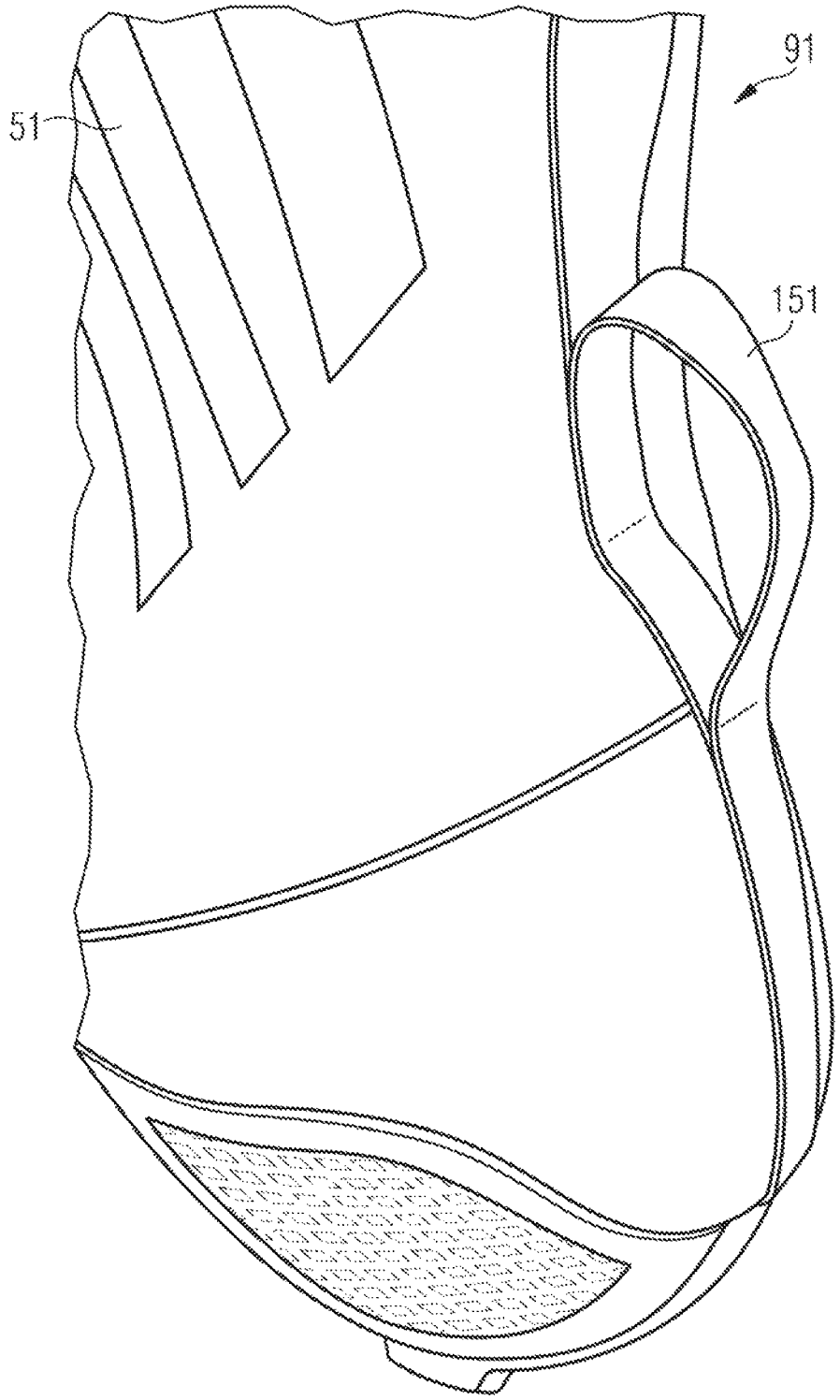
Figure 15C:
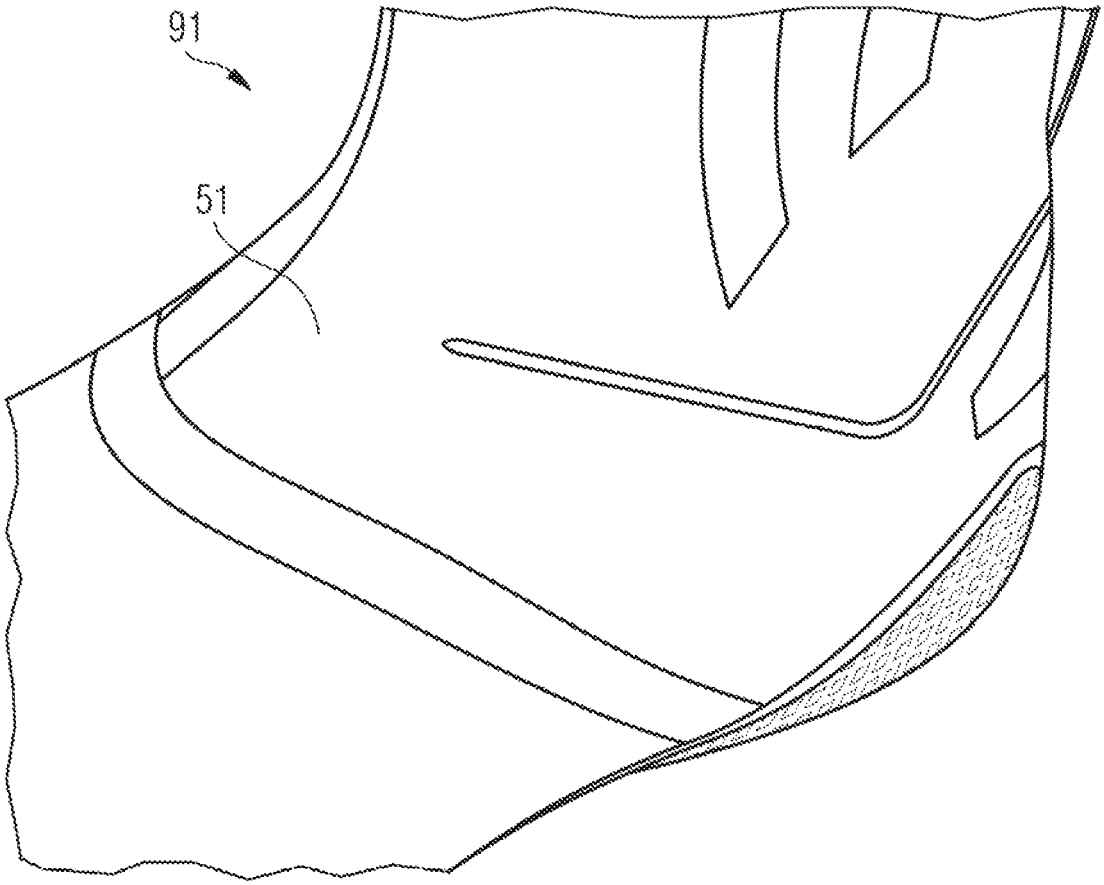
Figure 15D:
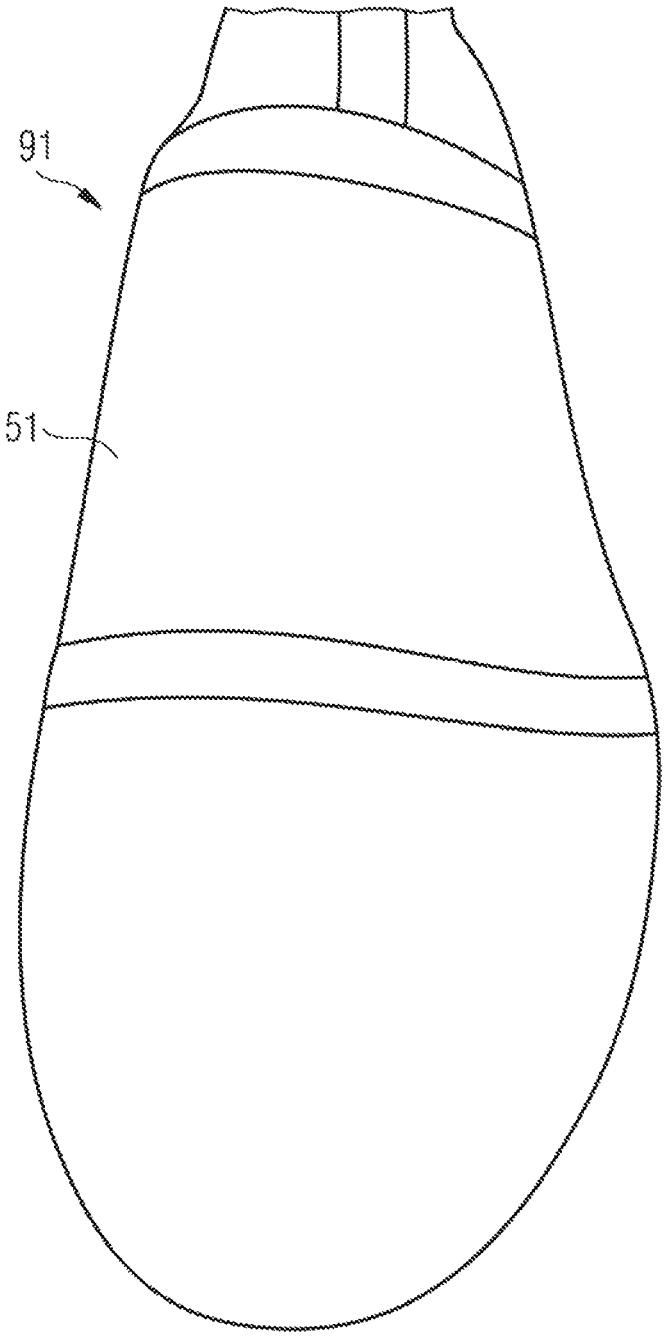
Figure 15E:
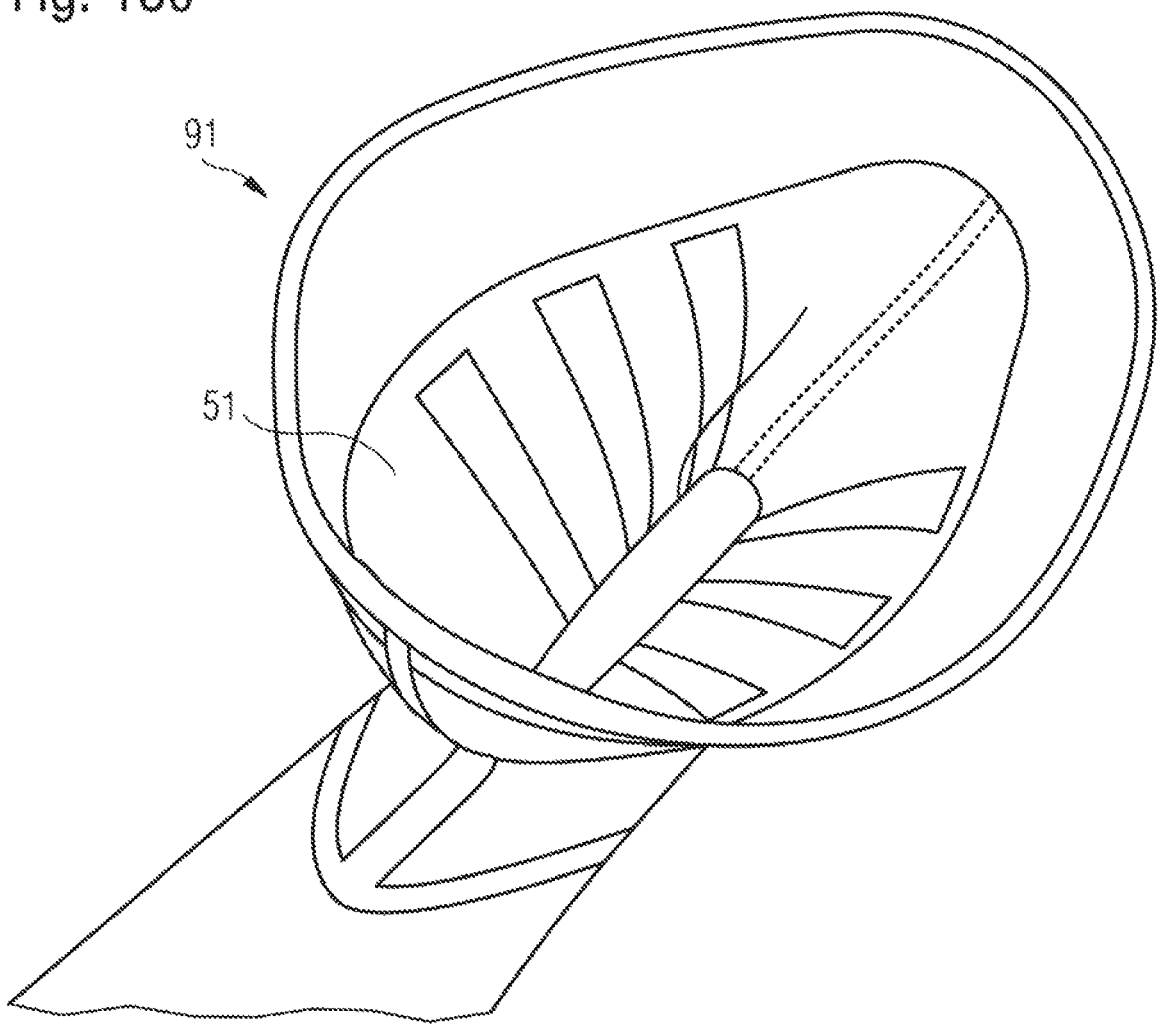
Figure 15F:
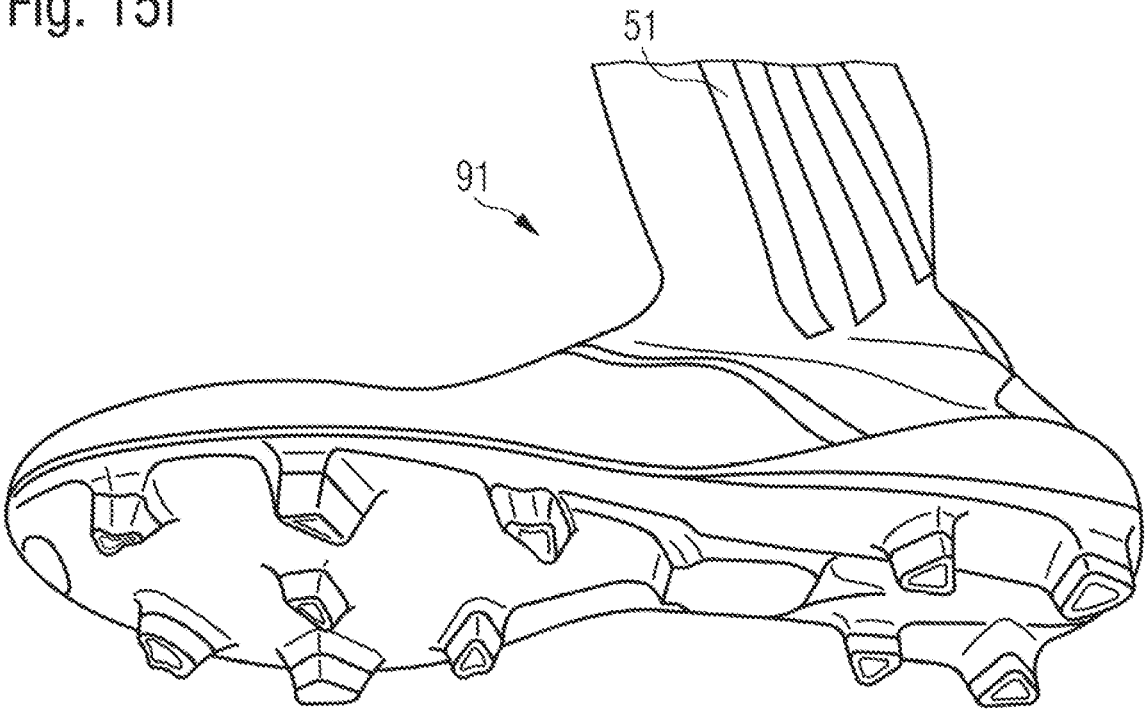

FIGS. 14*a* and 14*b* show further exemplary embodiments of the present invention. The soccer shoe 91 shown in FIGS. 14*a* and 14*b* differs from the soccer shoe shown in FIGS. 11 to 13 by a different coloring.

FIGS. 15*a* to 15*f* show still further exemplary embodiments of the present invention. The soccer shoe 91 shown in FIGS. 15*a* to 15*f* differs from the exemplary embodiments of FIGS. 11 to 13, 14*a* and 14*b* on the one hand by a different coloring, and on the other hand it comprises a loop 151 that is applied to the heel region of the shoe upper 51. Loop 151 simplifies donning and doffing of the soccer shoe 91. In the exemplary embodiments of FIGS. 15*a* to 15*f*, the loop is sewn to the heel region of the shoe upper 51. In other embodiments, the loop 151 may be alternatively or additionally glued or welded to the shoe upper 51. Also, the loop 151 may be integrally formed with the shoe upper 51, e.g. as one-piece knitwear.

FIGS. 16*a* to 16*d* show still further exemplary embodiments of a shoe with several sections. The materials in each section may be selected based on different requirements and properties, like for example stiffness, stretching, stability, waterproofness/water repellence, breathability, cushioning/padding, sensitivity, control (e.g. ball control), etc., or a combination thereof. As shown in FIGS. 16*a* to 16*d*, the sections 161, 162, and 163 may comprise materials with increased stability. For example, the materials used in sections 161, 162, and 163 may comprise a reduced stretching compared to other sections. For example, sections 164, 165, and 166 may comprise an increased stretching in comparison. As shown in FIGS. 16*a* to 16*d*, section 166 may comprise a flat knit material. Sections 164 and 165 may comprise a material that may be stretchable in four different directions ("four way stretch material"), like for example a "four way stretch mesh."

The sections of the soccer shoe 91 shown in FIGS. 16*a* to 16*d* may thus be formed according to requirements. The sections 161 in the toe region and 163 in the heel region are subject to high mechanical stress due to the rolling motion of the foot and, therefore, may be especially reinforced. The medial or lateral section 162, respectively, is especially stressed under lateral forces (e.g. during fast changes of direction) and may therefore be reinforced especially. In contrast, the sections 164, 165, and 166 may comprise a more elastic material in comparison to exert compression to the foot and to allow for a tighter fit of the soccer shoe 91. In particular, section 166 comprising knitwear causes high compression and a strong coupling of the sole 61 to a foot of a wearer of the soccer shoe 91.

Figure 16A:
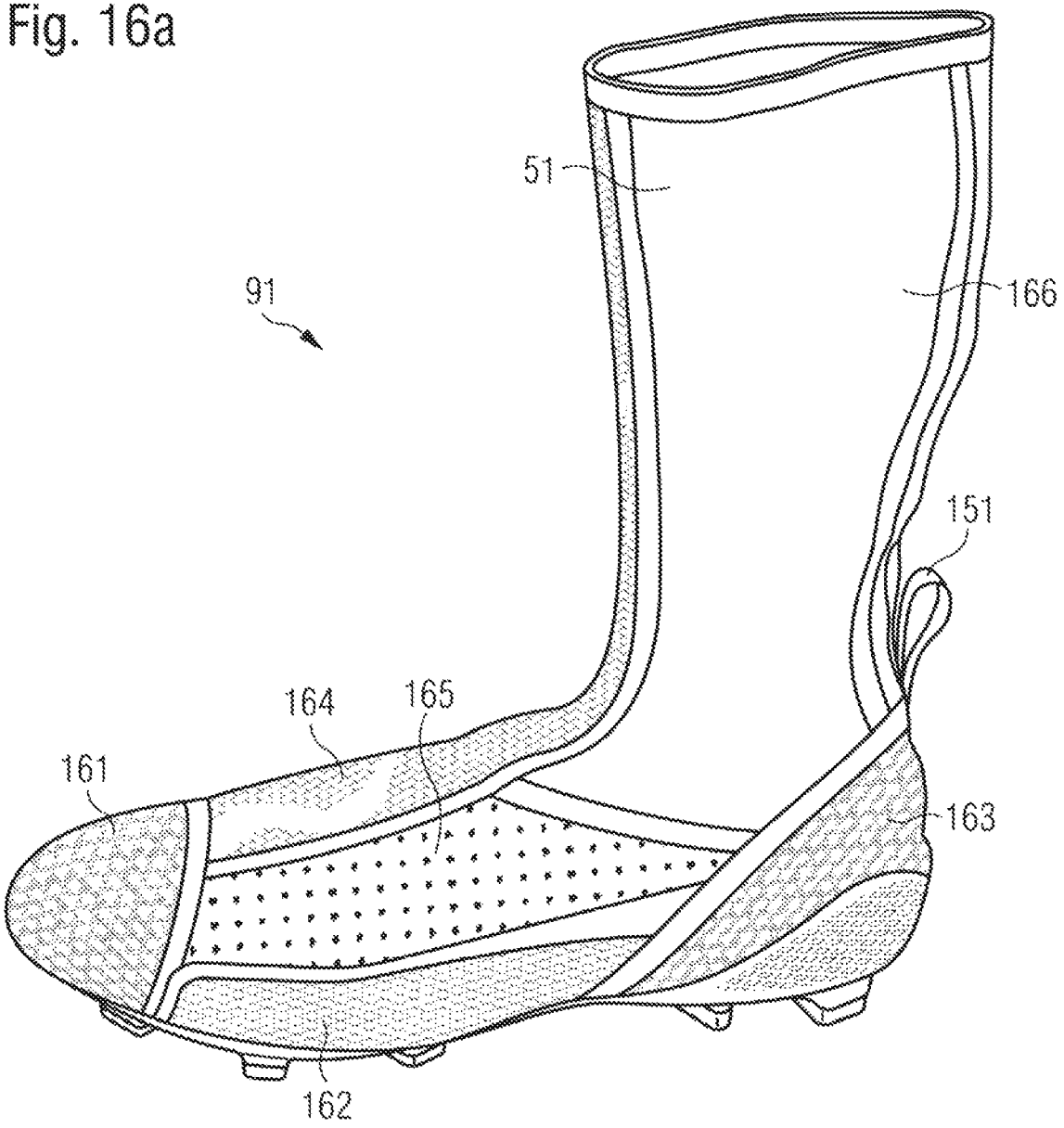
FIGS. 16*a*-16*d* are views of a soccer shoe, according to certain embodiments of the present invention.
Figure 16B:
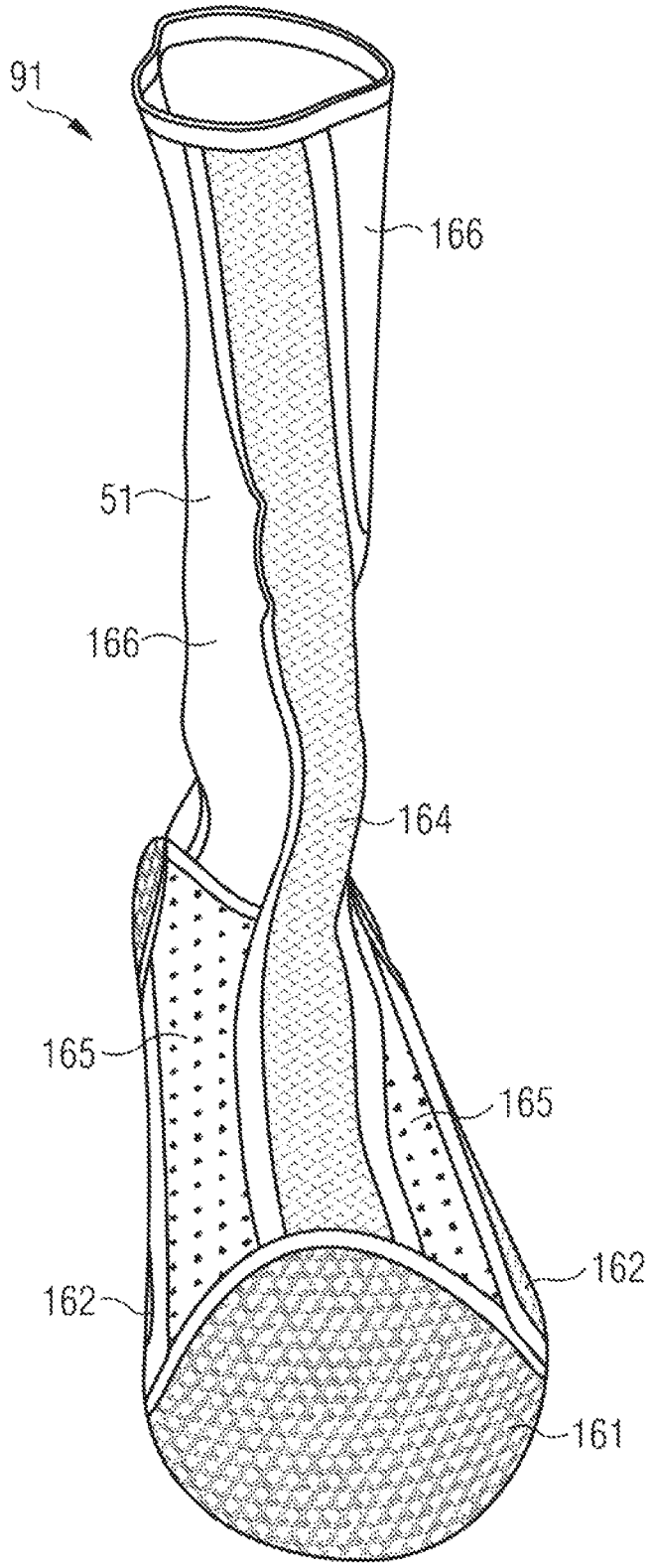
Figure 16C:
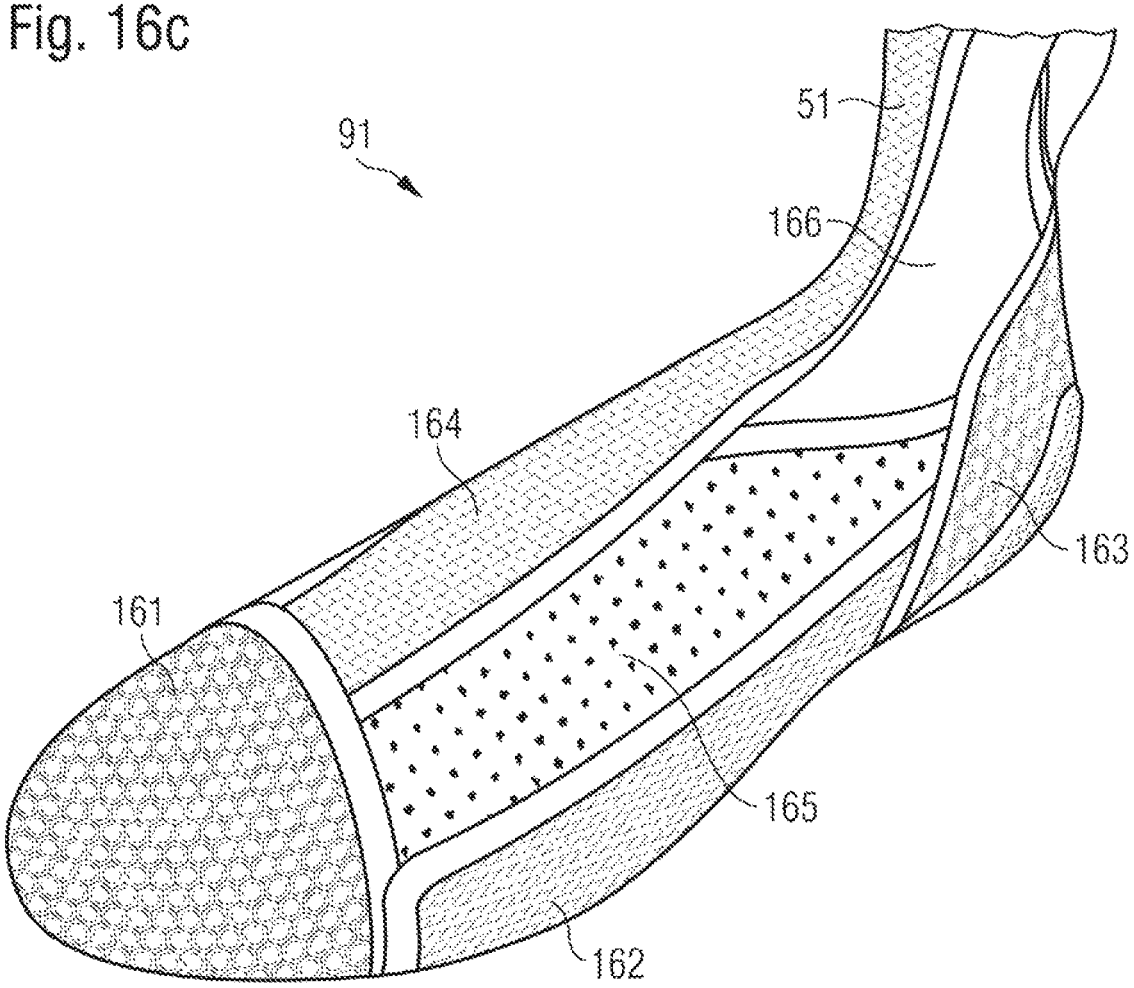
Figure 16D:
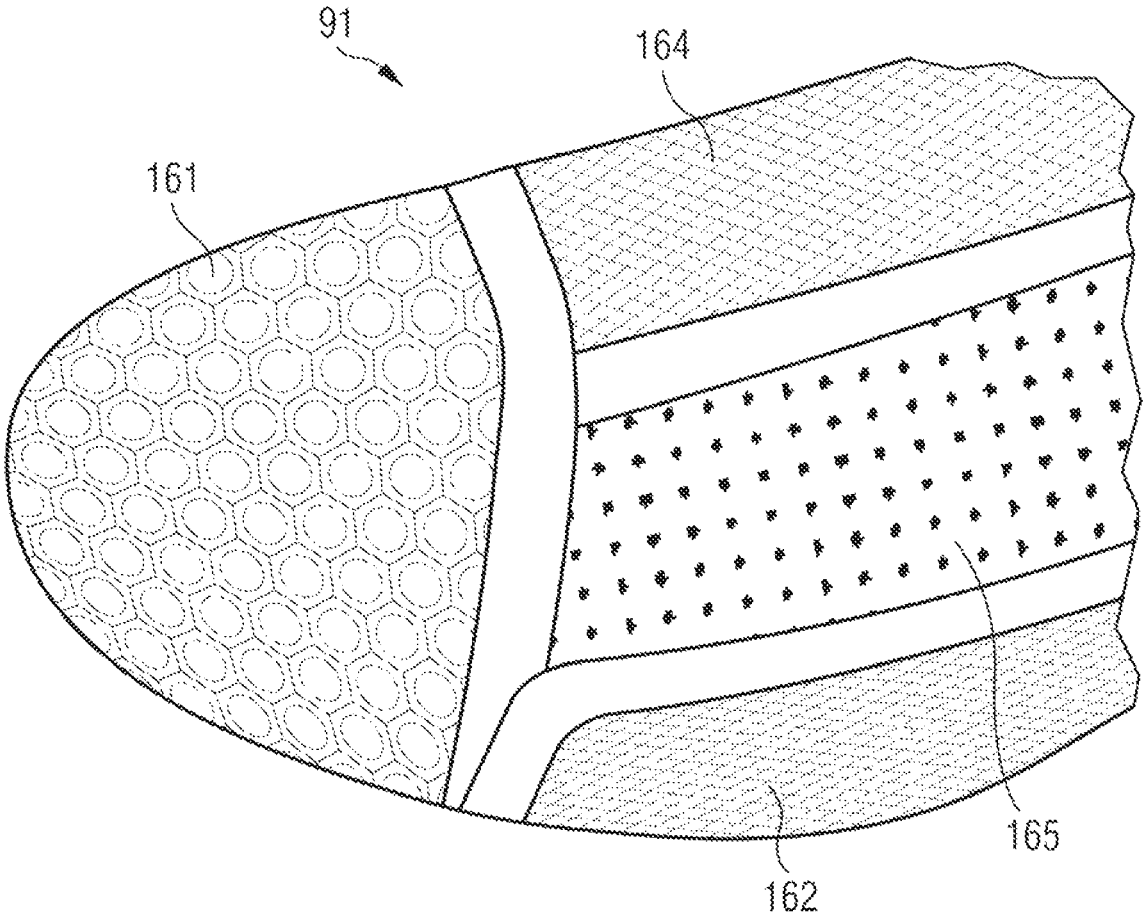

As shown in FIG. 16*a*, the soccer shoe 91 of these exemplary embodiments may additionally comprise a loop 151 in the heel region to simplify donning and doffing of the soccer shoe 91.

Figure 17A:
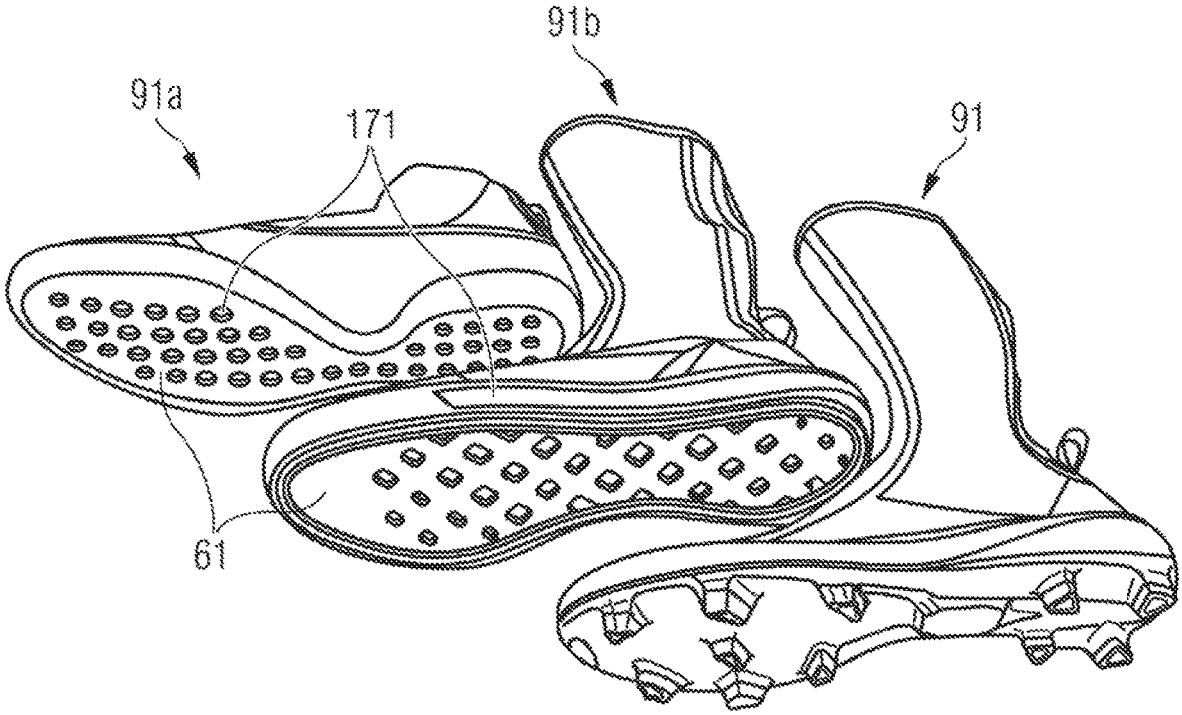
FIGS. 17*a*-17*b* are views of a soccer shoe, according to certain embodiments of the present invention.
Figure 17B:
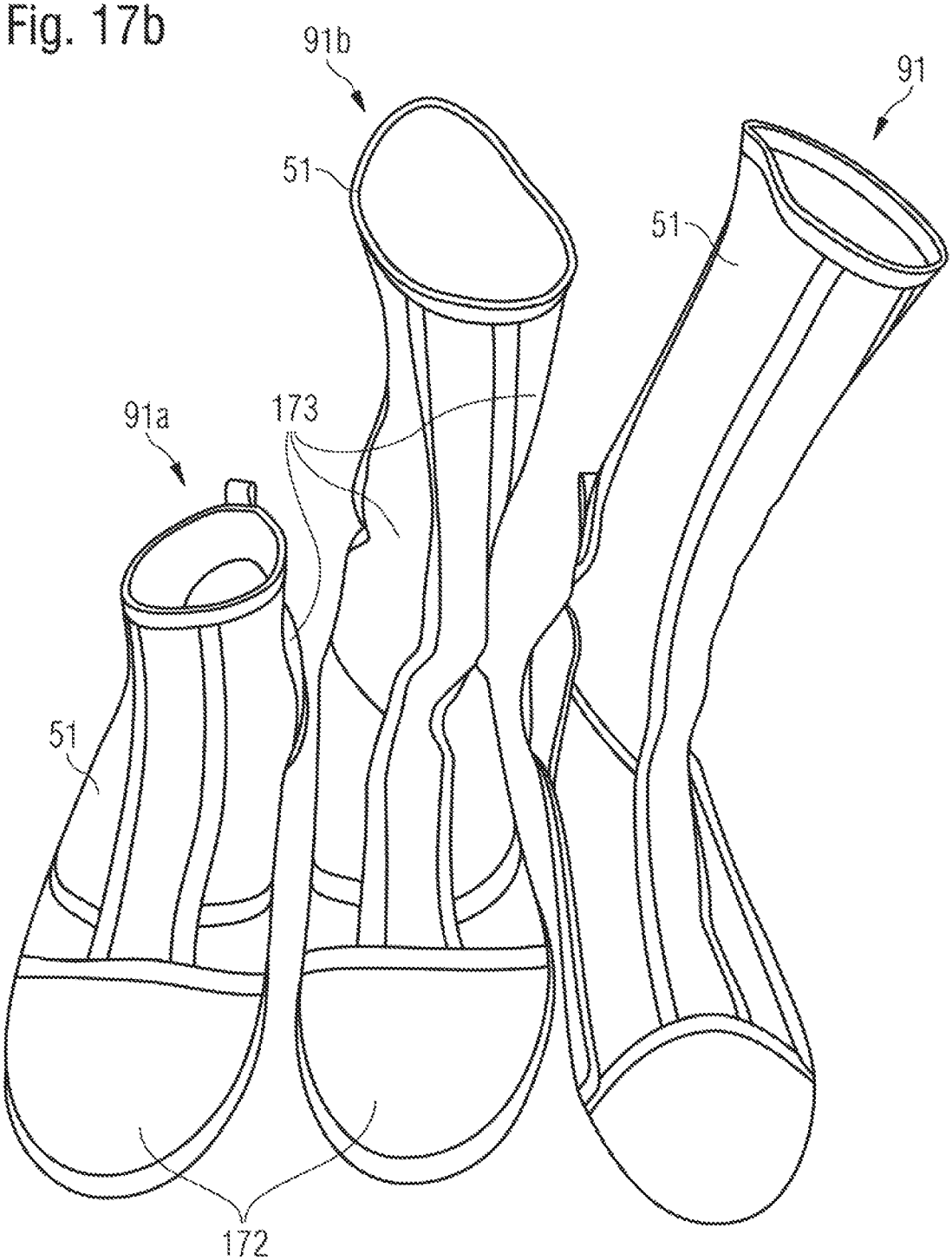

FIGS. 17*a* and 17*b* show embodiments of three soccer shoes 91, 91*a*, and 91*b*, wherein the soccer shoe 91 on the right-hand side is an exemplary embodiment of FIGS. 16*a* to 16*d*. The soccer shoe 91*a* shown on the left-hand side of FIGS. 17*a* and 17*b* and the soccer shoe 91*b* shown in the middle are soccer shoes for indoor soccer. The soccer shoes 91*a* and 91*b* each comprise a shoe upper 51 comprising knitwear to couple the soccer shoe to a foot of a wearer when wearing the shoe.

Further, the soccer shoes 91*a* and 91*b* each comprise a sole 61 comprising a grid-shaped structure to increase traction with respect the ground. In the shown exemplary embodiments of FIGS. 17*a* and 17*b*, the sole 61 of the soccer shoe 91*a* and 91*b* is made from rubber. However, other materials like EVA, TPU or polyamide may also be used.

The two soccer shoes 91*a* and 91*b* comprise a midsole 171 from eTPU. The midsole 171 is arranged above the sole 61. eTPU is especially elastic, i.e. comprises high resilience. It maintains this property over a wide temperature range compared to e.g. EVA. Furthermore, eTPU comprises a considerably reduced abrasion than ordinary midsoles compared e.g. with EVA.

Each of the shoe uppers 51 of the soccer shoes 91*a* and 91*b* comprise a section 172 in the toe region, which is made from rubber and provided with an alveolar structure to increase friction with a soccer ball. The shoe upper 51 of soccer shoes 91*a* and 91*b* furthermore comprise knitwear in sections 173, which is able to couple the soccer shoe 91*a*, 91*b* to a foot of a wearer when wearing the shoe.

The shoe uppers 51 of the soccer shoes 91, 91*a*, and 91*b* shown in FIGS. 17*a* and 17*b* may basically comprise arbitrary heights, i.e. they may extend for example to a position below or above the ankle or extend to a knee. Thus, the shoe uppers 51 of the soccer shoes 91, 91*a*, and 91*b* do not necessarily comprise the heights shown in FIGS. 17*a* and 17*b*.

Figure 18A:
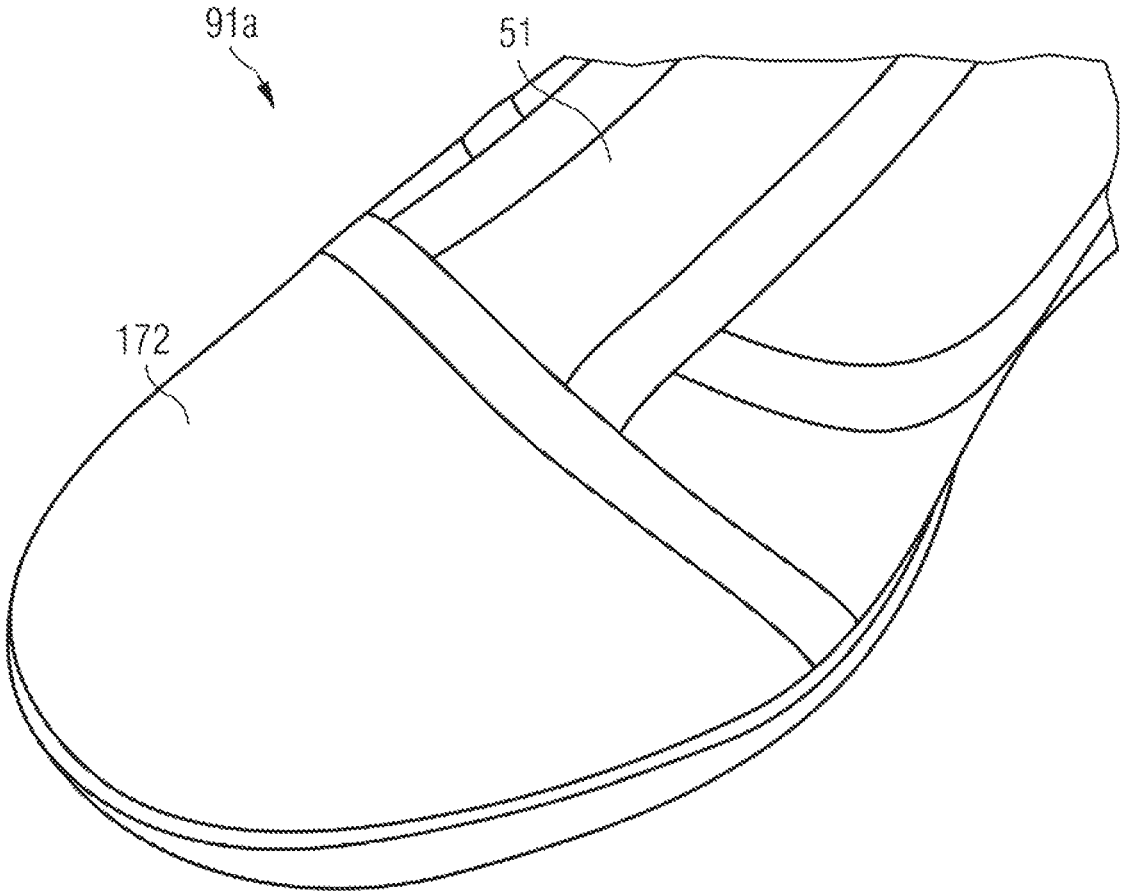
FIGS. 18*a*-18*b* are views of a soccer shoe, according to certain embodiments of the present invention.
Figure 18B:
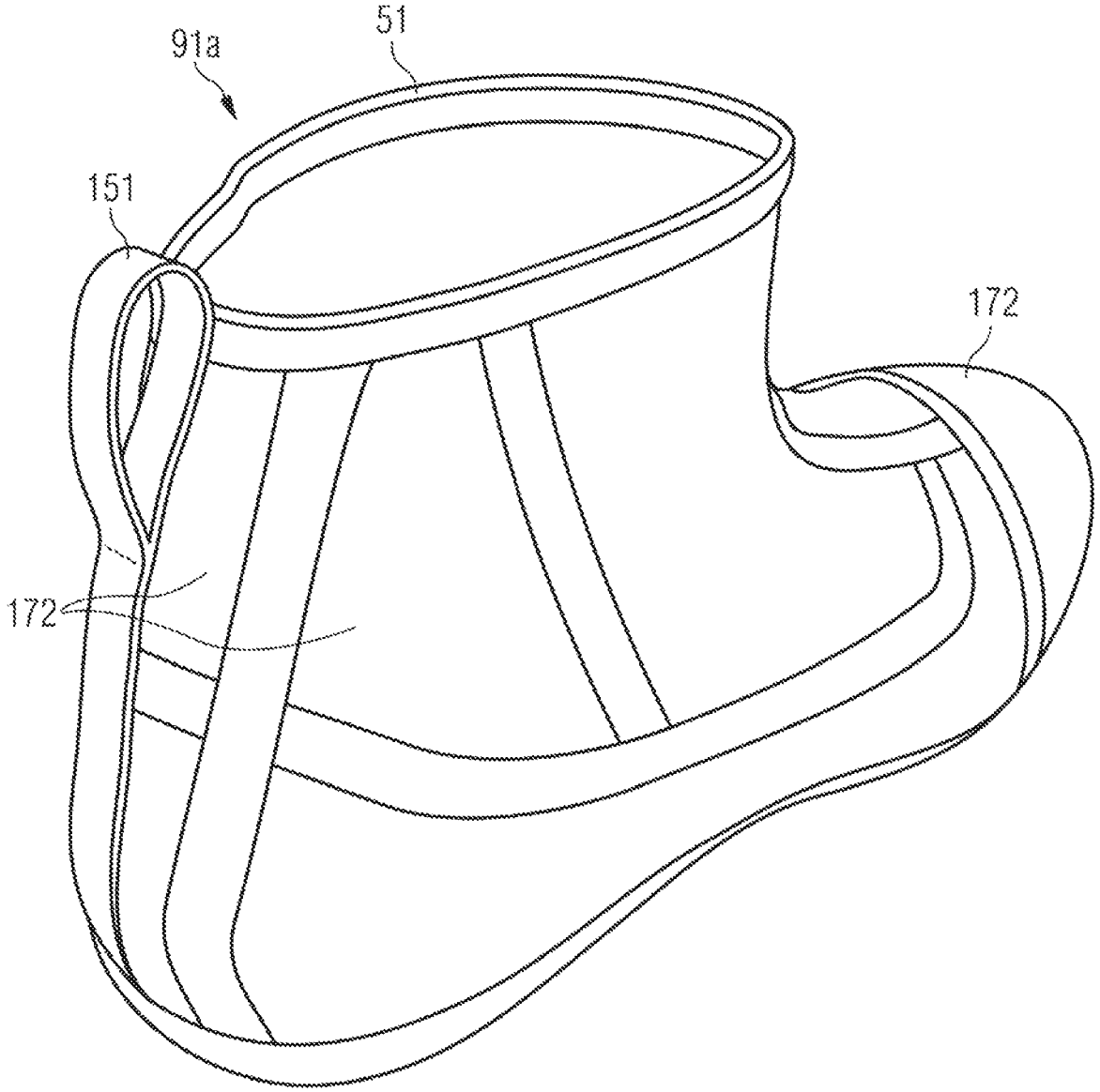

FIGS. 18*a* and 18*b* show the soccer shoe 91*a* on the left side of FIGS. 17*a* and 17*b* from a different perspective.

Figure 19A:
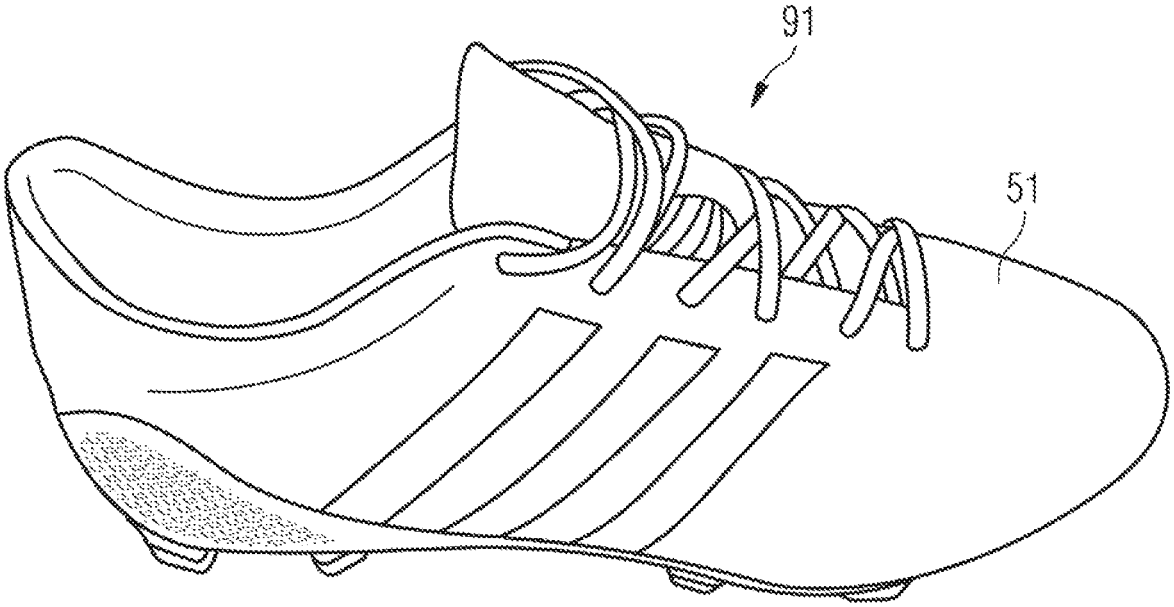
FIGS. 19*a*-19*c* are views of a soccer shoe, according to certain embodiments of the present invention.
Figure 19B:
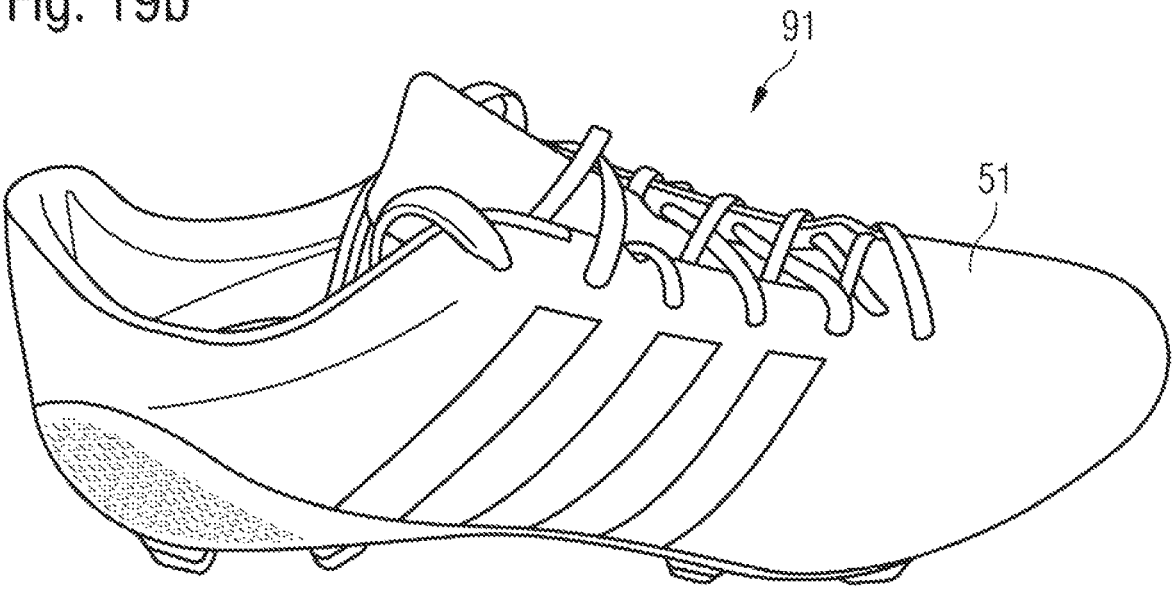
Figure 19C:
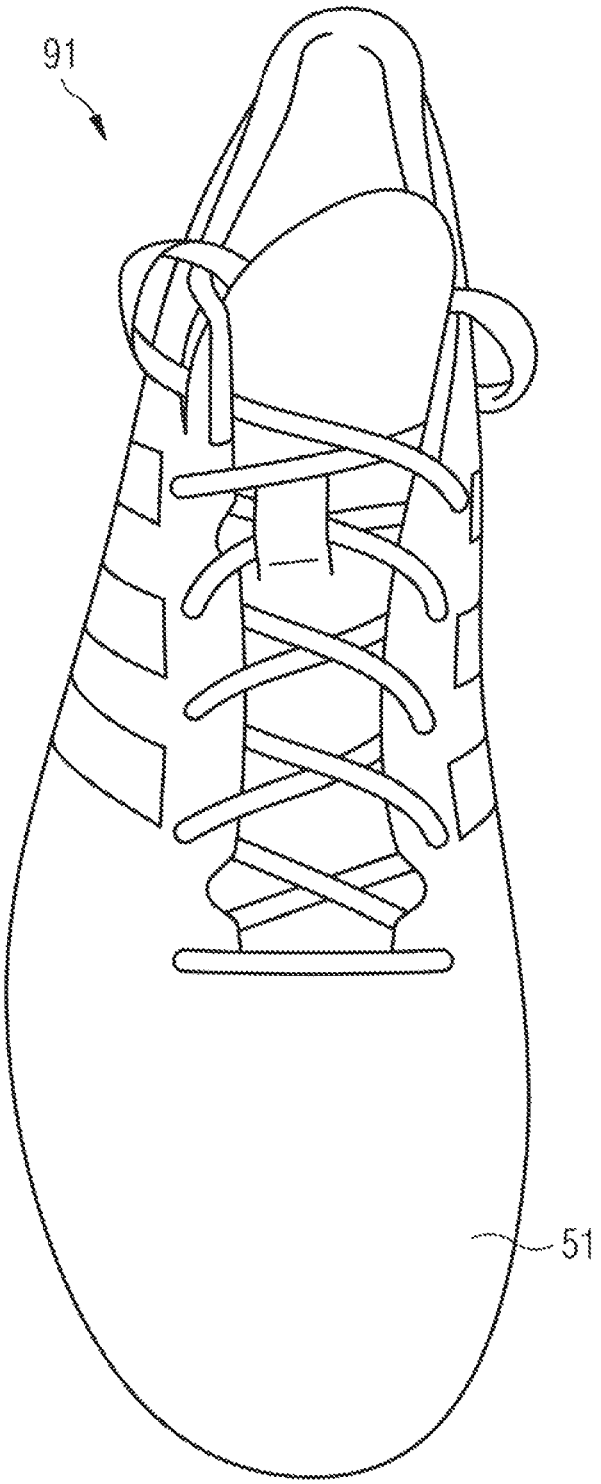

FIGS. 19*a*, 19*b*, and 19*c* show further exemplary embodiments of the present invention. The soccer shoe 91 shown in FIGS. 19*a*, 19*b*, and 19*c* differs from the exemplary embodiments shown in FIGS. 9*a*, 9*b*, and 10 in that the knitwear of the shoe upper 51 does not extend over the ankle of a foot of a wearer of the soccer shoe 91. Instead, the upper edge of the shoe upper 51 is arranged below the ankle during wearing. In other respects, the description with respect to the exemplary embodiments of FIGS. 9*a*, 9*b*, and 10 is similarly applicable to the exemplary embodiments of FIGS. 19*a*, 19*b*, and 19*c*.

Figure 20:
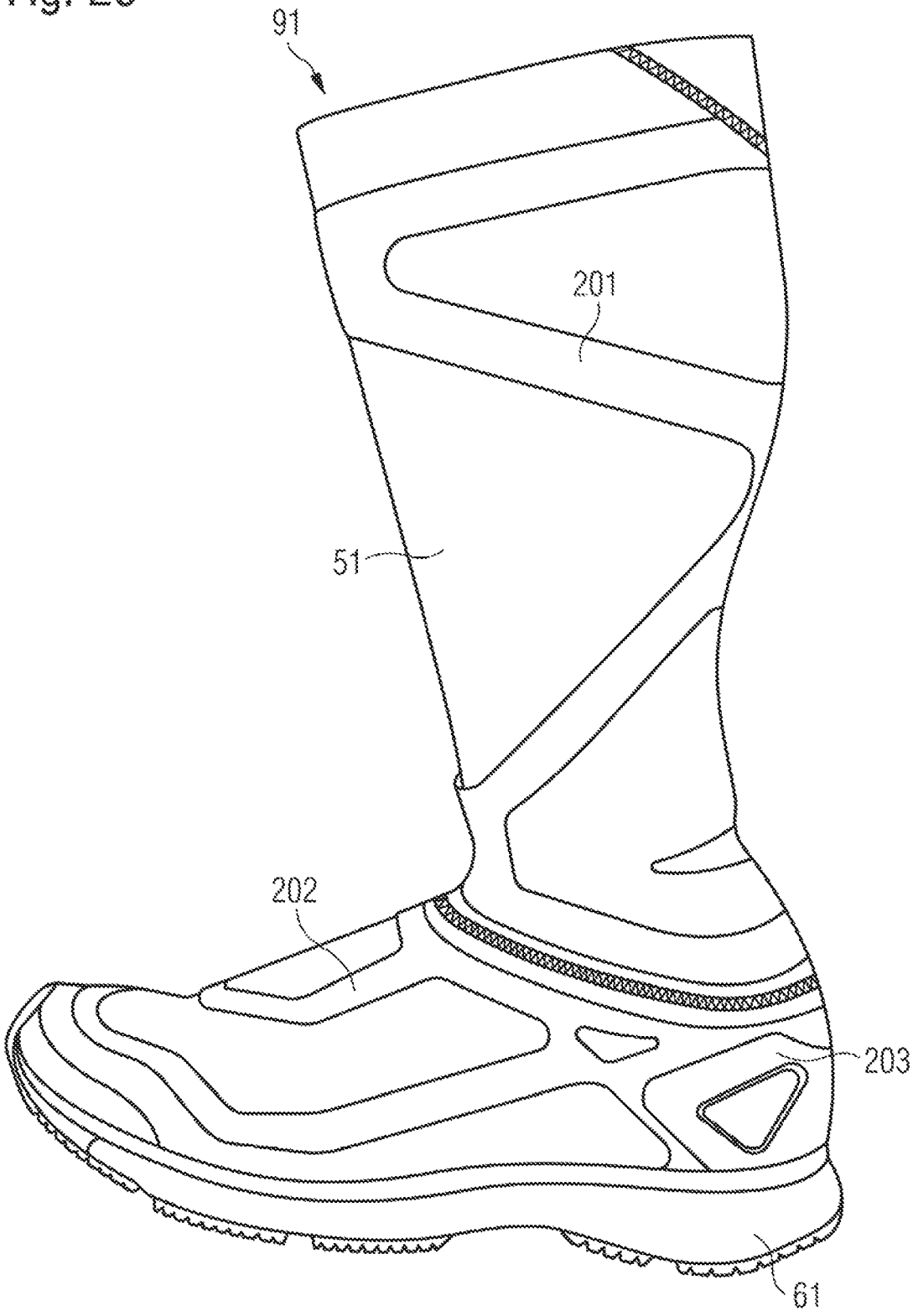
FIG. 20 is a lateral view of a soccer shoe, according to certain embodiments of the present invention.

FIG. 20 shows a soccer shoe 91 according to certain embodiments of the present invention with a shoe upper 51 and a sole 61. Straps 201 run over the shoe upper 51 in an upper area that extends from the ankle area to the upper border of the shoe upper 51. Furthermore, straps 202 run over a lower area of the shoe upper that extends from an ankle area to the toe region. In some embodiments, the straps 201 and 202 are made from TPU. In other embodiments, the straps 201 and 202 may be made from rubber or any other suitable material. The straps 201 and 202 may provide targeted compression to the shoe upper, i.e. the shoe upper tightly adapts to the form of the foot.

A different course of the straps 201 and 202 according to requirements may be included in other embodiments. Also, a different number of straps may be used, for example, only one. The straps 201 and 202 may be laminated to the shoe upper 51. However, it is also possible to print the straps.

In the exemplary embodiments of FIG. 20, a cage construction 203 is shown in the heel region as well. The cage construction 203 extends over the heel and protects the heel from external forces, while also improving transmission of forces from the foot to the sole 61. In some embodiments, the cage construction 203 is made from TPU. In other embodiments, the cage construction 203 may be made from EVA or rubber or any other suitable material.

Further, some embodiments of the soccer shoe according to the invention may comprise a support element or support elements, e.g. one or more elastic straps to provide additional support in certain areas of the foot. For example, one support element may be arranged such that it extends from a medial side over a foot arranged in the soccer shoe to the lateral side of the soccer shoe.

The soccer shoe 91 according to certain embodiments of the invention described above may be manufactured with a method comprising the following steps: providing the sole 61, weft-knitting or warp-knitting the knitwear for the upper 51, such that the knitwear is capable of coupling the sole 61 to a foot of a wearer of the soccer shoe 91 while the soccer shoe 91 is worn and, finally, connecting the sole 61 to the upper 51. The provided sole 61 may be a rigid sole.

The knitwear may be weft-knitted or warp-knitted such that the knitwear may extend above an ankle of a foot while the soccer shoe 91 is worn. The step of weft-knitting or warp-knitting the knitwear may further comprise the steps of: weft-knitting or warp-knitting multiple weft-knitted or warp-knitted sections and joining the multiple weft-knitted or warp-knitted sections to form the knitwear.

The invention has been described in relation to soccer shoes. Basically, however, the invention is not restricted to soccer shoes, but may be applied to any kind of shoe, in particular a sports shoe. The invention may in particular be applied to climbing shoes, running shoes and shoes for ball sports. Further sports where the described invention may be used are yoga, rambling, trekking, hiking, tennis, cycling, football, rugby, baseball and volleyball, and activities on sports equipment such as for example cross trainers and steppers. The mentioned sports shoes, sports and activities are not to be understood as limiting.

In the following, further examples are described to facilitate the understanding of the invention:

1. Soccer shoe (91), comprising:
   an upper (51) comprising knitwear; and
   a sole (61) which comprises cleats and is connected to the knitwear, wherein the knitwear is capable of coupling the sole (61) to a foot of a wearer of the soccer shoe (91) while the soccer shoe (91) is being worn.
2. Soccer shoe (91) according to example 1, wherein the sole (61) is a rigid sole.
3. Soccer shoe (91) according to one of examples 1 to 2, wherein the knitwear is capable of extending above an ankle of the foot while it is worn.
4. Soccer shoe (91) according to one of the preceding examples, wherein the knitwear consists of several weft-knitted or warp-knitted sections.
5. Soccer shoe (91) according to one of examples 1 to 3, wherein the knitwear is formed as one-piece knitwear.
6. Soccer shoe (91) according to one of the preceding examples, wherein the knitwear substantially encloses a foot of a wearer of the soccer shoe (91).
7. Soccer shoe (91) according to one of the preceding examples, wherein the knitwear is weft-knitted.
8. Soccer shoe (91) according to one of examples 1 to 6, wherein the knitwear is warp-knitted.
9. Soccer shoe (91) according to one of the preceding examples, wherein the knitwear is formed to fulfil the function of a tongue in the area of the instep.
10. Soccer shoe (91) according to one of the preceding examples, wherein the knitwear is formed to fulfil the function of laces.
11. Soccer shoe (91) according to one of the preceding examples, wherein the sole (61) is injection molded to the upper.
12. Soccer shoe (91) according to one of the preceding examples, wherein the knitwear of the upper (51) comprises a first and a second weft-knitted or warp-knitted layer.
13. Soccer shoe (91) according to example 12, wherein a reinforcement is arranged between the first and the second weft-knit or warp-knit layer.
14. Soccer shoe (91) according to example 13, wherein the reinforcement is made from plastic.
15. Soccer shoe (91) according to one of examples 13 to 14, wherein the reinforcement is arranged in a lateral area or in a medial area or in a lateral and a medial area of the upper (51).
16. Soccer shoe (91) according to one of the preceding examples, wherein the upper (51) does not comprise a securing element.

17. Soccer shoe (91) according to one of the preceding examples, wherein the knitwear is coated, such that the friction between a soccer ball and the knitwear is increased compared to uncoated knitwear.
18. Soccer shoe (91) according to one of the preceding examples, wherein the upper (51) comprises such a height that the upper edge of the upper overlaps a section of a shin guard when wearing the soccer shoe (91).
19. Soccer shoe (91) according to one of the preceding examples, wherein the knitwear is made on a flat weft-knitting or warp-knitting machine.
20. Soccer shoe (91) according to one of the preceding examples, wherein the knitwear is made on a circular weft-knitting or warp-knitting machine.
21. Soccer shoe (91) according to one of the preceding examples, wherein the upper (51) comprises means to connect the upper to a shin guard or a soccer sock.
22. Soccer shoe (91) according to example 21, wherein the means is a hook-and-loop fastener.
23. Soccer shoe (91) according to one of the preceding examples, wherein the knitwear is reinforced with a polymer reinforcement.
24. Method of manufacturing a soccer shoe according to one of the preceding examples, comprising:
    providing the sole;
    weft-knitting or warp-knitting the knitwear for the upper, such that the knitwear is capable of coupling the sole to a foot of a wearer of the soccer shoe while the soccer shoe is being worn; and
    connecting the sole to the upper.
25. Method according to example 24, wherein the sole is a rigid sole.
26. Method according to one of examples 24 to 25, wherein the knitwear is weft-knitted or warp-knitted such that the knitwear is capable of extending above an ankle of the foot while it is being worn.
27. Method according to one of examples 24 to 26, wherein the weft-knitting or warp-knitting of the knitwear further comprises:
    weft-knitting or warp-knitting multiple weft-knitted or warp-knitted sections; and
    joining the multiple weft-knitted or warp-knitted section to form the knitwear.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A soccer shoe comprising:
a sole comprising cleats;
a plurality of textile sections forming an upper connected to the sole, the upper configured to cover a majority of a shin of a wearer when the soccer shoe is worn;
wherein the plurality of textile sections comprises at least two knitted textile sections positioned over a foot of the wearer when the soccer shoe is worn and configured to create a firm coupling between the upper and the foot without laces;
wherein a portion of the upper extending above an ankle of the wearer when the soccer shoe is worn comprises a channel;
a plurality of seams connecting the at least two knitted textile sections, the plurality of seams including at least one seam in an area of the upper that can make contact with a ball when the soccer shoe is in use; and
at least one strap enclosing an exterior surface of the at least one seam in the area of the upper that can make contact with the ball when the soccer shoe is in use;
wherein the at least one strap is shaped to contour to a longitudinal and a lateral shape of the at least one seam.

2. The soccer shoe of claim 1, wherein the at least two knitted textile sections comprise at least one section reinforced with a polymer reinforcement.

3. The soccer shoe of claim 1, wherein the channel is made from a different material from the upper and is separately attached to the upper.

4. The soccer shoe of claim 1, wherein the sole is a rigid sole.

5. The soccer shoe of claim 1, further comprising a midsole formed of expanded thermoplastic polyurethane.

6. The soccer shoe of claim 1, wherein the at least two knitted textile sections substantially enclose the foot of the wearer when the soccer shoe is worn.

7. The soccer shoe of claim 1, wherein the soccer shoe does not comprise a separate tongue in an area of an instep.

8. The soccer shoe of claim 1, wherein the soccer shoe does not comprise laces.

9. The soccer shoe of claim 1, wherein the upper is configured to connect to a shin guard or a soccer sock.

10. The soccer shoe of claim 1, wherein the at least two knitted textile sections include a section that is weft-knitted or warp-knitted.

11. The soccer shoe of claim 1, wherein the upper further comprises a toe region having an alveolar structure.

12. The soccer shoe of claim 1, wherein the upper is configured to substantially overlap a shin guard positioned over the shin of the wearer when the soccer shoe is worn.

13. A shoe comprising:
a sole;
a plurality of textile sections forming an upper connected to the sole, the upper configured to cover at least half of a shin of a wearer when the shoe is worn;
wherein the plurality of textile sections comprises at least two knitted textile sections positioned over a foot of the wearer when the shoe is worn and configured to create a firm coupling between the upper and the foot without laces; and
wherein the upper comprises an elastic support element that extends from a medial side to a lateral side of the upper over the foot of the wearer when the shoe is worn;
a plurality of seams connecting the at least two knitted textile sections, the plurality of seams comprising at least one seam in an exterior area of the upper; and
at least one strap enclosing an exterior surface of the at least one seam in the exterior area of the upper;
wherein the at least one strap is shaped to contour to a longitudinal and a lateral shape of the at least one seam.

14. The shoe of claim 13, wherein the at least two knitted textile sections comprise at least one section reinforced with a polymer reinforcement.

15. The shoe of claim 14, wherein the polymer reinforcement is positioned on a surface of the at least one section.

16. The shoe of claim 13, wherein the upper is configured to couple to a shin guard when the shoe is worn by the wearer.

17. The shoe of claim 16, wherein the upper is coupled to the shin guard using at least one of a coupling mechanism or a compression of the plurality of textile sections.

18. The shoe of claim 13, wherein the at least two knitted textile sections include more than one weft-knitted or warp-knitted sections.

19. The shoe of claim 13, wherein the at least two knitted textile sections include at least one section formed as one-piece knitwear.

20. The shoe of claim 13, wherein the upper is configured to cover substantially all of the shin of the wearer when the soccer shoe is worn.

21. The shoe of claim 13, wherein the at least two knitted textile sections include at least one section made on a flat weft-knitting or warp-knitting machine.

22. The shoe of claim 13, wherein the at least two knitted textile sections include a section made on a circular weft-knitting or warp-knitting machine.

23. The shoe of claim 13, wherein the upper further comprises a toe region having an alveolar structure.

24. The shoe of claim 13, wherein the upper is configured to substantially overlap a shin guard positioned over the shin of the wearer when the soccer shoe is worn.

25. The soccer shoe of claim 13, wherein the soccer shoe does not comprise laces.

* * * * *